US006565112B2

(12) United States Patent
Hanson et al.

(10) Patent No.: US 6,565,112 B2
(45) Date of Patent: May 20, 2003

(54) AMBULATORY CARE CHAIR

(75) Inventors: Thomas W. Hanson, Loveland, OH (US); John D. Vogel, Columbus; Steven V. McCaig, Batesville, both of IN (US); Jack C. Newkirk, Bradford, MA (US); Donald E. Smith, Greensburg; Jonathan D. Turner, Dillsboro, both of IN (US); Terence M. Duncan, Kentwood, MI (US); Gary S. Siegle, Cincinnati, OH (US); Gregory J. Figel, Mason, OH (US); Jeffrey A. Heyser, Fairfield, OH (US); William M. Blyshak, Milan; Michael P. Bish, Lawrenceburg, both of IN (US)

(73) Assignee: Hill-Rom Services, Inc., Batesville, IN (US)

( * ) Notice: Subject to any disclaimer, the term of this patent is extended or adjusted under 35 U.S.C. 154(b) by 0 days.

(21) Appl. No.: 09/963,829

(22) Filed: Sep. 26, 2001

(65) Prior Publication Data

US 2002/0014751 A1 Feb. 7, 2002

Related U.S. Application Data

(62) Division of application No. 09/546,548, filed on Apr. 10, 2000, now Pat. No. 6,315,319, which is a division of application No. 08/798,317, filed on Feb. 10, 1997, now Pat. No. 6,089,593.

(51) Int. Cl.[7] ..... A47C 1/032

(52) U.S. Cl. ..... 280/650; 280/250.1; 280/304.1; 297/341; 297/344.15

(58) Field of Search ..... 280/647, 648, 280/650, 47.38, 47.4, 47.41, 250.1, 304.1; 297/330, 383, 341, 344.15, 344.16, 344.17, DIG. 4, DIG. 10, 68, 69, 75, 325, 84, 85; 16/35 R; 5/611, 614, 617, 618, 620, 86.1

(56) References Cited

U.S. PATENT DOCUMENTS 93,660 A 8/1869 Theaker
346,246 A 7/1886 Uhde (List continued on next page.)

FOREIGN PATENT DOCUMENTS

JP 58-63575 4/1983

OTHER PUBLICATIONS

Ortho–Biotic® Seating Product Brochure, "Table–Mate Posture–Glide™ Loungers", Lumex, 1987, four pages.

(List continued on next page.)

*Primary Examiner*—Avraham Lerner
(74) *Attorney, Agent, or Firm*—Barnes & Thornburg

(57) ABSTRACT

A chair for transporting a patient includes a base frame, a plurality of casters mounted to the base frame, a seat, and a push bar mounted to a back section of the seat for use when transporting the patient. A wheel is coupled to the base frame for movement between a downward brake-steer position, facilitating steering the chair during transport of the patient, and an upward neutral position. A brake mechanism brakes the casters when the brake mechanism is in a braking position and permits rotation of the casters when the brake mechanism is in a releasing position. A brake-steer shaft is coupled to the brake mechanism. Movement of the shaft moves the brake mechanism between the braking position and the releasing position. The brake-steer shaft is pivotably coupled to the base frame. The brake-steer shaft is coupled to the wheel so that rotation of the brake-steer shaft moves the wheel between the brake-steer position and the neutral position. A neutral pedal is coupled to the brake-steer shaft so that movement of the neutral pedal to a neutral position automatically rotates the brake-steer shaft to move the wheel to the neutral position.

7 Claims, 23 Drawing Sheets

U.S. PATENT DOCUMENTS 825,984 A 7/1906 Schmersahl
1,398,203 A 11/1921 Schmidt
2,308,592 A 1/1943 Drexler et al.
2,766,463 A 10/1956 Bendersky
3,038,174 A 6/1962 Brown et al.
3,053,568 A 9/1962 Miller
3,096,121 A 7/1963 Knabusch et al.
3,099,487 A 7/1963 Knabusch et al.
3,210,779 A 10/1965 Herbold
3,217,340 A 11/1965 Durr
3,235,304 A 2/1966 Glass
3,235,307 A 2/1966 Knabusch et al.
3,304,116 A 2/1967 Stryker
3,325,210 A 6/1967 Knabusch et al.
3,336,606 A 8/1967 Beitzel
3,357,739 A 12/1967 Knabush et al.
3,406,772 A 10/1968 Ahrent et al.
3,484,132 A 12/1969 Biagi
3,484,133 A 12/1969 White et al.
3,695,701 A 10/1972 Knabusch et al.
3,711,876 A 1/1973 Kirkland et al.
3,793,652 A 2/1974 Linehan et al.
3,801,122 A 4/1974 Shoemaker et al.
3,848,924 A 11/1974 Shoemaker et al.
3,965,500 A 6/1976 Stein, Jr.
4,092,041 A 5/1978 Landry et al.
4,119,342 A 10/1978 Jones
4,153,292 A 5/1979 White et al.
4,183,109 A 1/1980 Howell
4,227,269 A 10/1980 Johnston
4,367,895 A 1/1983 Pacitti et al.
4,381,571 A 5/1983 Elliott
4,385,410 A 5/1983 Elliott et al.
4,407,030 A 10/1983 Elliott
4,451,945 A 6/1984 Heinz et al.
4,453,732 A 6/1984 Assanah et al.
4,555,121 A 11/1985 Lockard et al.
4,592,104 A 6/1986 Foster et al.
4,629,242 A 12/1986 Schrager
4,639,954 A 2/1987 Speed
4,751,754 A 6/1988 Bailey et al.
4,790,599 A 12/1988 Goldman
4,862,529 A 9/1989 Peck
4,894,876 A 1/1990 Fenwick
4,918,766 A 4/1990 Leonaggeo, Jr.
4,949,410 A 8/1990 Failor et al.
4,974,905 A 12/1990 Davis
5,011,220 A 4/1991 LaPointe
5,033,793 A 7/1991 Quintile
5,073,463 A 12/1991 Willis
5,074,000 A 12/1991 Soltani et al.
5,148,562 A 9/1992 Borders et al.
5,195,803 A 3/1993 Quintile
5,203,610 A 4/1993 Miller
5,222,567 A 6/1993 Broadhead et al.
5,230,113 A 7/1993 Foster et al.
5,242,179 A 9/1993 Beddome et al.
5,279,010 A 1/1994 Ferrand et al.
5,282,395 A 2/1994 LaPointe et al.
5,288,126 A 2/1994 Saul et al.
5,294,141 A 3/1994 Mentessi et al.
5,377,372 A 1/1995 Rudolf et al.
5,398,357 A 3/1995 Foster
5,421,598 A 6/1995 Robertson et al.
5,547,245 A 8/1996 Knouse
5,651,422 A 7/1997 Casali
6,315,319 B1 * 4/2000 Hanson et al. ..... 280/650
6,089,593 A * 7/2000 Hanson et al. ..... 280/650

OTHER PUBLICATIONS

Ortho–Biotic® Seating Product Brochure, "3 Position Recliner—Model No. 574", Lumex, 1986, four pages.

Thayercare© Product Brochure, "5235 Recliner", Thayer Coggin Institutional, date unknown, two pages.

Patient Lounger Product Brochure, "4 Position Recliner", T.B.S., date unknown, two pages.

Invacare® Innovation in Health Care™ Product Brochure, "Comfort+Plus™ Seating System", date unknown four pages.

Treatment Chairs Pristo™ Product Brochure, Nemschoff, date unknown, four pages.

LA–Z–Boy® Contract Product Brochure, "Health Care Products", date unknown, four pages.

Anatome UNE Revolution, Le Couviour Product Brochure, Groupe Hill–Rom®, date unknown, six pages.

* cited by examiner

AMBULATORY CARE CHAIR

This is a division of U.S. Ser. No. 09/546,548, filed Apr. 10, 2000, now U.S. Pat. No. 6,315,319. U.S. Ser. No. 09/546,548 is itself a division of U.S. Ser. No. 08/798,317, filed Feb. 10, 1997, now U.S. Pat. No. 6,089,593. Both U.S. Ser. Nos. 08/798,317 and 09/546,548 are assigned to the same assignee as this application.

BACKGROUND AND SUMMARY OF THE INVENTION

The present invention relates to a wheeled chair for use in a hospital or other health care facility, and particularly to an ambulatory care chair that converts between a chair and a table. More particularly, the present invention relates to a wheeled hospital chair having articulated patient-support sections that move relative to one another between a generally upright position and a generally horizontal table position and that can be tilted and elevated so that a patient can rest and be transported in the chair. The chair can be converted to a table for supporting the patient during medical procedures without having to transfer the patient between separate chairs and tables.

Carriers for transporting a patient in a hospital or other care facility from one location to another are well known in the art. Conventional wheelchairs may be used by a caregiver to transport the patient when the patient is conscious and capable of sitting in an upright position. Such wheelchairs may also be used in a hospital to transport patients between hospital stations for medical testing, therapy, or recreation. In addition, wheelchairs having features designed to aid in the transfer of a patient between the hospital bed and the wheelchair are known in the art. See, for example, U.S. Pat. No. 4,453,732 to Assanah et al. and U.S. Pat. No. 4,119,342 to Jones. Each of these references discloses a wheelchair having back, seat, and leg sections that are convertible to a horizontal stretcher configuration.

Conventional stretchers having flat patient-support surfaces may also be used as a carrier to transport patients. For example, conventional stretchers may transport the patient before or after surgery is performed the patient or when the patient is otherwise incapacitated or unable to sit upright. Conventional stretchers that raise and lower can be used to transfer patients from the stretcher to a surface of an operating table, a bed, or another patient surface by adjusting the height of the stretcher to the same height as the patient surface receiving the patient. See, for example, U.S. Pat. No. 4,629,242 to Schrager and U.S. Pat. No. 3,304,116 to Stryker, each of which discloses a stretcher having a patient-support surface that can be vertically adjusted.

Caregivers may wish to adjust the position of the patient supported by the carrier. In addition, a patient supported by the carrier may wish to adjust their own position for reasons of comfort. Carriers having articulated back, seat, and leg sections that assist patients in moving between a lying-down position and a sitting-up position are known in the art. See, for example, U.S. Pat. No. 5,230,113 to Foster et al.; U.S. Pat. No. 5,398,357 to Foster; and U.S. Pat. No. 4,862,529 to Peck, all of which are assigned to the assignee of the present invention. Each of these references discloses a hospital bed that is convertible to a chair configuration.

Some hospital beds having patient-support decks including articulated patient-support sections also have mechanisms that adjust the height of the patient-support deck relative to a base frame. In addition, these hospital beds may include mechanisms that tilt the patient-support deck relative to the base frame. See, for example, U.S. Pat. No. 5,148,562 to Borders et al.; U.S. Pat. No. 4,894,876 to Fenwick; and U.S. Pat. No. 4,862,529 to Peck, all of which are assigned to the assignee of the present invention. Each of these references discloses a bed having an intermediate frame that is mounted to a base frame for vertical and tilting movement with respect thereto. Each reference also discloses an articulated patient-support deck carried by the intermediate frame and including patient-support sections that are movable relative to the intermediate frame.

What is desired is an ambulatory care chair that can be used both to transport the patient and as an operating chair or table when minor surgical procedures are to be performed on the patient. The ambulatory care chair should provide a comfortable and adjustable patient-support surface on which the patient can rest prior to such procedures, when recovering after such procedures, and at other times when desired. Such a chair should have articulated back, seat, and leg sections that are adjustable between a sitting-up position supporting the patient in a sitting position and a table position having the back, seat, and leg sections aligned and defining a generally planar upwardly-facing patient-support surface supporting the patient in a supine position. In addition, the ambulatory care chair should include mechanisms for raising and lowering the back, seat, and leg sections relative to a floor and mechanisms for tilting the back, seat, and leg sections.

According to the present invention, a chair is provided for supporting a patient above a floor. The chair includes a base frame and an intermediate frame coupled to the base frame for pivoting movement relative to the base frame about a generally horizontal transverse axis. An articulated patient support is mounted to the intermediate frame. The patient support has longitudinally spaced back and seat sections mounted to the intermediate frame for movement relative to one another and relative to the intermediate frame. The back and seat sections are movable relative to the base frame about the horizontal transverse axis of the intermediate frame.

In preferred embodiments, the ambulatory care chair includes an articulated patient support defining a patient-support surface. The patient support has back, seat, and leg sections that are mounted to the intermediate frame for movement between a sitting-up position carrying the patient in a sitting position and a table position carrying the patient in a supine position. The back, seat, and leg sections are lockable relative to the intermediate frame in an infinite number of positions between the sitting-up and table positions. In addition, the patient support can be tilted between a Trendelenburg position and a reverse Trendelenburg position when the sections of the patient support are in the table position. When the sections of the patient support are in the sitting-up position, the patient support can be tilted rearwardly to rock the patient to a leaned-back position or forwardly to assist with patient egress from the chair.

The ambulatory care chair includes a base frame having a lower frame and a staging frame mounted to the lower frame for upward and downward movement with respect thereto. An intermediate frame is pivotably mounted to the staging frame for pivoting movement relative to the staging frame about a generally transverse horizontal axis. The intermediate frame pivots between a forward tilt position and a rearward tilt position and is lockable at an infinite number of positions therebetween. The sections of the patient support are mounted to the intermediate frame for movement relative to the intermediate frame. When the patient support moves between the sitting-up and the table positions, the back and seat sections, move relative to the base frame about the same horizontal transverse axis as the intermediate frame when the intermediate frame pivots between the forward tilt position and the rearward tilt position.

The ambulatory care chair also includes foot pedals that control upward and downward movement of the staging frame, the intermediate frame, and the articulated patient support relative to the lower frame. A recline release handle unlocks the back, seat, and leg sections of the patient support for movement between the sitting-up and table positions relative to the intermediate frame. In addition, a tilt handle can be provided for unlocking the intermediate frame from the staging frame of the base frame for forward and rearward tilting movement about the horizontal axis relative to the staging frame.

The ambulatory care chair also includes a push bar having a grip extending across the back of the chair. When the patient support is in the sitting-up position, the caregiver can grasp the push bar when transporting a patient on the chair. A deployable center wheel can be easily deployed against the floor by the caregiver to assist with steering the ambulatory care chair. The caregiver can move the center wheel into and out of engagement with the floor by actuating a foot pedal coupled to the center wheel by a center wheel deployment mechanism. The foot pedal is also coupled to a braking mechanism which brakes and releases casters mounted to the lower frame. The center wheel automatically deploys against the floor or retracts away from the floor when the caregiver operates the braking mechanism.

When the foot pedal is in a braking position, the braking mechanism brakes two of the casters and prevents the braked casters from rotating or swivelling relative to the base frame. In addition, the center wheel engages the floor providing a third braking point to prevent inadvertent rotation of the chair about the braked casters. When the foot pedal is in a neutral position, the casters are free to rotate and swivel and the center wheel is spaced apart from the floor. When the caregiver moves the foot pedal to a steering position, the casters are free to rotate and swivel and the center wheel is in contact with the floor to assist in steering the chair by providing a frictional contact area about which the chair can be easily turned.

The ambulatory care chair can also include a pair of arm rest assemblies having generally upwardly-facing arm-support surfaces that can be infinitely positioned relative to the seat section between a raised position and a lowered position. Each arm rest assembly includes a locking mechanism that can be locked to lock the arm-support surface at any position between the raised and lowered positions and that can be released allowing the arm-support surface of the arm rest assembly to move relative to the seat section. Each arm rest assembly includes a release handle for releasing the locking mechanism to unlock the arm-support surfaces for upward and downward movement relative to the seat section.

It is within the scope of the invention as presently perceived to mount each arm rest assembly to a side portion of the seat section so that the arm-support surfaces move with the seat section. It is also within the scope of the invention as presently perceived to mount each arm rest assembly to the intermediate frame adjacent to side portions of the seat section so that the arm rest assemblies move with the intermediate frame.

In the upward raised position, the arm-support surfaces of the arm rest assemblies can carry the arms of a patient sitting-up on the patient-support surface when the patient support is in the sitting-up position. In the lowered position, the arm-support surfaces are out of the way of the patient-support surface both to provide a caregiver with unobstructed access to the patient carried by the chair and so that the patient can be transferred between the patient-support surface and another patient-support device without interference from the arm rest assemblies.

Additional objects, features, and advantages of the invention will become apparent to those skilled in the art upon consideration of the following detailed description of preferred embodiments exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figure 2:
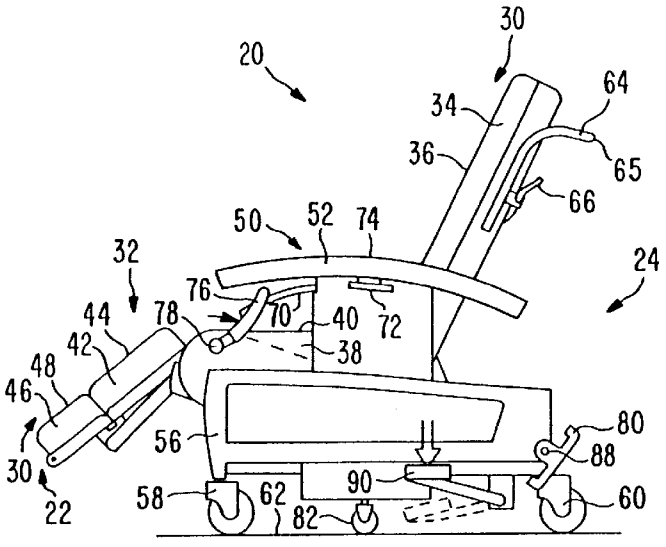
FIG. 2 is a view similar to FIG. 1 showing a leg section deployment handle pivoted from a retracting position of FIG. 1 having the leg section and foot section in a stored position retracted underneath the seat section to an extending position deploying the leg section and foot section to an extended position having the foot section unfolded from underneath the seat section into alignment with the leg section, a pump pedal in a middle locking position vertically locking the patient support relative to the floor, the pump pedal being movable to a downward pumping position (in phantom) to raise the patient support and movable to an upward releasing position to lower the patient support toward the floor, and a brake-steer butterfly pedal forwardly tilted to a steering position having a center wheel contacting the floor and having the front and rear casters free to rotate and swivel so that the chair can be moved and the center wheel can assist with steering.

A first embodiment of an ambulatory care chair 20 in accordance with the present invention is shown in FIGS. 1–13 and a second embodiment of an ambulatory care chair 400 in accordance with the present invention is shown in FIGS. 14–25. Like components shared by chair 20 and chair 400 are identified in the description below using like reference numerals. For example, both chair 20 and chair 400 include a center wheel deployment assembly 138 shown in FIGS. 26 and 27.

Chair 20 includes an articulated patient support 32, as shown in FIGS. 1–6, upon which a patient can rest. Patient support 32 includes a back section 34 having a back-support surface 36, a seat section 38 having a seat-support surface 40, and a leg section 42 having a leg-support surface 44. Chair 20 also includes a foot section 46 having a foot-support surface 48. Back-support surface 36 cooperates with seat-support surface 40, leg-support surface 44, and foot-support surface 48 to define a patient-support surface 30.

Chair 20 has a front end 22, a rear end 24, a first side 26, and a second side 28. As used in this description with reference to chair 20, the phrase "front end 22" will be used to denote the end of any referred-to object that is positioned to lie nearest the front end 22 of chair 20 and the phrase "rear end 24" will be used to denote the end of any referred-to object that is positioned to lie nearest the rear end 24 of chair 20.

Chair 20 includes spaced-apart first and second arm rest assemblies 50 mounted to first side 26 and second side 28 of chair 20, respectively, as shown in FIGS. 1–6. Each arm rest assembly 50 includes an arm rest 52 defining a generally horizontal and upwardly-facing arm-support surface 74 upon which the arms of a person carried by chair 20 can rest.

Figure 6:
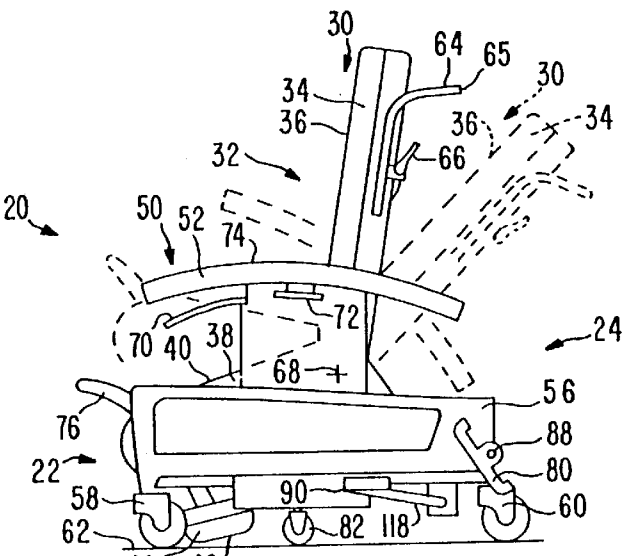
FIG. 6 is a view similar to FIG. 1 showing the patient support in the sitting-up position and tilted to a forward egress position and the tilt handle on the push bar moved to the releasing position so that the patient support can pivot about the horizontal axis between the forward egress position and a leaned-back position (in phantom)
Figure 7:
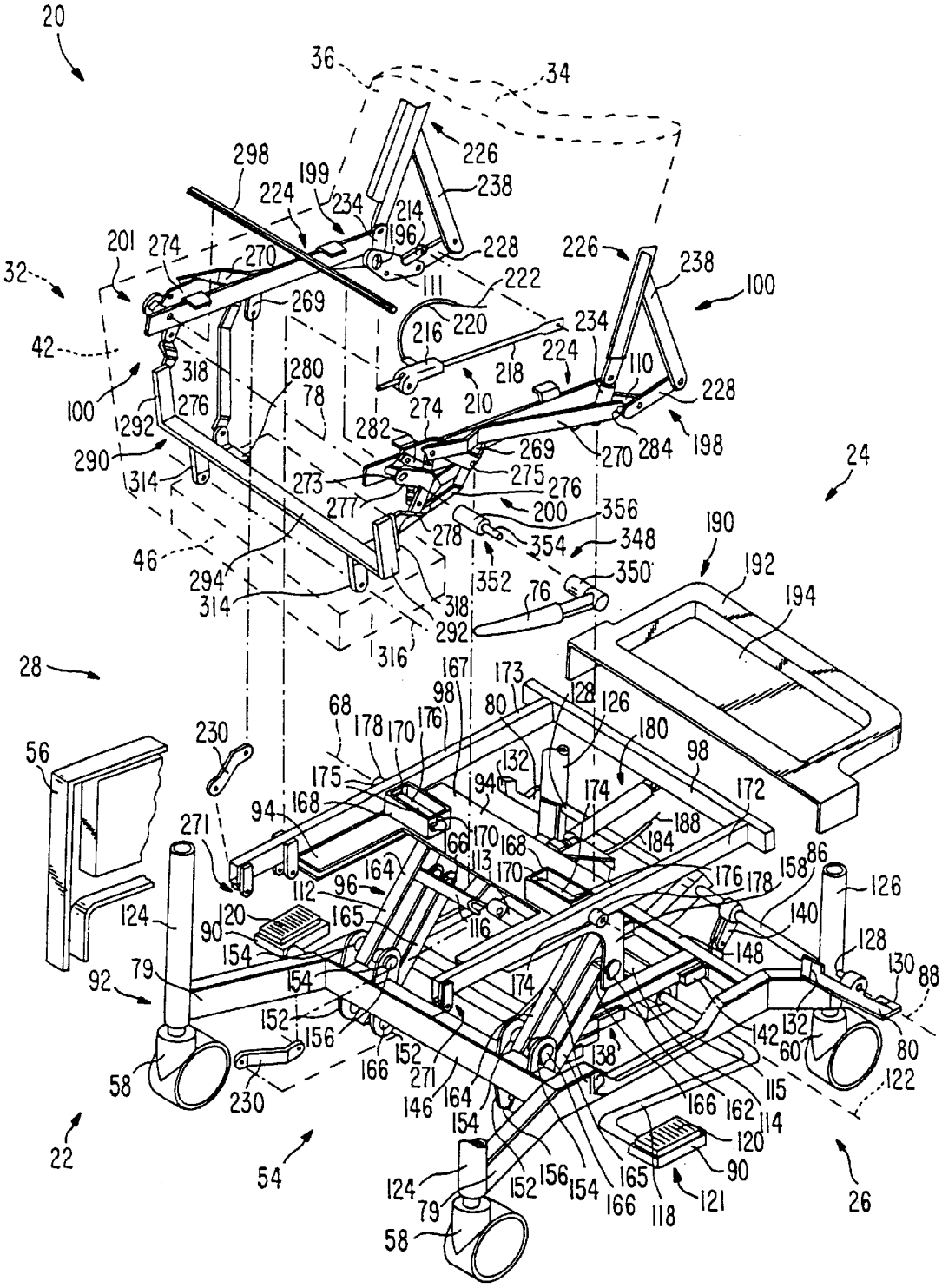
FIG. 7 is an exploded perspective view of the first embodiment of the chair in accordance with the present invention with portions broken away showing a base frame including a lower frame having the front and rear casters engaging the floor and a U-shaped staging frame supported above the lower frame by a pair of spaced-apart parallelogram elevation linkages for upward and downward movement relative thereto, the brake-steer butterfly pedal coupled to the lower frame by a transversely-extending rotatable brake-steer shaft, an intermediate frame pivotably mounted to the staging frame to pivot about a horizontal axis defined by a pair of main journals rigidly coupled to the intermediate frame, the back, seat, leg, and foot sections of the patient support being carried above the intermediate frame and coupled thereto by a control assembly, the back and seat sections being pivotably mounted to outwardly-extending portions of the main journals for movement about the horizontal axis of the intermediate frame, and the leg section deployment handle coupled to a leg deployment assembly of the control assembly so that the leg section can be independently deployed by pivoting the leg section deployment handle.

Chair 20 includes a base frame 54 as shown in FIG. 7. Front casters 58 and rear casters 60 are mounted to base frame 54 so that chair 20 can be rolled over a floor or other surface across which the patient is being transported, hereinafter referred to as floor 62. Front and rear casters 58, 60 each swivel freely about a vertical axis. Base frame 54 is shielded from view by a pair of side panels 56. Patient support 32 is supported above base frame 54 as shown in FIGS. 1–8.

A recline handle 70 is mounted to one of the arm rest assemblies 50. Recline handle 70 is pivotably mounted to arm rest assembly 50 at a position beneath arm rest 52 and extends forwardly therefrom, as shown in FIGS. 1, 2, 5, and 6, for movement between an upward releasing position allowing back, seat, leg, and foot sections 34, 38, 42, 46 to move relative to one another and a downward locking position locking back, seat, leg, and foot sections 34, 38, 42, 46 so that back, seat, leg, and foot sections 34, 38, 42, 46 are fixed relative to one another. Recline handle 70 is biased toward the locking position.

Figure 1:
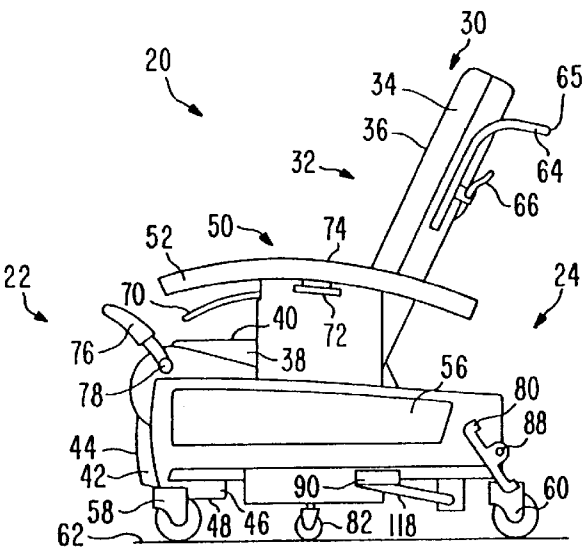
FIG. 1 is a side elevation view of a first embodiment of a chair in accordance with the present invention showing a patient support having back, seat, leg, and foot sections moved to a sitting-up position.
Figure 3:
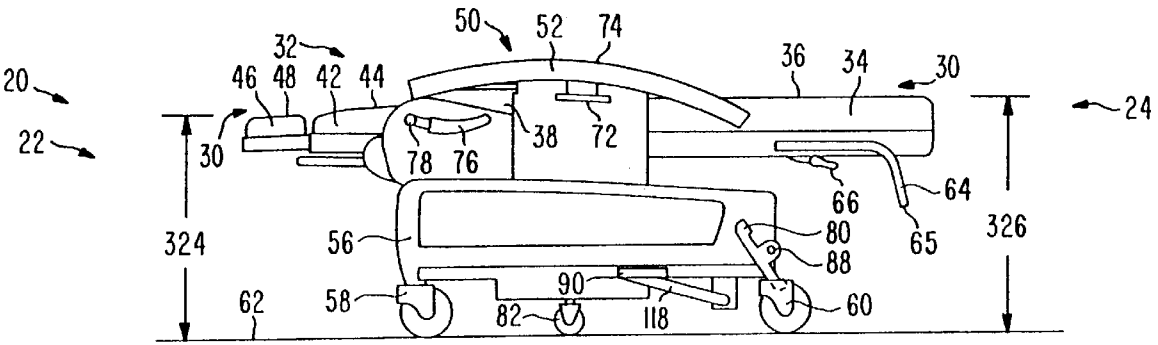
FIG. 3 is a view similar to FIG. 2 showing the back, seat, leg, and foot sections in a table position defining an upwardly-facing patient-support surface that is generally planar and oriented in a generally horizontal "home" position and the leg section deployment handle automatically rotated to a generally horizontal position away from the patient-support surface when the patient support is moved from the sitting-up position to the table position.
Figure 4:
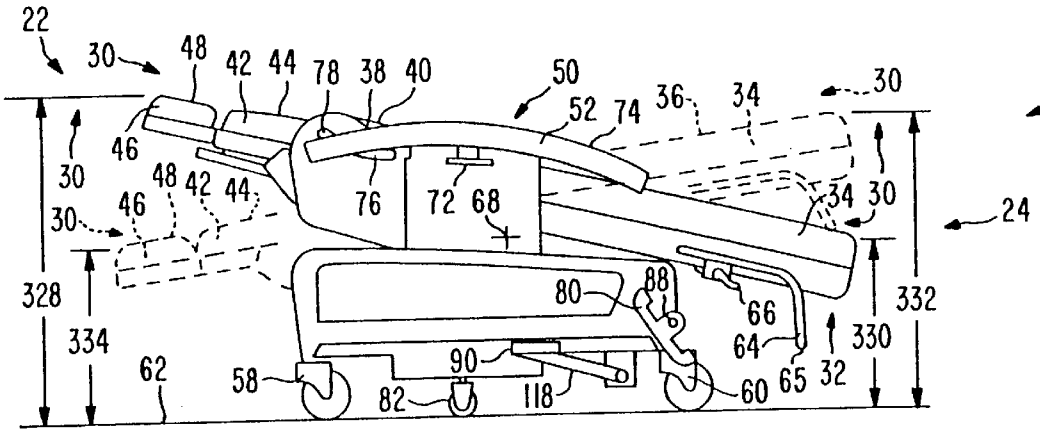
FIG. 4 is a view similar to FIG. 3 showing the back, seat, leg, and foot sections locked in the table position and a tilt handle on a push bar moved to a releasing position so that the patient support pivots about a horizontal axis between a Trendelenburg position and a reverse Trendelenburg position (in phantom)

Movement of recline handle 70 to the releasing position allows back, seat, leg, and foot sections 34, 38, 42, 46 to be moved between a sitting-up position shown in FIG. 1 and a table position shown in FIG. 3. In the sitting-up position, seat section 38 is generally horizontal so that seat-support surface 40 faces generally upwardly, back section 34 extends generally upwardly from rear end 24 of seat section 38 so that back-support surface 36 faces generally toward front end 22 of chair 20, and leg section 42 extends generally downwardly from front end 22 of seat section 38 so that leg-support surface 44 faces generally forwardly toward front end 22 of chair 20 as shown in FIG. 1. In the table position, back, seat, leg, and foot sections 34, 38, 42, 46 are generally aligned so that back-support surface 36, seat-support surface 40, leg-support surface 44, and foot-support surface 48 face generally upwardly and are generally coplanar as shown in FIGS. 3 and 4. Back, seat, leg, and foot sections 34, 38, 42 can be locked in an infinite number of positions between the sitting-up position and the table position by moving release handle 70 to the locking position when back, seat, leg, and foot sections 34, 38, 42, 46 are at a desired position between the sitting-up position and the table position.

A push bar 64 having a generally horizontal grip 65 is mounted to back section 34 and a tilt lever 66 is pivotably mounted to push bar 64 as shown in FIG. 1 for movement between a locking position and a releasing position. Movement of tilt lever 66 from the locking position to the releasing position allows patient support 32 to be tilted from front to back about a horizontal axis 68 as shown in FIGS. 4 and 6.

Hereinafter, components of chair 20 will be described as tilting "forwardly" when each referred-to component is rotated about an axis so that front end 22 of the component is lowered and rear end 24 of the component is raised. Likewise, components of chair 20 will be described as tilting "rearwardly" when each referred-to component is rotated about an axis so that rear end 24 of the component is lowered and front end 22 of the component is raised. Patient support 32 can be tilted forwardly and rearwardly when back, seat, leg, and foot sections 34, 38, 42, 46 are locked in the sitting-up position, the table position, or any position therebetween.

Figure 5:
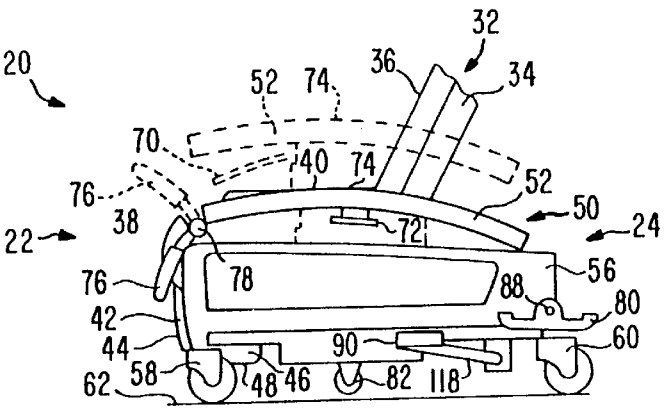
FIG. 5 is a view similar to FIG. 1 showing the leg section deployment handle disengaged from the leg section and the foot section and rotated to a down-out-of-the-way position away from the patient-support surface, the brake-steer butterfly pedal in a generally horizontal neutral position so that the center wheel is moved away from the floor and the front and rear casters rotate and swivel, and an arm rest of an arm rest assembly in a raised position (in phantom) having the arm rest elevated above the seat section and in a lowered position having an arm-support surface of the arm rest generally coplanar with a seat-support surface of the seat section, the arm rest being movable between the raised and lowered positions when an arm rest release handle is moved to a releasing position and being lockable at any position between the raised and lowered positions when the arm rest release handle is moved to a locking position.

When back, seat, leg, and foot sections 34, 38, 42, 46 are locked in the sitting-up position, patient support 32 can be tilted forwardly from a generally horizontal "home" position, shown in FIGS. 1, 2, and 5, to a forward egress position shown in FIG. 6 so that the person sitting in chair 20 can more easily egress from chair 20 to a standing position. In addition, patient support 32 can be tilted rearwardly to a leaned-back position, shown in FIG. 6 (in phantom), when back, seat, leg, and foot sections 34, 38, 42, 46 are locked in the sitting-up position. A storage shelf 190 is mounted to rear end 24 of intermediate frame 98 to tilt therewith as shown best in FIG. 7. Storage shelf 190 has a top surface 192 formed to include a storage pan 194. Objects (not shown) can be placed in storage pan 194 and carried by chair 20.

When back, seat, leg, and foot sections 34, 38, 42, 46 are locked in the table position, patient support 32 can be placed in the home position as shown in FIG. 3. In the home position, front end 22 of patient-support surface 30 is spaced apart from floor 62 by a distance 324, rear end 24 of patient-support surface 30 is spaced apart from floor 62 by a distance 326, and distances 324, 326 are generally equal so that patient-support surface 30 is generally level. In addition, when patient support 32 is locked in the table position, patient support 32 can be tilted rearwardly to a Trendelenburg position having front end 22 of patient-support surface 30 spaced apart from floor 62 a distance 328 and rear end 24 of patient-support surface 30 spaced apart from floor 62 a distance 330 that is less than distance 328, as shown in FIG. 4. Patient support 32 also can be tilted forwardly to a reverse Trendelenburg position having rear end 24 of patient-support surface 30 spaced apart from floor 62 a distance 332 and front end 22 of patient-support surface 30 spaced apart from floor 62 a distance 334 that is less than distance 332, as also shown in FIG. 4 (in phantom).

An arm rest release handle 72 is mounted to each arm rest assembly 50 as shown in FIGS. 1–6. Each release handle 72 extends downwardly from underneath arm rest 52 for movement between an upward releasing position allowing arm rest 52 to move vertically relative to seat section 38 and a downward locking position locking arm rest 52 relative to seat section 38 so that each arm rest 52 is fixed relative to seat section 38. Each release handle 72 is biased toward the locking position.

Movement of release handle 72 from the locking position to the releasing position allows the corresponding arm rest 52 to move between a raised position shown in FIGS. 1–6 (in phantom in FIG. 5) and a lowered position shown in FIG. 5. In their raised positions arm rests 52 are elevated above seat section 38 and in their lowered positions arm rests 52 are adjacent to seat section 38 so that arm-support surface 74 of each arm rest 52 is generally coplanar with seat-support surface 40.

Each arm rest 52 can be locked in an infinite number of positions between the raised position and the lowered position by moving the corresponding release handle 72 to the locking position when selected arm rest 52 is at a desired position between the upward raised position and the downward lowered position. Although arm rests 52 are adjacent to seat section 38 when in the lowered position so that each arm-support surface 74 is generally coplanar with seat-support surface 40, it is within the scope of the invention as presently perceived to provide arm rest assemblies 50 for which arm-support surfaces 74 are vertically beneath the level of seat support surface 40 when arm rests 52 are in the lowered position.

Figure 9:
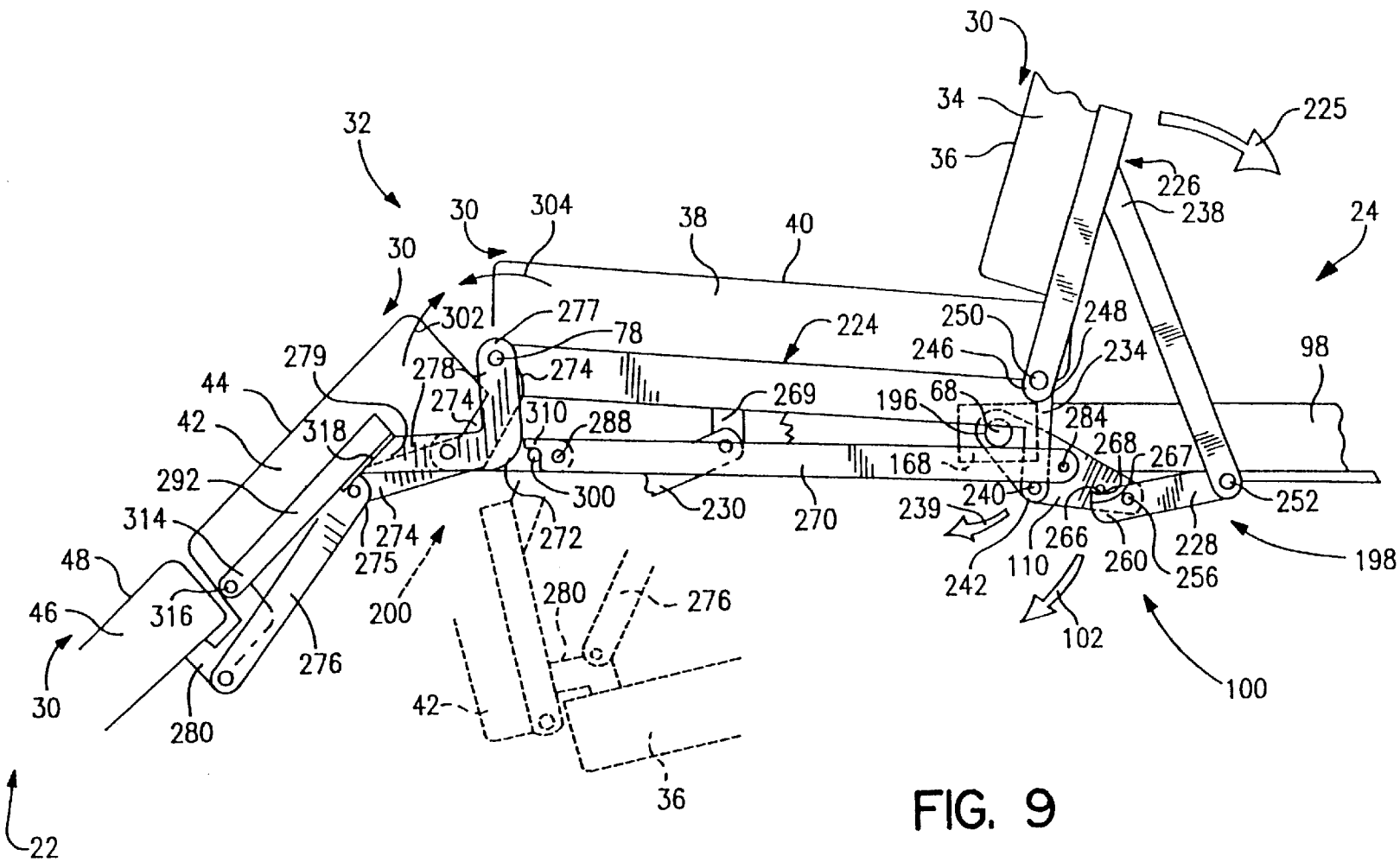
FIG. 9 is a side elevation view of the chair of FIG. 8 with portions broken away showing the back and seat sections in the sitting-up position, the leg and foot sections deployed to the extended position, the control plate in a first orientation, and the control assembly including linkages coupling each of the back, seat, leg, and foot sections of the patient support to the control plate so that rotation of the control plate about the horizontal axis of the intermediate frame causes the patient support to move between the sitting-up position and the table position.

Chair 20 also includes a leg section deployment handle 76, as shown in FIGS. 1–6, that can be used to manually swing leg section 42 about a hinge axis 78 when back section 34 and seat section 38 are locked relative to one another. When back section 34 and seat section 38 are locked in the sitting-up position, handle 76 can be pivoted about axis 78 between a retracting position retracting leg section 42 and foot section 46 to a stored position beneath seat section 38 having leg-support surface 44 facing toward front end 22 of chair 20 and foot-support surface 48 facing generally toward floor 62, as shown in FIGS. 1, 5, and 6, and an extending position extending leg section 42 and foot section 46 to an extended position angling downwardly and away from front end 22 of seat section 38, as shown in FIGS. 2 and 9.

Handle 76 can also be pulled axially away from patient support 32 along axis 78 from a driving state coupled to leg section 42 to a decoupled state connected to patient support 32 but decoupled from the leg section 42. Leg section 42 moves relative to seat section 38 in response to pivoting movement of handle 76 when handle 76 is in the driving state and leg section 42 remains stationary relative to seat section 38 in response to pivoting movement of handle 76 when handle 76 is in the decoupled state. When disengaged from leg section 42, handle 76 can be pivoted forwardly or rearwardly to be positioned below seat-support surface 40 in an infinite number of down-out-of-the-way positions, one of which is shown in FIG. 5. When handle 76 is in the down-out-of-the-way position and arm rests 52 are in the lowered position, the caregiver will have unobstructed access to patient-support surface 30 so that the patient supported by chair 20 can be easily moved from chair 20 to another patient-support device without interference from arm rests 52 or handle 76.

As previously described, chair 20 includes foot section 46 having foot-support surface 48. Foot section 46 is mounted to leg section 42 as shown best in FIGS. 2–4. When leg section 42 and foot section 46 are in the stored position, foot section 46 is positioned to lie underneath seat section 38, as shown in FIGS. 1, 5, and 6, and foot-support surface 48 is curled underneath seat section 38 and faces generally downwardly toward floor 62. When leg and foot sections 42, 46 are in the extended position, foot section 46 is aligned with leg section 42 so that leg-support surface 44 and foot-support surface 48 are generally coplanar. Foot-support surface 48 and leg-support surface 44 are maintained in coplanar relation when leg section 42 is moved between the extended position and the table position.

When leg and foot sections 42, 46 are in the extended position, leg and foot sections 42, 46 automatically deploy to the table position when back section 34 moves from the sitting-up position to the table position. When leg and foot sections 42, 46 move to the table position and handle 76 is in the driving state engaged with leg section 42, handle 76 automatically rotates to a generally horizontal position, shown in FIG. 3, when back section 34 moves to the table position.

Chair 20 also includes a pair of brake-steer butterfly pedals 80 mounted to first and second sides 26, 28 of chair 20 and coupled to base frame 54. Pedals 80 are fixed to a brake-steer shaft 86 that is mounted to base frame 54 to rotate about a transversely-extending pivot axis 88. Shaft 86 is coupled to rear casters 60 and is coupled to a center wheel 82 so that movement of pedals 80 controls braking and releasing of rear casters 60 and controls movement of center wheel 82 between a downward brake-steer position engaging floor 62 as shown in FIGS. 1–4, and 6, and a neutral position spaced apart from floor 62 as shown in FIG. 5.

When pedals 80 are tilted rearwardly to a braking position as shown in FIGS. 1, 3, 4, and 6, rear casters 60 are braked to prevent rear casters 60 from rotating or swiveling. In addition, center wheel 82 is moved to the brake-steer position engaging floor 62 to assist in preventing pivoting movement of chair 20 about either of braked rear casters 60. When pedals 80 are moved to a generally horizontal neutral position as shown in FIG. 5, rear casters 60 are no longer braked so that rear casters 60 can rotate and swivel and center wheel 82 moves to the neutral position spaced apart from floor 62. Finally, when pedals 80 are tilted forwardly to a steering position as shown in FIG. 2, rear casters 60 can rotate and swivel and center wheel 82 moves back to the brake-steer position engaging floor 62 to assist in steering chair 20 by providing a frictional contact area with floor 62 about which chair 20 can be easily turned.

A pump pedal 90 is pivotably mounted to each side 26, 28 of chair 20 to control the raising and lowering of patient support 32 relative to floor 62. Pump pedals 90 are normally in a middle locking position shown in FIGS. 1–6, vertically locking patient support 32 relative to floor 62. Pump pedals 90 can be depressed to a downward pumping position shown in FIG. 2 (in phantom) and can be "pumped" so that pump pedals 90 reciprocate between the middle locking position and the downward pumping position to raise patient support 32 relative to floor 62. In addition, pump pedals 90 can be lifted from the middle locking position to an upward releasing position releasing patient support 32 relative to floor 62 to lower patient support 32 relative to floor 62.

Thus, chair 20 includes articulated patient support 32 having back, seat, leg, and foot sections 34, 38, 42, 46 that are movable and lockable between the sitting-up position, as shown in FIGS. 1, 5, and 6, and the table position, as shown in FIGS. 3 and 4. In addition, patient support 32 is forwardly and rearwardly tiltable about axis 68 when back, seat, leg, and foot sections 34, 38, 42, 46 are locked in the sitting-up position, the table position, or any position therebetween. Furthermore, articulated patient support 32 can be raised and lowered relative to floor 62. Leg section 42 and foot section 46 can be retracted to the stored position, can be manually extended to the extended position when back and seat sections 34, 38 are in the sitting-up position, and can be automatically deployed from the extended position to the table position to be coplanar with seat section 38 and back section 34 when back and seat sections 34, 38 are moved to the table position. Additionally, chair 20 includes center wheel 82 that can be moved into and out of engagement with floor 62 and arm rest assemblies 50 having arm rests 52 that are each lockable at an infinite number of positions between the upward raised position and the downward lowered position.

As can be seen, chair 20 is especially useful in a patient care facility such as a hospital for use by patients receiving emergency care, outpatient surgery, and other same day surgical procedures. A patient can be queued and then transported on chair 20 from a waiting room to an operating room while sitting upright with chair 20 in the sitting-up position. Once in the operating room, chair 20 can be moved to the fully flat table position, arm rests 52 can be moved to the lowered positions, and, if desired, patient-support surface 30 can be raised or lowered and the patient can be transferred from patient-support surface 30 to an operating table. After the procedure is complete, the patient can recover on chair 20 which can be moved to the Trendelenburg position if required and which can be moved to assist patient egress from chair 20 as shown in FIG. 6.

Base frame 54 of chair 20 includes a lower frame 92 having casters 58, 60 engaging floor 62, a U-shaped staging frame 94, above lower frame 92, and an elevation mechanism 96 mounting staging frame 94 above lower frame 92 for upward and downward movement with respect thereto, as shown in FIG. 7, so that staging frame 94 can be raised and lowered relative to floor 62. An intermediate frame 98 is pivotably mounted to staging frame 94 to tilt forwardly and rearwardly about axis 68 between a forward tilt position and a rearward tilt position, respectively. A control linkage assembly 100 (hereinafter assembly 100) is carried by intermediate frame 98 and connects patient support 32 to intermediate frame 98. Assembly 100 controls the pivoting movement of each of back, seat, leg, and foot sections 34, 38, 42, 46 relative to intermediate frame 98. Thus, sections 34, 38, 42, 46 of patient support 32 move relative to one another in response to movement of assembly 100, patient support 32 tilts relative to floor 62 with intermediate frame 98, and patient support 32 raises and lowers relative to floor 62 with staging frame 94.

Lower frame 92 of chair 20 includes a transversely-extending front member 146, a transversely-extending rear member 148, and first and second spaced-apart side members 79 connecting front and rear members 146, 148 as shown best in FIG. 7. Each side member 79 includes an upwardly-extending front tube 124 at front end 22 of side member 79 and an upwardly-extending rear tube 126 at rear end 24 of side member 79. Front casters 58 are mounted to and extend downwardly from front tubes 124 and rear casters 60 are mounted to and extend downwardly from rear tubes 126. Side panels 56 are mounted to front and rear tubes 124, 126 to shield lower frame 92 and portions of elevation mechanism 96 from view and to prevent foreign objects from being inadvertently inserted underneath seat section 38 from either side 26, 28 of chair 20.

Each rear tube 126 of lower frame 92 is formed to include apertures 128 and shaft 86 is received by apertures 128 for rotation relative to lower frame 92 about pivot axis 88 as shown in FIG. 7. Portions of shaft 86 extend transversely outwardly past each rear tube 126 to define outwardly-extending portions of shaft 86. Pedals 80 are fixed to the outwardly-extending portions of shaft 86 so that pivoting either of pedals 80 about axis 88 rotates shaft 86 about axis 88.

Each pedal 80 includes a braking portion 130 and a steering portion 132 as shown in FIG. 7. Applying a downward contact force to braking portion 130 of either pedal 80 rotates shaft 86 about pivot axis 88 in a braking direction indicated by arrow 134 shown in FIG. 8 until shaft 86 and pedal 80 reach the braking position. Applying a downward contact force to steering portion 132 of either of pedals 80 rotates shaft 86 about axis 88 in a steering direction indicated by arrow 136 also shown in FIG. 8 until shaft 86 and pedal 80 reach the steering position.

Shaft 86 is coupled to each rear caster 60 by a conventional braking mechanism (not shown) well-known to those skilled in the art. When pedal 80 is in the braking position, the braking mechanism moves to a braking position braking rear casters 60 and preventing rear casters 60 from rotating and swivelling. When pedal 80 is in the steering position, the braking mechanism moves to a releasing position releasing rear casters 60 so that rear casters 60 can freely rotate and swivel. Each braking mechanism is attached to shaft 86 and is positioned to lie inside a corresponding rear tube 126.

A center wheel deployment assembly 138 couples shaft 86 to center wheel 82 so that rotation of shaft 86 about axis 88 moves center wheel 82 relative to floor 62 between the neutral position and the brake-steer position. Center wheel deployment assembly 138 includes a pivot link 140 attached to shaft 86 and an elongated fork 142 coupling pivot link 140 to center wheel 82 as shown in FIGS. 7 and 8 and as described in more detail hereinafter with reference to FIGS. 26 and 27.

Figure 8:
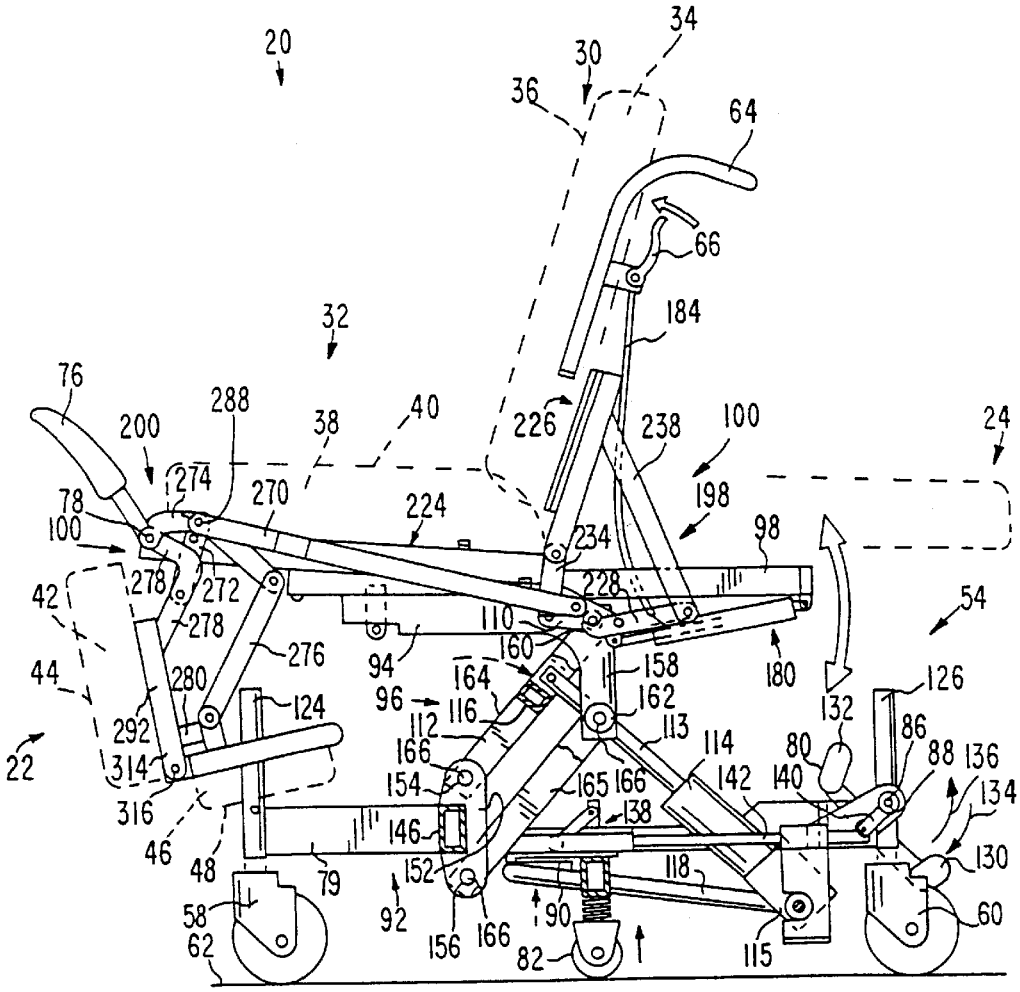
FIG. 8 is a side elevation view of the chair of FIG. 7 with portions broken away showing the back and seat sections of the patient support in the sitting-up position and the leg section in the stored position, the intermediate frame in a generally horizontal "home" position and tiltable about the horizontal axis, and a generally triangular control plate of the control assembly coupled to each of the back, seat, and leg sections and rotatable about the horizontal axis of the intermediate frame, the control plate being oriented relative to the intermediate frame so that the back and seat sections are in the sitting-up position.

Elevation mechanism 96 of chair 20 for raising and lowering patient support 32 relative to floor 62 includes a pair of spaced-apart parallelogram linkages 112, each of which includes parallel upper and lower links 164, 165 as shown in FIGS. 7 and 8. Parallelogram linkages 112 are connected to one another by a cross member 116 extending transversely therebetween. Each link 164, 165 is pivotably mounted to lower frame 92 for pivoting movement relative to lower frame 92 between an upward raised position and a downward lowered position. A drive mechanism 114 is coupled to lower frame 92 and to cross member 116 for moving links 164, 165 and thus moving staging frame 94, intermediate frame 98, and patient support 32 upward and downward relative to lower frame 92 and floor 62.

Two pairs of flanges 152 are rigidly attached to front member 146 of lower frame 92 as shown in FIGS. 7 and 8. Flanges 152 of each pair of flanges 152 are spaced apart to form a space therebetween as shown best in FIG. 7. Ends of each link 164, 165 are received in the spaces between flanges 152. Each flange 152 is formed to include an upper aperture 154 aligned with an aperture (not shown) of a lower end of one of links 164 and receiving a pivot pin 166 to pivotably connect link 164 to flange 152 and lower frame 92. Each flange 152 is also formed to include a lower aperture 156 aligned with an aperture (not shown) of a lower end of one of links 165 and receiving a pivot pin 166 to pivotably connect link 165 to flange 152 and lower frame 92 as shown best in FIG. 8. Lower aperture 156 is vertically aligned with upper aperture 154.

In addition, upper ends of links 164, 165 are connected to staging frame 94 by spaced-apart first and second flanges 158 extending generally vertically downwardly from staging frame 94 as shown in FIGS. 7 and 8. Each flange 158 is formed to include an upper aperture 160 aligned with an aperture (not shown) of the upper end of one of links 164 and receiving a pivot pin 166 to pivotably connect link 164 to flange 158 and staging frame 94 as shown best in FIG. 8. Each flange 158 is also formed to include a lower aperture 162 aligned with an aperture (not shown) of the upper end of one of links 165 and receiving a pivot pin 166 to pivotably connect link 165 to flange 158 and staging frame 94. Lower aperture 162 is vertically aligned with upper aperture 160.

Apertures 154, 156 of flanges 152 on lower frame 92 and apertures 160, 162 of flanges 158 of staging frame 94 are arranged so that vertical flanges 158 remain vertically oriented during upward and downward pivoting movement of parallel links 164, 165 relative to lower frame 92. As a result, a top surface 167 of staging frame 94 is maintained in a horizontal orientation as staging frame 94 is raised and lowered relative to lower frame 92.

It will be appreciated that various mechanical and electromechanical actuators and drivers may be used to raise and lower staging frame 94 relative to lower frame 92 without exceeding the scope of the invention as presently perceived. It is well known in the hospital bed art that electric drive motors with various types of transmission elements including lead screw drives and various types of mechanical linkages may be used to cause relative movement of portions of hospital stretchers, beds, and chairs. As a result, the terms "drive mechanism" and "drive means" in the specification and in the claims is intended to cover all types of mechanical, electromechanical, hydraulic, and pneumatic mechanisms, including manual cranking mechanisms of all types and including combinations of the above elements for raising and lowering portions of chair 20.

For example, hydraulic cylinder 114 may be the drive mechanism. Hydraulic cylinder 114 includes a piston 113 and a pump 115 for pressurizing hydraulic fluid and controlling the flow of hydraulic fluid into and out of an interior region (not shown) of hydraulic cylinder 114. For example, when pump 115 forces hydraulic fluid into the interior region of hydraulic cylinder 114, piston 113 will extend and push parallelogram linkages 112 upwardly moving staging frame 94 upwardly away from lower frame 92. Although pump 115 is illustratively a hydraulic pump that pumps hydraulic fluid in response to manual movement of pump pedal 90, it is within the scope of the invention as presently perceived for an electric pump to be used to control the movement of hydraulic fluid.

Chair 20 includes a pump pedal arm 118 pivotably coupling pump 115 to pump pedals 90 as shown in FIG. 8 so that pump pedals 90 pivot between the locking position and the releasing position and between the locking position and the pumping position. Each pump pedal 90 includes an upwardly-facing foot-engaging surface 120. The caregiver can apply a downward pumping force to foot-engaging surface 120 of either pump pedal 90 so that pump pedals 90 reciprocate upwardly and downwardly about a transversely-extending pivot axis 122 between the locking position and the pumping position.

Pumping pump pedals 90 between the locking position and the pumping position causes pump 115 to pressurize hydraulic fluid and forces hydraulic fluid into the interior region of hydraulic cylinder 114 to move staging frame 94 upwardly relative to lower frame 92 away from the lowered position and toward the raised position as previously described. Lifting pump pedals 90 upwardly past the locking position to the releasing position allows hydraulic fluid to escape from the interior region of hydraulic cylinder 114 so that piston 113 retracts into hydraulic cylinder 114 and parallelogram linkages 112 pivot downwardly toward the lowered position, lowering staging frame 94 relative to lower frame 92 toward the lowered position.

A pair of upwardly-extending spaced-apart boxes 168 are attached to top surface 167 of staging frame 94 as shown in FIG. 7. Each box 168 is formed to include apertures 170.

Apertures 170 support bearings (not shown) and are collinear so that apertures 170 define axis 68.

A first main journal 174 is rigidly attached to a first side strut 172 of intermediate frame 98 and a second main journal 175 is rigidly attached to a second side strut 173 of intermediate frame 98 as shown in FIG. 7. Journals 174, 175 each include an inwardly-extending portion 176 extending inwardly from intermediate frame 98 and an outwardly-extending portion 178 extending outwardly from intermediate frame 98. Inwardly-extending portions 176 of journals 174, 175 are received by the bearings of corresponding apertures 170 of boxes 168 so that intermediate frame 98 pivots about axis 68 relative to staging frame 94 between the forward tilt position and the rearward tilt position.

A locking mechanism 180 connects intermediate frame 98 to staging frame 94 as shown in FIGS. 7 and 8 for movement between a releasing position allowing intermediate frame 98 to pivot relative to staging frame 94 and a locking position locking intermediate 98 frame to staging frame 94 to prevent pivoting movement of intermediate frame 98 relative to staging frame 94. Locking mechanism 180 can lock intermediate frame 98 in an infinite number of positions between the forward tilt position and the rearward tilt position. Locking mechanism 180 has a front end pivotably coupled to staging frame 94 and a rear end pivotably coupled to intermediate frame 98. Locking mechanism 180 includes a gas spring and hereinafter is referred to alternatively as locking mechanism 180 and gas spring 180.

Gas spring 180 includes a housing and a piston slidably received in the housing. Gas spring 180 can be locked so that the piston is generally fixed relative to the housing and can neither extend further out of the housing nor retract into the housing, thereby preventing intermediate frame 98 from pivoting relative to staging frame 94.

Although locking mechanism 180 is a gas spring for locking intermediate frame 98 relative to staging frame 94, it is within the scope of the invention as presently perceived for locking mechanism 180 to include any locking mechanism that can extend and retract and that can be locked blocking the movement of the locking mechanism and that can be released allowing the movement of the locking mechanism. Thus, the terms locking mechanism and locking means as used in this specification and in the claims includes a gas spring, a spring clutch, a ball screw, a hydraulic cylinder, a pneumatic cylinder, or any other suitable latching or locking mechanism.

A bowden wire 184 including a flexible control cable 188 enclosed in a sheath as shown in FIG. 7 extends from gas spring 180 to tilt lever 66 as shown in FIG. 8 for locking and unlocking gas spring 180 so that movement of the piston of gas spring 180 relative to the housing of gas spring 180 is controlled by the movement of cable 188 of bowden wire 184. When tilt lever 66 is in the locking position, cable 188 of bowden wire 184 is positioned so that the piston is locked relative to the housing. Movement of tilt lever 66 from the locking position to the releasing position moves the cable and releases gas spring 180 so that the piston can slide relative to the housing and intermediate frame 98 can pivot relative to staging frame 94 between the forward tilt position and the rearward tilt position.

Gas spring 180 is yieldably biased into its locked mode and, as a result, gas spring 180 yieldably biases tilt lever 66 toward the locking position. When tilt lever is moved to the releasing position, intermediate frame 98 and patient support 32, which is mounted to intermediate frame 98, can be tilted to a desired position. Tilt lever 66 can be released once intermediate frame is tilted to the desired position so that gas spring 180 locks, thereby locking intermediate frame 98 relative to staging frame 94 and automatically moving control cable 188 of bowden wire 184 and tilt lever 66 to the locking position.

As previously described, assembly 100 is carried by intermediate frame 98 and is coupled to patient support 32 to control pivoting movement of back, seat, leg, and foot sections 34, 38, 42, 46 relative to intermediate frame 98. Back section 34 is defined by transversely spaced-apart back section frame members 226, seat section 38 is defined by transversely spaced-apart seat section frame members 224 pivotably coupled to back section frame members 226 and movably coupled to intermediate frame 98 by control plates 110, 111, leg section 42 is defined by a U-shaped leg section frame 290 pivotably coupled to seat section frame members 224, and foot section 46 is supported by transversely spaced-apart foot section links 280 pivotably coupled to frame 290 of leg section 42 as shown in FIG. 7.

Assembly 100 includes control plate 110 rotatably coupled to intermediate frame 98 adjacent to first side 26 of chair 20 as shown in FIGS. 7–11 and control plate 111 rotatably coupled to intermediate frame 98 adjacent to second side 28 of chair 20. Control plates 110, 111 are each formed to include an aperture 196. Journals 174, 175 are rotatably received by apertures 196 so that control plates 110, 111 are mounted to intermediate frame 98 for rotation about axis 68 relative to intermediate frame 98 and relative to staging frame 94.

Assembly 100 includes first and second reclining linkage assemblies 198, 199 (hereinafter reclining assemblies 198, 199) as shown in FIGS. 7–11. Reclining assemblies 198, 199 are connected to back section 34 and seat section 38 to control pivoting movement of back section 34 and seat section 38 relative to one another and relative to intermediate frame 98. In addition, leg section deployment linkage assemblies 200, 201 (hereinafter leg deployment assemblies 200, 201) are connected to leg, foot, and seat sections 42, 46, 38 to control the movement of leg section 42 and foot section 46 relative to one another, relative to seat section 38, and relative to intermediate frame 98.

Reclining assemblies 198, 199 and leg deployment assemblies 200, 201 are pivotably coupled to control plates 110, 111, respectively, as shown in FIGS. 7–11. As a result, the orientations of control plates 110, 111 relative to intermediate frame 98 establish the positions of back, seat, leg, and foot sections 34, 38, 42, 46 of patient support 32 relative to one another and relative to intermediate frame 98 between the sitting-up position and the table position.

A locking mechanism 210 connects assembly 100 to intermediate frame 98 as shown in FIG. 7. Locking mechanism 210 includes a front end 22 coupled to intermediate frame 98 and a rear end 24 coupled to a tab 214 that is rigidly fixed to control plate 111 as shown in FIG. 7. Locking mechanism 210 can be locked locking front end 22 of locking mechanism 210 relative to rear end 24 and locking mechanism 210 can be released allowing movement of front end 22 relative to rear end 24 so that locking mechanism 210 can extend and retract. When front end 22 of locking mechanism 210 is locked relative to rear end 24, locking mechanism 210 blocks movement of control plate 111 relative to intermediate frame 98.

Locking mechanism 210 includes a spring clutch having a clutch housing 216 and a rod 218 slidably received by clutch housing 216. Locking mechanism 210 hereinafter is referred to alternatively as locking mechanism 210 and spring clutch 210. Rod 218 can be locked in an infinite number of positions relative to housing 216. As a result, control plate 111 can be locked in an infinite number of positions relative to intermediate frame 98 and patient support 32 can be locked in an infinite number of positions relative to intermediate frame 98 between the sitting-up position and the table position.

Spring clutch 210 includes a coil gripping spring (not shown) received in clutch housing 216 and defining an interior region receiving a portion of rod 218. When locking mechanism 210 is locked, the gripping spring constricts around rod 218 preventing rod 218 from sliding relative to the spring and to clutch housing 216. Although locking mechanism 210 includes a spring clutch, it is within the scope of the invention as presently perceived for locking mechanism 210 to include any locking mechanism as described above with reference to locking mechanism 180 which is suitable for locking control plate 111 relative to intermediate frame 98.

A bowden wire 220 including a flexible control cable 222 enclosed in a sheath is coupled to the spring and is configured so that control cable 222 can be moved to loosen the spring around rod 218 thereby releasing spring clutch 210 so that rod 218 can slide relative to the spring and relative to clutch housing 216. Bowden wire 220 extends from clutch housing 216 through one of arm rest assemblies 50 to recline handle 70. Control cable 222 is connected to recline handle 70 so that when recline handle 70 is in the locking position, the spring constricts rod 218 and rod 218 is locked relative to clutch housing 216. Locking mechanism 210 is yieldably biased toward its locked position biasing recline handle 70 toward the locking position. When recline handle 70 pivots from the locking position to the releasing position, recline handle 70 moves control cable 222, loosens the spring, and releases locking mechanism 210 allowing rod 218 to slide relative to clutch housing 216. When recline handle 70 is released, locking mechanism 210 automatically locks locking patient support 32 relative to intermediate frame 98 and automatically moving control cable 222 and recline handle 70 to the locking position.

As previously described, assembly 100 includes control plate 110, reclining assembly 198, and leg, deployment assembly 200 on first side 26 of chair 20 and control plate 111, reclining assembly 199, and leg deployment assembly 201 on second side 28 of chair 20 that are similar to corresponding elements on first side 26 of chair 20 except that the portion of assembly 100 mounted on second side 28 is a mirror image of the portion of assembly 100 mounted on first side 26. Control plate 110, reclining assembly 198, and leg deployment assembly 200 and the operation thereof are substantially similar to control plate 111, reclining assembly 199, and leg deployment assembly 201, respectively. Thus, the description herein of control plate 110, reclining assembly 198, and leg deployment assembly 200 applies as well to control plate 111, reclining assembly 199, and leg deployment assembly 201, respectively, unless specifically noted otherwise.

Patient support 32 includes longitudinally extending and laterally spaced-apart back section frame members 226 of back section 34, longitudinally extending and laterally spaced-apart seat section frame members 224 of seat section 38, and leg section frame 290 including longitudinally extending and laterally spaced-apart leg section frame members 292. Reclining assembly 198 connects control plate 110 and intermediate frame 98 to back section 34 and seat section 38 as shown in FIGS. 7–11. Leg deployment assembly 200 connects control plate 110 and recline handle 70 to leg and foot sections 42, 46 of patient support 32.

Reclining assembly 198 includes a seat section link 234 fixed to rear end 24 of seat section frame member 224 and connecting seat section frame member 224 both to control plate 110 and to back section frame member 226 as shown in FIGS. 7–11. A bottom end 242 of seat section link 234 is pivotably coupled to control plate 110 by a pivot pin 240 as shown best in FIGS. 9–11 so that seat section 38 can pivot relative to control plate 110. A top end 248 of seat section link 234 is pivotably coupled to back section frame member 226 by a pivot pin 246 so that back section 34 and seat section 38 pivot relative to one another about a pivot axis 250 defined by pin 246. In addition, reclining assembly 198 includes a tilt link 230 that couples seat section frame member 224 to intermediate frame 98 as shown best in FIG. 7 to control the movement of seat section 38 relative to intermediate frame 98.

Tilt link 230 has a first end pivotably coupled to a flange 269 depending from seat section frame member 224 and a second end pivotably coupled to a set 271 of flanges depending from intermediate frame 98, as shown best in FIG. 7. Flange 269 is positioned to lie approximately mid-way between front end 22 and rear end 24 of seat section frame member 224 and set 271 of flanges is positioned to lie adjacent to front end 22 of intermediate frame 98. Thus, tilt link 230 connects seat section 38 to intermediate frame 98 and seat section link 234 connects seat section 38 to both back section 34 and to intermediate frame 98 through control plate 110 for movement relative thereto.

Reclining assembly 198 also includes a back section strut 238 fixed to back section frame member 226 and extending generally downwardly therefrom as shown in FIGS. 7–11. A pivot pin 252 couples a chair stop link 228 of reclining assembly 198 to strut 238. A pivot pin 256 spaced apart from pin 252 couples chair stop link 228 to control plate 110 so that back section frame member 226 is movably coupled to control plate 110. Thus, back section frame member 226 is coupled to control plate 110 both through chair stop link 228 and through seat section link 234 of seat section frame member 224 so that back section 34, seat section 38, and control plate 110 are pivotably coupled to one another and movement of any one of back section 34, seat section 38, or control plate 110 relative to intermediate frame 98 results in pivoting movement of the others relative to intermediate frame 98.

When back section 34 and seat section 38 are in the sitting-up position, control plate 110 has a first orientation extending generally rearwardly from axis 68 as shown in FIGS. 7–9. As described above, when locking mechanism 210 is locked, locking mechanism 210 blocks movement of control plate 110 relative to intermediate frame 98 so that back section 34 and seat section 38 are locked relative to intermediate frame 98. Releasing locking mechanism 210 allows back section 34 and seat section 38 to move.

For example, when patient support 32 is locked in the sitting-up position as shown in FIG. 9, the caregiver can release locking mechanism 210 and pull back section 34 downwardly about axis 250 toward the table position in the direction indicated by arrow 225. As back section 34 moves downwardly, back section strut 238 is pushed downwardly and forwardly thereby pushing chair stop link 228 forwardly. Forward movement of chair stop link 228 rotates control plate 110 clockwise about axis 68 in the direction indicated by arrow 102 shown in FIG. 9. Clockwise rotation of control plate 110 in direction 102 pushes pivot pin 240 of seat section link 234 along an arc 239 about axis 68 as shown in FIG. 9 moving seat section link 234 and seat section frame member 224 about axis 68 as shown in FIGS. 9 and 10 so that seat section 38 moves about axis 68 in response to the rotation of control plate 110 when back section 34 moves about axis 68 from the sitting-up position to the table position.

Figure 10:
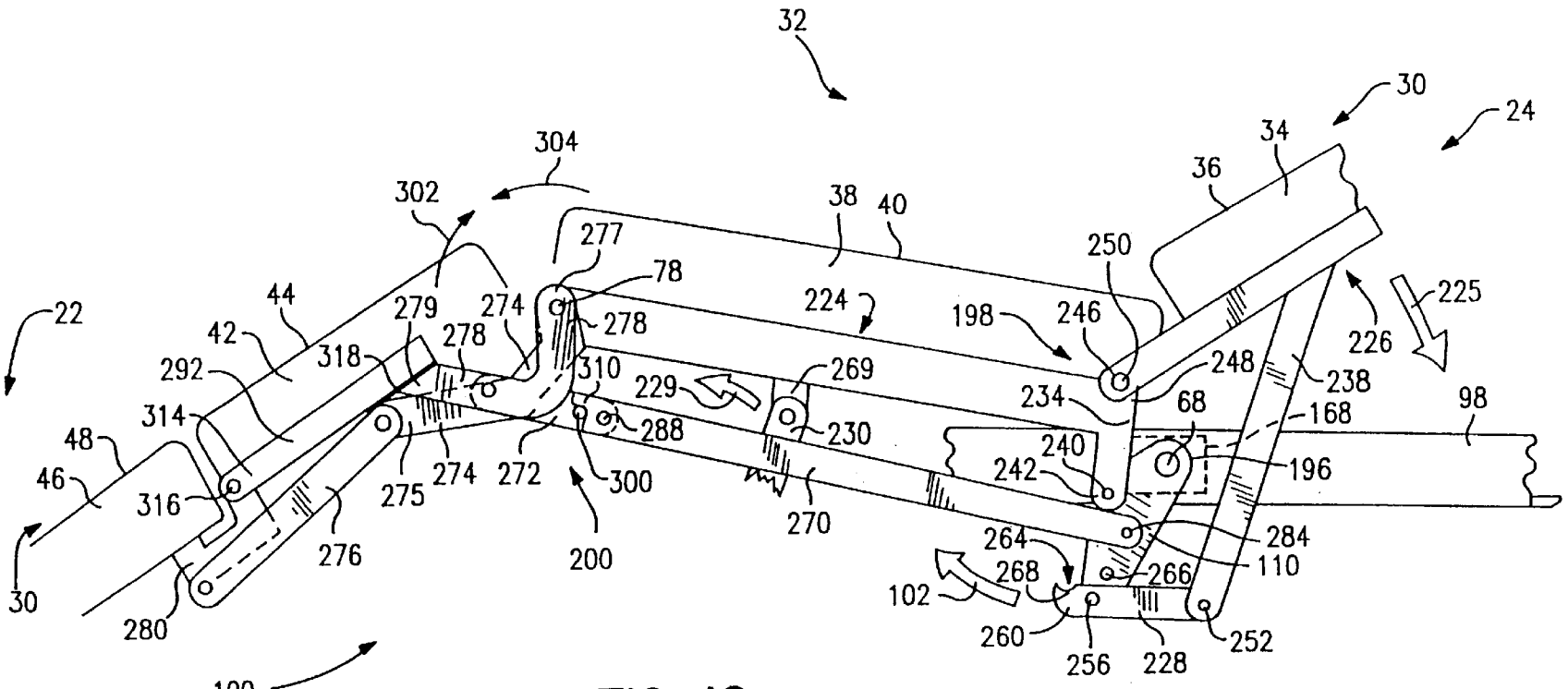
FIG. 10 is a view similar to FIG. 9 showing the patient support in a transitional position between the sitting-up position and the table position having the control plate rotated away from the first orientation in a clockwise direction, the back section pivoted downwardly toward the table position, a front end of the seat section pivoted upwardly, and the leg and foot sections pivoted upwardly toward the table position.
Figure 11:
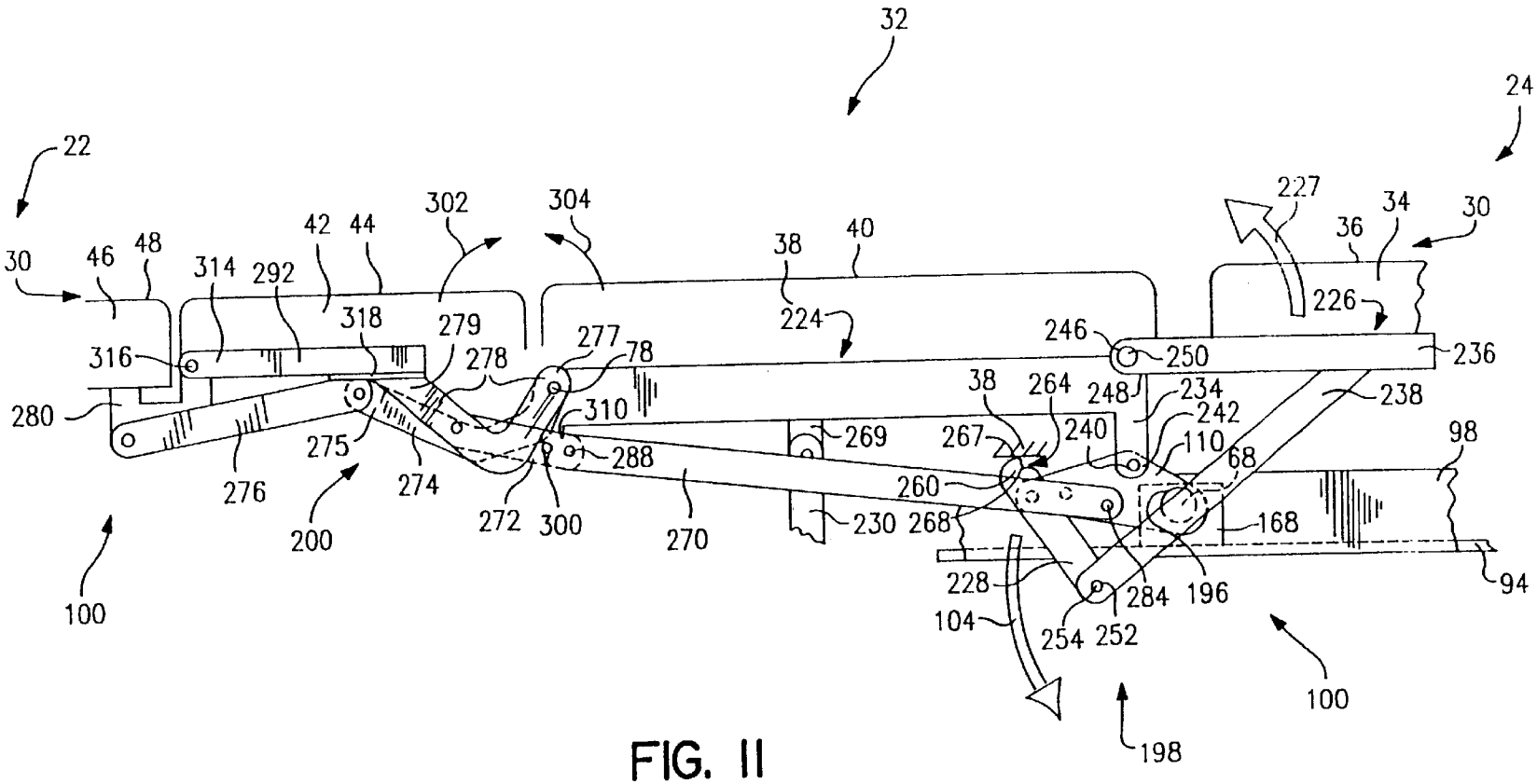
FIG. 11 is a view similar to FIG. 10 showing the patient support in the table position and the control plate in a second orientation, counter clockwise rotation of the control plate resulting in movement of the back, seat, leg, and foot sections from the table position back toward the sitting-up position.

Seat section link 234 cooperates with tilt link 230 to restrict the range of movement of front end 22 of seat section 38 so that as patient support 32 moves from the sitting-up position of FIG. 9 to the table position of FIG. 11, seat section 38 moves from a generally horizontal flat position adjacent to intermediate frame 98 as shown in FIG. 9 to an inclined transitional position having front end 22 of seat section 38 lifted above rear end 24 of seat section as shown in FIG. 10 and then to a generally horizontal position spaced apart from intermediate frame 98 when patient support 32 is in the table position as shown in FIG. 11. It can be seen that back, seat, leg, and foot sections 34, 38, 42, 46 of patient support 32 define a transitional position between the sitting-up position and the table position having front end 22 of seat section 38 above rear end 24 of seat section 38 as shown in FIG. 10. When patient support 32 is in the transitional position, control plate 110 extends generally downwardly from axis 68 as shown in FIG. 10.

When back, seat, leg, and foot sections 34, 38, 42, 46 are locked in the table position of FIG. 11, control plate 110 is in a second orientation extending generally forwardly from axis 68. The caregiver can release locking mechanism 210 and pull back section 34 upwardly relative to seat section 38 about axis 250 away from floor 62 in the direction indicated by arrow 227 shown in FIG. 11, through the transitional position of FIG. 10, and back toward the sitting-up position of FIG. 9.

Chair stop link 228 includes a front portion 260 extending generally forwardly from pin 256 as shown best in FIGS. 9 and 10. Front portion 260 has a front edge 267 and a locking edge 268 adjacent to front edge 267, locking edge 268 defining a notch 264. A stop peg 266 is fixed to control plate 110. Notch 264 receives peg 266 and edge 268 engages peg 266 when back section 34 is in the sitting-up position shown in FIG. 9 blocking the continued rotation of control plate 110 in direction 104 and thereby blocking forward movement of back section 34 past the sitting-up position. When back section 34 and seat section 38 are in the table position shown in FIG. 11, front edge 267 engages a bottom surface 39 of seat section 38 blocking the continued rotation of control plate 110 in direction 102 and thereby blocking downward movement of back section 34 past the table position.

As previously described, leg deployment assembly 200 of assembly 100 controls the movement of leg section 42 and foot section 46 relative to seat section 38 as shown in FIGS. 9–11. Handle 76 is coupled to leg deployment assembly 200 so that movement of handle 76 moves leg section 42 and foot section 46 between the stored position and the extended position described above with reference to FIGS. 1 and 2. In addition, leg deployment assembly 200 is pivotably coupled to control plate 110 so that rotation of control plate 110 about axis 68 causes movement of leg section 42 and foot section 46 between the extended position and the table position as shown in FIGS. 9–11.

Figure 12:
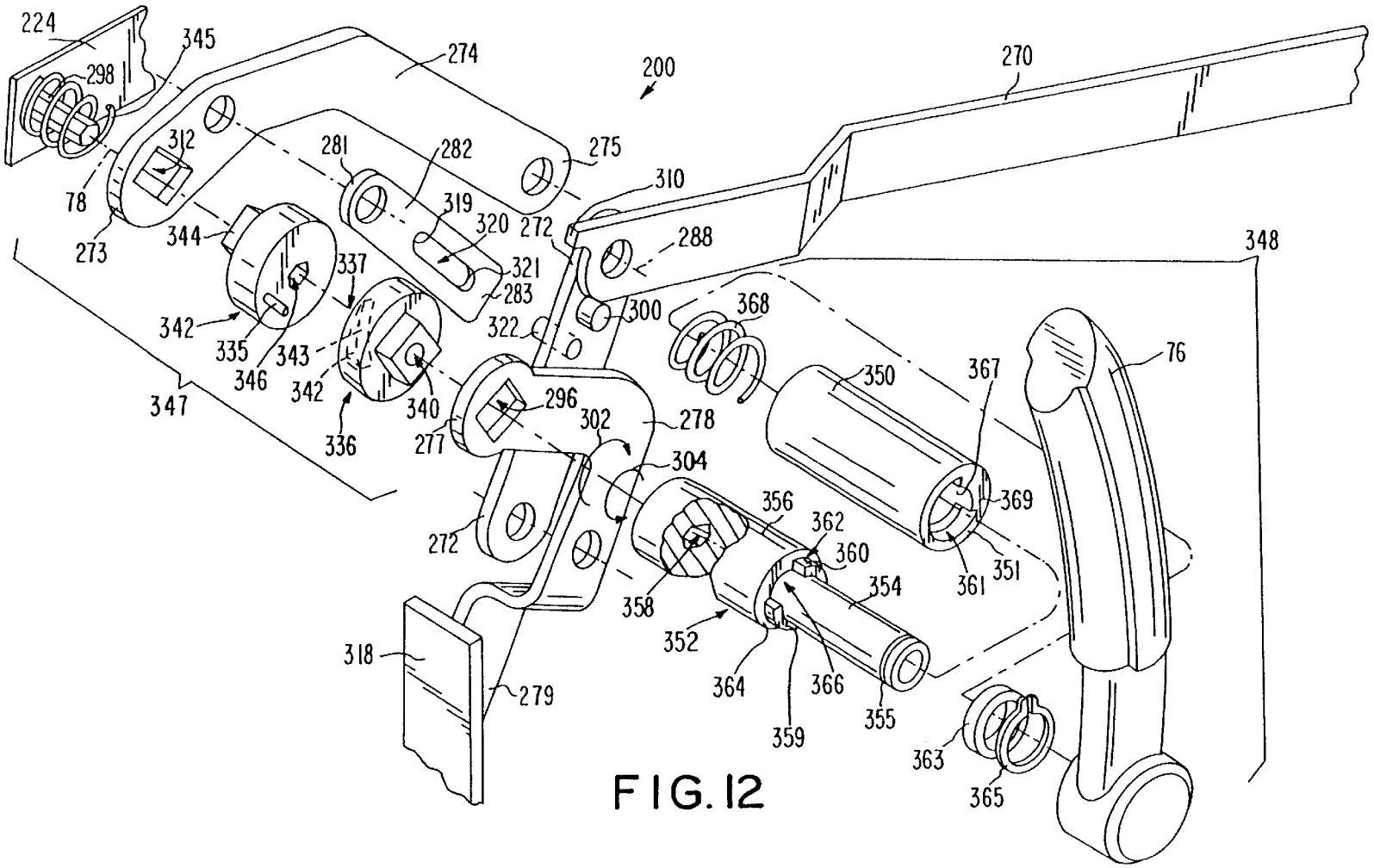
FIG. 12 is an exploded perspective view of a handle assembly of the chair of FIG. 8 for coupling the leg section deployment handle to the leg and foot sections of the patient support showing a handle assembly coupling the leg section deployment handle to a clutch assembly and the clutch assembly coupling the handle assembly to the leg and foot sections so that the leg section deployment handle and the leg and foot sections can move independent of the back and seat sections.

Leg deployment assembly 200 includes a handle assembly 348 including handle 76 and components that couple handle 76 to leg section 42 as shown in FIG. 12. Leg deployment assembly 200 also includes a clutch assembly 347 coupling control plate 110 to handle assembly 348 and allowing movement of handle 76 independent of control plate 110 when handle 76 is used to move leg section 42 between the stored position and the extended position. A hinge shaft 298 having a nonround transverse cross section is connected to handle assembly 348 so that movement of handle 76 about axis 78 causes rotation of shaft 298 about axis 78 which is defined by hinge shaft 298 as shown in FIGS. 1–8 and 12. In addition, hinge shaft 298 connects handle assembly 348 to clutch assembly 347, connects leg section 42 to seat section 40, and connects leg deployment assembly 200 to leg deployment assembly 201 as shown in FIG. 7.

An elongated deployment link 270 couples control plate 110 to leg section frame 290 through an aligning link 272 and a leg section link 278 as shown in FIGS. 9–11. Link 270 is pivotably coupled at its rear end 24 to control plate 110 by a pivot pin 284 and extends generally forwardly from control plate 110 to its front end 22 which is pivotably coupled to aligning link 272 as shown best in FIG. 12. Aligning link 272 extends from the front end of deployment link 270 and is pivotably coupled to a middle portion of leg section link 278 as shown in FIGS. 7–12.

Leg section links 278 of leg deployment assemblies 200, 201 are each formed to include attachment plates 318 as shown in FIGS. 7 and 12. The U-shaped leg section frame 290 includes a transversely-extending central member 294 connecting side members 292 and each side member 292 attaches to one of attachment plates 318 to connect frame 290 to linkage assembly 200 so that movement of leg section link 278 results in movement of leg section 42.

Leg deployment assembly 200 also includes a driven link 274 having a first end 273 formed to include a square-shaped aperture 312 that receives a square-shaped hub 344 of a clutch inner disk 342 of clutch assembly 347 as shown in FIG. 12. Inner disk 342 is formed to include a non-round aperture 346 that drivingly receives shaft 298 so that rotation of shaft 298 causes rotation of inner disk 342 and driven link 274. Shaft 298 has a hexagonal cross section and aperture 346 has a corresponding hexagonal shape. However, it is within the scope of the invention as presently perceived to provide aperture 346 and shaft 298 with a cross section having any non-circular shape so long as inner disk 342 rotates with shaft 298.

Leg section link 278 includes a first end 277 having a square-shaped aperture 296 that receives a square-shaped hub 338 of a clutch outer disk 336 of clutch assembly 347 as shown best in FIG. 12. Outer disk 336 is formed to include an "oversized" aperture 340 that receives hinge shaft 298 so that hinge shaft 298 can rotate relative to outer disk 336 and leg section link 278. Inner disk 342 and outer disk 336 are positioned to lie between leg section link 278 and driven link 274 as shown in FIG. 12 and inner and outer disks 342, 336 slidably engage one another so that shaft 298, inner disk 342, and driven link 274 can rotate relative to outer disk 336, leg section link 278, frame 290, and leg section 42.

A connecting link 276 of leg deployment assembly 200 is pivotably coupled to a second end 275 of driven link 274 as shown in FIGS. 7–11 and extends from driven link 274 to foot section link 280. Foot section link 280 has a first end and pivotably coupled to a flange 314 fixed to central member 294 of leg section frame 290 for pivoting movement about a foot section axis 316 and a second end mounted to foot section 46 so that foot section 46 is pivotable about foot section axis 316 relative to leg section 42.

A slotted link 282 connects aligning link 272 to driven link 274 as shown best in FIG. 12. A first end 281 of slotted link 282 is pivotably coupled to driven link 274 at a position spaced apart from second square-shaped aperture 312 as shown in FIGS. 7 and 12. Slotted link 282 includes an upper edge 319 cooperating with a lower edge 321 to define a slot 320 adjacent to a second end 283 of slotted link 282. A pin 322 is appended to aligning link 272 and is received by slot 320 for sliding and pivoting movement so that slotted link 282 and driven link 274 can slide and pivot relative to aligning link 272.

When leg section 42 and foot section 46 are in the stored position and back section 34 and seat section 38 are locked in the sitting-up position, handle 76 can be manually pivoted about axis 78 from the retracting position to the extending position. When handle 76 pivots, shaft 298, inner disk 342, and driven link 274 rotate about pivot axis 78 and leg section link 278, leg section frame 290, and leg section 42 also pivot about axis 78 due to driving engagement of inner disk 342 with outer disk 336. In addition, when leg section link 278 moves forwardly and upwardly, leg section link 278 pivots aligning link 272 forwardly about a pivot axis 288 relative to deployment link 270 from a generally vertical orientation, as shown in FIG. 8, to a generally horizontal orientation in alignment with deployment link 270, as shown in FIG. 9.

During forward pivoting movement of aligning link 272, pin 322 of aligning link 272 slides within slot 320 away from edge 319 of slotted link 282 and toward edge 321 while axis 288 of aligning link moves downwardly from a raised position shown in FIG. 8 to a lowered position shown in FIG. 9. Downward movement of axis 288 causes deployment link 270 to pivot downwardly about pivot pin 284 relative to control plate 110. Thus, as leg section 42 and leg section link 278 pivot forwardly and upwardly about axis 78, aligning link 272 and deployment link 270 unfold from an angled configuration shown in FIG. 8 to a generally linear in-line configuration shown in FIG. 9.

When aligning link 272 and deployment link 270 reach the in-line configuration, a stop peg 300 appended to aligning link 272 engages a barb 310 appended to front end 22 of deployment link 270 as shown in FIG. 9. Engagement of stop peg 300 with barb 310 blocks further upward pivoting movement of aligning link 272 about axis 288 relative to deployment link 270 thereby blocking upward movement of leg section 42 past the extended position when back section 34 and seat section 38 are in the sitting-up position. It can be seen that when aligning link 272 and deployment link 270 are in the in-line configuration, an "over-center condition" exists in which aligning link 272 cooperates with deployment link 270 to lock leg deployment assembly 200 blocking downward movement of leg section 42 when leg section 42 is in the extended position.

As described above, inner disk 342 drivingly engages outer disk 336 during movement of leg section 42 from the stored position to the extended position so that outer disk 336, leg section link 278, and leg section 42 move together with inner disk 342 and driven link 274. However, outer disk 336 includes a stop face 341 and a ramp surface 343 which define an arcuate recess 337. A drive pin 335 is appended to inner disk 342 and extends into recess 337 of outer disk 336 as shown in FIG. 12. During initial movement of handle 76 from the retracting position toward the extending position, inner disk 342 and outer disk 336 are drivingly coupled together and during later movement of handle 76 toward the extending position, inner disk 342 moves independent of outer disk 336. As a result, the movement of leg and foot sections 42, 46 from the stored position to the extended position occurs in two stages. During the first stage, foot section 46 moves together with leg section 42 until leg section reaches its extended position, thus allowing foot section 46 to "clear" floor 62. During the second stage, foot section 46 moves relative to leg section 42 and uncurls from underneath leg section 42 until foot and leg sections 46, 42 are generally coplanar in the extended position.

When leg section 42 is at the stored position, drive pin 335 engages stop face 341 of outer disk 336. As handle 76 is pivoted in direction 302 to move leg section 42 from the stored position to the extended position, a spring 345 coiled about hinge shaft 298 and compressed between seat section frame member 224 and driven link 274, axially biases inner disk 342 through driven link 274 into engagement with outer disk 336, which is held against axial movement by leg section link 278, so that drive pin 335 of inner disk 342 engages ramp surface 343 of outer disk 336 with sufficient force to rotate outer disk 336 and inner disk 342 together about axis 78 through equivalent angular displacements resulting in foot section 46 pivoting together with leg section 42. Thus, when leg section 42 first reaches its extended position, foot section 46 is still curled beneath leg section 42.

When leg section 42 reaches its extended position, deployment link 270 and aligning link 272 are in the in-line configuration preventing leg section link 278 from pivoting past the extended position toward the table position when back section 34 and seat section 38 are in the sitting up position, as previously described. Continued movement of handle 76 toward the extending position rotates shaft 298, inner disk 342, and driven link 274 about axis 78 independent of outer disk 336, leg section link 278, and leg section 42 which are prevented from moving about axis 78 by links 270, 272. Driven link 274 pushes connecting link 276 and connecting link 276 pushes foot section link 280 pivoting foot section link 280 and foot section 46 relative to leg section 42 until foot section 46 is generally coplanar with leg section 42.

During independent movement of foot section 46 into coplanar relation with leg section 42, shaft 298 rotates within oversized aperture 340 relative to outer disk 336 and leg section link 278. In addition, drive pin 335 separates away from stop face 341 and rides on ramp surface 343 out of recess 337 resulting in axial movement of inner disk 342 and end 273 of driven link 274 along axis 78 toward seat section frame member 224 further compressing spring 345. Handle 76 can be used to rotate shaft 298, inner disk 342, and driven link 274 relative to outer disk 336 and leg section link 278 until second end 275 of driven link engages plate 318, as shown in FIGS. 9–11, at which point handle 76 is in the extending position and foot section 46 is coplanar with leg section 42.

When leg section 42 and foot section 46 are in the extended position, handle 76 can be manually pivoted about axis 78 from the extending position to the retracting position to move leg section 42 and foot section 46 from the extended position to the stored position. Movement of handle 76 in this manner rotates shaft 298, inner disk 342, and driven link 274 counter clockwise in direction 304 as shown in FIGS. 9–11, about axis 78. The movement of driven link 274 in direction 304 pulls slotted link 282 upwardly. As slotted link 282 moves upwardly, lower edge 321 of slotted link 282 engages slot pin 322 and moves slot pin 322 upwardly so that aligning link 272 and deployment link 270 move from the in-line configuration toward the angled configuration thereby moving aligning link 272 and deployment link 270 upwardly at axis 288.

The remaining movement of leg section 42, foot section 46, and leg deployment assembly 200 to the stored position is similar, but opposite to, the movement of leg section 42, foot section 46, and leg deployment assembly 200 from the stored position to the extended position described above. For example, as assembly 200 moves toward the stored position, aligning link 272 pivots rearwardly and downwardly about axis 288 relative to deployment link 270 from the generally horizontal orientation to the generally vertical orientation and upward movement of aligning link 272 and deployment link 270 at axis 288 pivots leg section link 278 downwardly about axis 78 relative to seat section 40.

Once leg section 42 and foot section 46 are moved to the extended position, leg and foot sections 42, 46 can be moved to the table position by pivoting back section 34 downwardly about axis 250 toward floor 62 as described above with reference to FIGS. 9–11 from the sitting-up position to the table position. Movement of back section 34 from the sitting-up position toward the table position rotates control plate 110 about axis 68 in direction 102 from its first orientation.

As control plate 110 rotates about axis 68 in direction 102, pin 284 connecting deployment link 270 to control plate 110 moves about axis 68 and pushes deployment link 270 generally forwardly as shown in FIG. 9. Since aligning link 272 and deployment link 270 are in the in-line configuration when leg and foot sections 42, 46 are in the extended position, aligning link 272 is pushed generally forwardly as well.

Forward movement of aligning link 272 pivots leg section link 278 about axis 78 in direction 302 as shown in FIGS. 9 and 10. Forward movement of aligning link 272 also pivots driven link 274 in direction 302 about axis 78 through the operation of foot section link 280 and connecting link 276. Thus, when leg and foot sections 42, 46 are in the extended position, movement of control plate 110 from the first orientation shown in FIG. 9 through the transitional orientation shown in FIG. 10 to the second orientation shown in FIG. 11 automatically moves leg and foot sections 42, 46 from the extended position shown in FIG. 9 through the transitional position shown in FIG. 10 to the table position shown in FIG. 11.

When second end 275 of driven link 274 engages attachment plate 318, which occurs when leg section 42 and foot section 46 are in the extended position and all positions between the extended position and the table position maintaining the coplanar alignment of leg-support surface 44 and foot-support surface 48, driven link 274 and leg section link 278 pivot together about axis 78. Thus, when leg section 42 and foot section 46 are moved between the extended and table positions, inner disk 342 and outer disk 336 rotate together about axis 78 without any relative motion between them. As a result, handle 76 is moved automatically from the extending position to the down-out-of-the-way position when leg and foot sections are in the extended position and back section 34 is moved to the table position.

When foot section 46 and leg section 42 are in the extended position, the table position, and the positions therebetween, gravity urges foot section 46 and foot section link 280 to pivot downwardly about axis 316 relative to leg section 42. However, the engagement of second end 275 of driven link 274 with attachment plate 318 prevents such movement. Thus, driven link 274 engages attachment plate 318 to lock foot-support surface 48 relative to leg-support surface 44 in coplanar relation when foot section 46 and leg section 42 are in the extended position, the table position, or any position therebetween.

When leg section 42 and foot section 46 are in the table position, back section 34 can swing upwardly about axis 250 from the table position to the sitting-up position. As back section 34 swings to the sitting-up position, control plate 110 rotates from the second orientation toward the first orientation in direction 104 pulling deployment link 270 and aligning link 272 generally rearwardly moving leg section 42 and foot section 46 from the table position to the extended position shown in FIG. 10. The movement of leg section 42, foot section 46, and leg deployment assembly 200 from the table position to the extended position is similar, but opposite to, the movement of leg section 42, foot section 46, and leg deployment assembly 200 from the extended position to the table position described above.

As described above with reference to FIG. 5, handle 76 can be decoupled from clutch assembly 347 and pivoted about axis 78 to the down-out-of-the-way position below seat-support surface 40 so that the caregiver can easily slide the patient supported by chair 20 off of patient-support surface 30 without interference from handle 76. Handle assembly 348 allows handle 76 to be pulled from the driving state axially outwardly along axis 78 to the decoupled state disengaged from leg deployment assemblies 200, 201 so that rotation of handle 76 about axis 78 does not affect the positions of leg section 42 and foot section 46. Handle assembly 348 includes a coupling tube 350 rigidly attached to handle 76 and extending inwardly therefrom. A shaft end cap 352 includes a post 354 received inside of tube 350 and a coupling cylinder 356. appended to post 354, cylinder 356 being formed to include a hexagonal aperture 358 that drivingly receives shaft 298 as shown in FIG. 12 so that rotation of cap 352 about axis 78 by handle 76 and tube 350 causes rotation of shaft 298 about axis 78.

Cap 352 is formed to include an annular ring 360 appended to post 354 adjacent to a shoulder 362 defined by an outer end face 364 of cylinder 356. Ring 360 is formed to include a notch 366. A compression.spring 368 is mounted on post 354 inside tube 350 to yieldably bias a ring 363 mounted on an end of post 354 adjacent handle 76 away from an internal shoulder (not shown) of tube 350, thus yieldably biasing ring 363 outwardly into contact with a C-ring 365 which is received in a circumferential groove 355 formed in an outer end of post 354. C-ring 365 prevents end ring 363 from pushing off of post 354. Spring 368 also yieldably biases handle 76 and tube 350 toward shoulder 362 of cylinder 356.

An inner end of tube 350 is formed to include an annular groove 361 and a lug 367. When lug 367 and notch 366 are aligned, spring 368 yieldably biases lug 367 into notch 366 so that ring 360 of post 354 is received by groove 361 of tube 350 and an inner end face 351 of tube 350 contacts shoulder 362 of cylinder 356. When lug 367 is received by notch 366 and inner end face 351 engages shoulder 362, lug 367 drivingly engages ring 360 and rotation of handle 76 about axis 78 rotates tube 350 which rotates ring 360 thereby rotating cap 352 and shaft 298 about axis 78.

When handle 76 is pulled axially outwardly so that inner end face 351 disengages from shoulder 362, spring 268 is further compressed and lug 367 separates from notch 366 and disengages from ring 360. Rotation of handle 76 about axis 78 when lug 367 is disengaged from ring 360 causes tube 350 to rotate about axis 78 relative to post 354. Spring 368 yieldably biases an inner end face 369 of lug 367 against an outer end face 359 of ring 360 when lug 367 and notch 366 are not in alignment and handle 76 is released so that handle 76 is decoupled from clutch assembly 347 and can rotate about axis 78 to a position beneath patient-support surface 32 without moving leg and foot sections 42, 46.

As previously described, chair 20 includes first arm rest assembly 50 mounted to first side 26 of chair 20 and second arm rest assembly 50 mounted to second side 28 of chair 20 as shown in FIGS. 1–6 and 13. Each arm rest assembly 50 includes arm rest 52 having upwardly-facing arm support surface 74 and arm rest release handle 72 for unlocking arm rest 52 for upward and downward movement relative to seat section 38. The description below of arm rest assembly 50 mounted to first side 26 of chair 20 and shown in FIG. 13 applies as well to arm rest assembly 50 mounted to second side 28 of chair 20 unless specifically noted otherwise.

Figure 13:
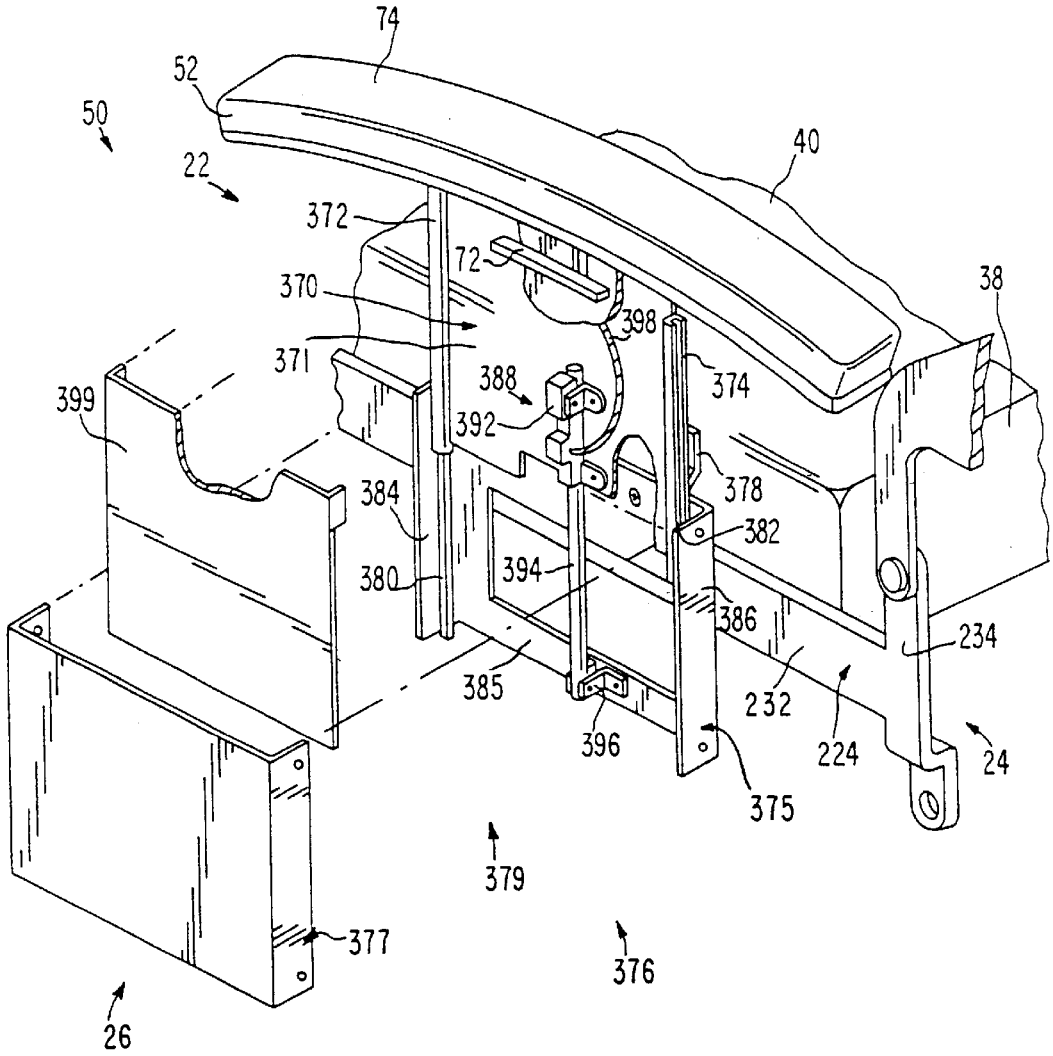
FIG. 13 is an exploded perspective view of a first embodiment of an arm rest assembly in accordance with the present invention with portions broken away showing the arm rest including a generally horizontal arm-support surface mounted to a generally vertically-extending plate slidably mounted to a lower housing that is mounted to a seat section frame member, a locking mechanism having an upwardly-extending rod mounted to the lower housing and a clutch housing mounted to the plate and receiving the rod to lock the lower housing to the plate when the locking mechanism is locked thereby locking the plate and the arm rest relative to the lower housing, and the arm rest release handle coupled to the locking mechanism and mounted to the arm rest for movement between an upward releasing position releasing the locking mechanism and a downward locking position locking the locking mechanism so that the arm-support surface can be locked in an infinite number of positions relative to the seat section of the chair.

Arm rest assembly 50 includes a plate 370 extending generally downwardly from arm rest 52 as shown in FIG. 13. Arm rest assembly 50 also includes a lower housing 376 having an inner casing 375 cooperating with an outer casing 377 to define an interior region 379 receiving plate 370. Outer casing 377 is mounted to inner casing 375 and inner casing 375 is mounted to a side portion of seat section 38 by a mounting bracket 378.

A rearwardly-directed front guide rail 380 is appended to a front wall 384 of inner casing 375 and a forwardly-directed rear guide rail 382 is appended to a rear wall 386 of inner casing 375 as shown in FIG. 13. Front end 22 of plate 370 is formed to include a front guide track 372 and rear end 24 of plate 370 is formed to include a rear guide track 374. Front and rear guide rails 380, 382 are received by front and rear guide tracks 372, 374, respectively, and cooperate therewith to guide the upward and downward movement of plate 370 and arm rest 52 relative to lower housing 376 and seat section 38.

Arm rest assembly 50 additionally includes a locking mechanism 388 movable between a locking position blocking movement of arm rest 52 and plate 370 relative to lower housing 376 and seat section 38 and a releasing position allowing movement of arm rest 52 and plate 370 relative to lower housing 376 and seat section 38. Locking mechanism 388 includes a spring clutch having a clutch housing 392 and a rod 394 received by clutch housing 392 for sliding movement. Rod 394 is mounted to an inner wall 385 of inner casing 375 by a rod bracket 396 and extends generally upwardly from rod bracket 396 as shown in FIG. 13. Clutch housing 392 is mounted to an outer face 371 of plate 370 and rod 394 is received by clutch housing 392. The spring clutch is coupled to arm rest release handle 72 by a bowden wire 398 having a flexible control cable (not shown) surrounded by a sheath. Although locking mechanism 388 includes a spring clutch, it is within the scope of the invention as presently perceived for locking mechanism 388 to include any locking mechanism as described above with reference to locking mechanism 180 which is suitable for locking arm rest 52 relative to seat section 38.

When arm rest release handle 72 is in the downward locking position, locking mechanism 388 is locked blocking the sliding movement of rod 394 relative to clutch housing 392 and blocking the sliding movement of locking plate 370 and arm rest 52 relative to lower housing 376, thus blocking upward and downward movement of arm rest 52 and plate 370 relative to lower housing 376 and seat section 38. When the caregiver moves arm rest release handle 72 to the upward releasing position, the control cable of bowden wire 398 moves locking mechanism 388 to the releasing position so that rod 394 can slide relative to clutch housing 392 and plate 370 and arm rest 52 can move upwardly and downwardly relative to lower housing 376 and seat section 38.

A plate cover 399 attaches to plate 370 so that clutch housing 392 is shielded from view and encased between plate 370 and plate cover 399. Plate cover 399 and plate 370 are positioned to lie between inner casing 375 and outer casing 377 of lower housing 376 so that plate cover 399 and plate 370 telescope into and out of lower housing 376 when arm rest 52 is lowered and raised, respectively, relative to seat section 38.

Figure 14:
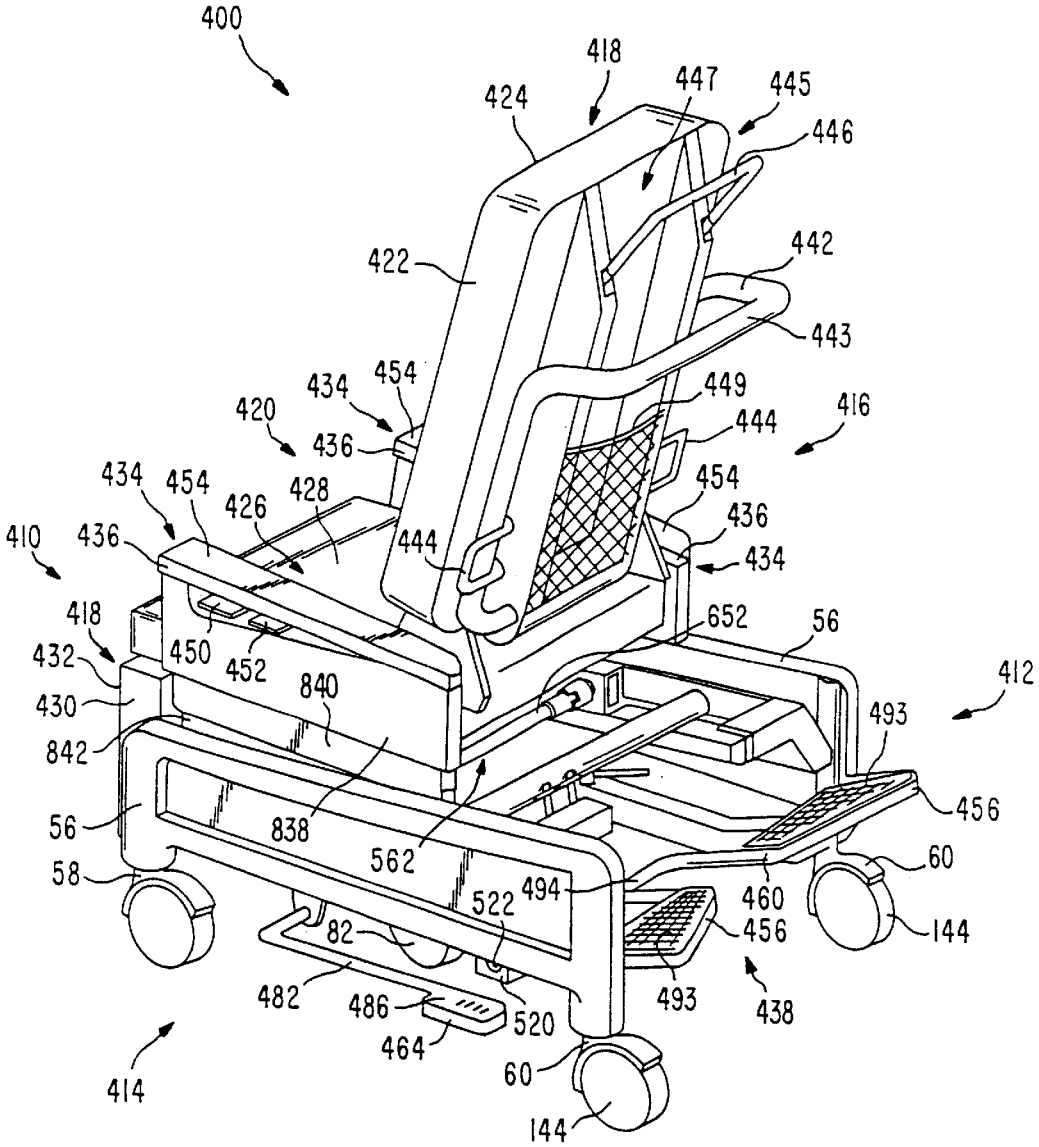
FIG. 14 is a perspective view of a second embodiment of a chair in accordance with the present invention showing an articulated patient support having back, seat, and leg sections in a sitting-up position, an adjustable arm rest assembly mounted to each side of the chair, each arm rest assembly having an arm rest in a raised position above the seat section, front and rear casters and a center wheel in contact with a floor, and controls for controlling the operation of the chair, the controls including a recline handle extending transversely outwardly underneath the arm rest and movable to lock and unlock the back, seat, and leg sections for movement between the sitting-up position and a table position, a push bar mounted to the rear of the back section to be grasped by a caregiver pushing the chair, a forward tilt handle mounted to each side of the push bar, a rearward tilt handle extending across the back of the back section above the push bar, each forward tilt handle and the rearward tilt handle being movable to lock and unlock the patient support for forward and rearward tilting movement, respectively, a pair of brake-steer pedal wings extending rearwardly from the chair and pivotable to brake and release the rear casters and to move the center wheel into and out of contact with the floor, and a pump pedal positioned to lie in front of the brake-steer pedal wings and movable to raise and lower the patient support relative to the floor.
Figure 15:
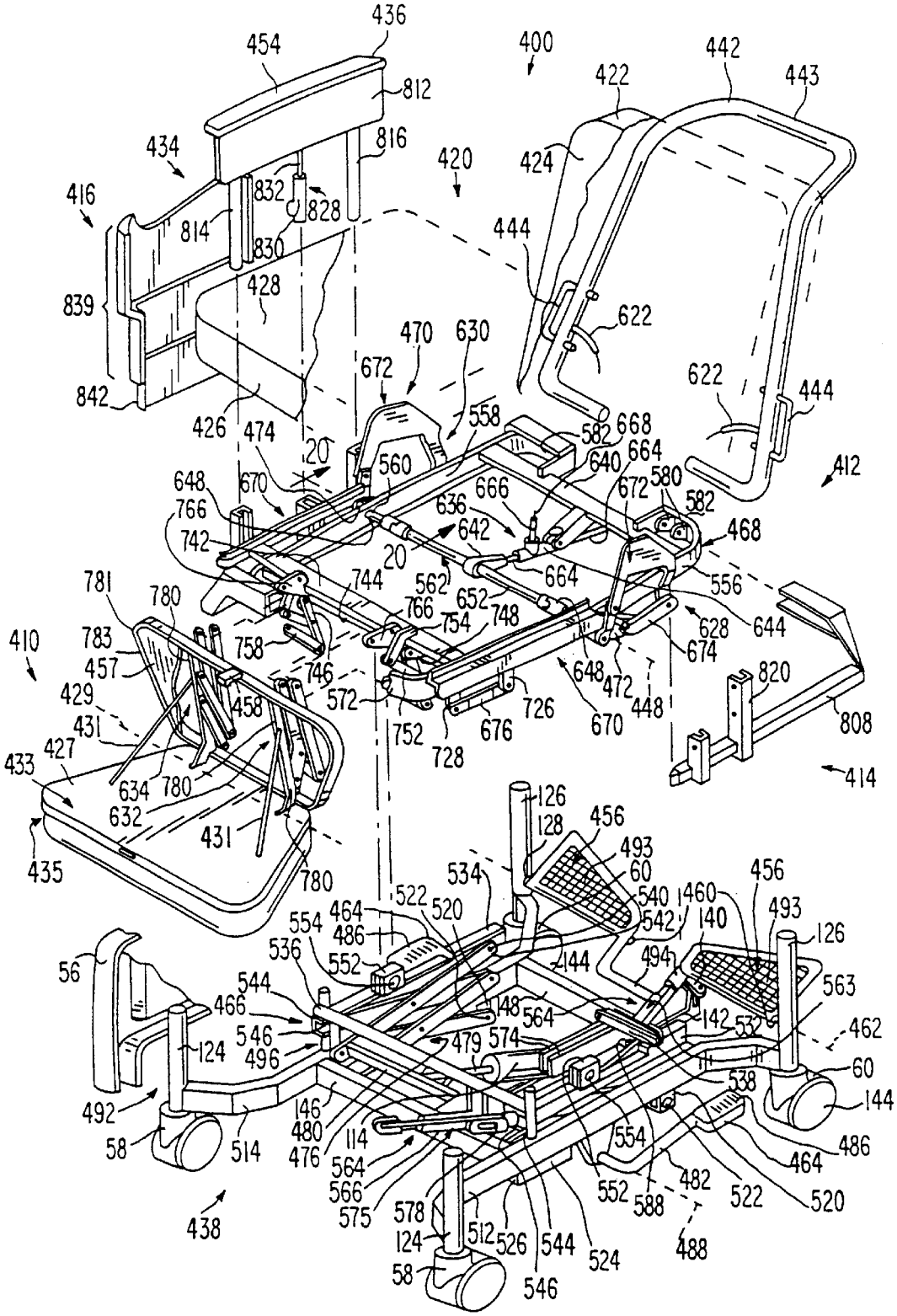
FIG. 15 is an exploded perspective view of the chair of FIG. 14 with portions broken away showing a base frame including a lower frame having the front and rear casters engaging the floor and a staging frame supported above the lower frame by a pair of spaced-apart scissors elevation linkages for upward and downward movement relative thereto, the pair of brake-steer pedal wings being coupled to the lower frame by a bell crank-shaped rotatable brake-steer shaft having a generally transversely-extending axis of rotation and having a central offset portion, an intermediate frame pivotably mounted to the staging frame to pivot about a horizontal axis defined by a main control shaft, each of the arm rest assemblies attached to the intermediate frame, and the patient support coupled to the intermediate frame by a control assembly for movement about the horizontal axis between the sitting-up position and the table position.
Figure 16:
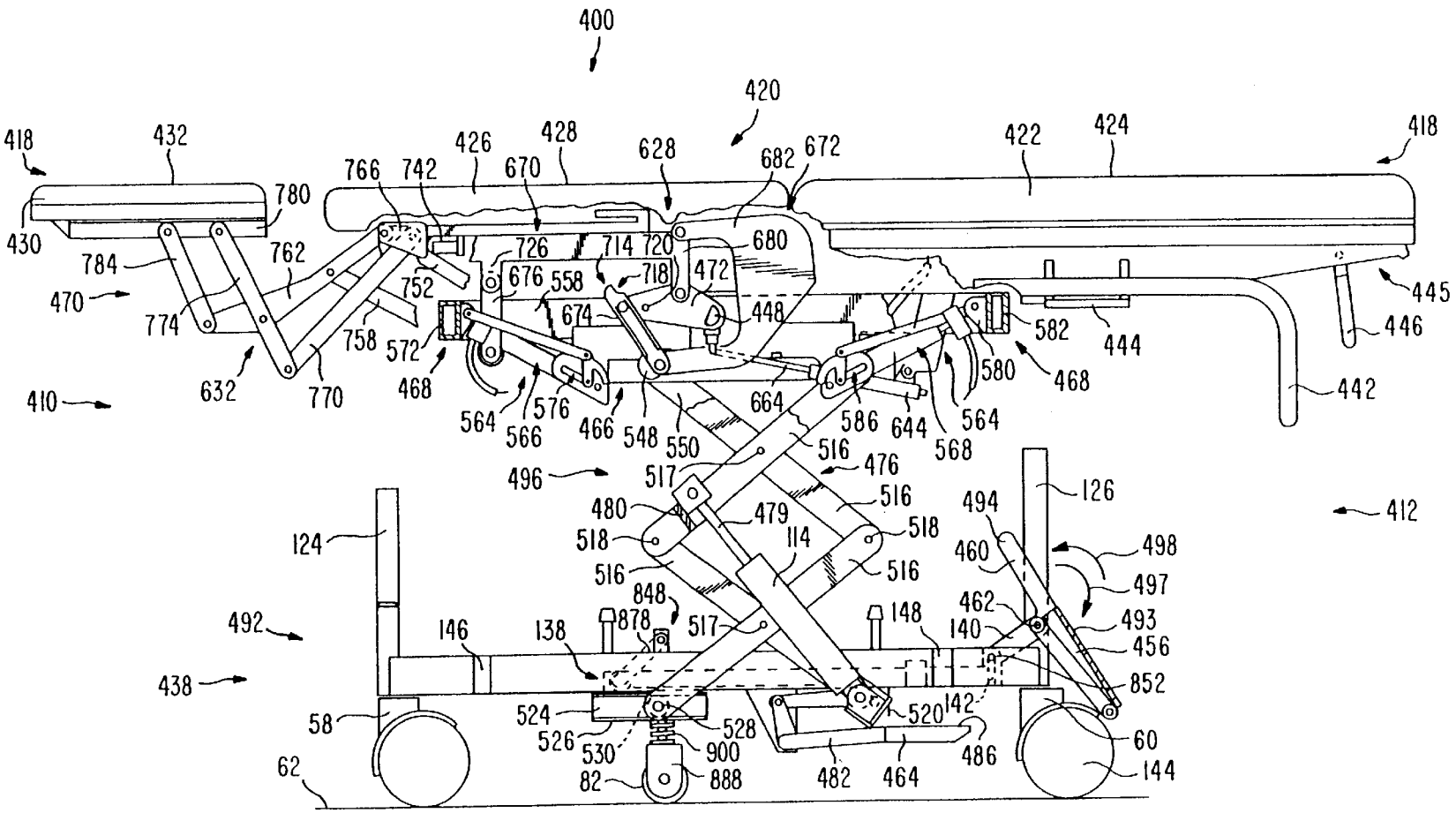
FIG. 16 is a side elevation view of the chair of FIG. 15 with portions broken away showing the back, seat, and leg sections of the patient support in the table position and oriented by the intermediate frame in a generally horizontal "home" position, the leg section spaced apart from the seat section by a leg deployment assembly of the control assembly, the brake-steer pedal wings tilted rearwardly to a braking position having the rear casters braked and the center wheel engaging the floor, and a generally triangular control plate of the control assembly rigidly attached to the main control shaft for rotation about the horizontal axis and coupled to each of the back, seat, and leg sections, the control plate being oriented relative to the intermediate frame so that the back and seat sections are in the table position.

Another embodiment of ambulatory care chair 400 includes an articulated patient support 420, as shown in FIG. 14, upon which a patient (not shown) can rest. Patient support 420 includes a back section 422 having a back-support surface 424, a seat section 426 having a seat-support surface 428, and a leg section 430 having a leg-support surface 432 as shown in FIGS. 14–16. Back-support surface 424 cooperates with seat-support surface 428 and leg-support surface 432 to define a patient-support surface 418.

Chair 400 has a front end 410, a rear end 412, a first side 414, and a second side 416. As used in this description with reference to the second embodiment of ambulatory care chair 406, the phrase "front end 410" will be used to denote the end of any referred-to object that is positioned to lie nearest the front end 410 of chair 400 and the phrase "rear end 412" will be used to denote the end of any referred-to object that is positioned to lie nearest the rear end 412 of chair 400.

Chair 400 includes spaced-apart first and second arm rest assemblies 434 mounted to first side 414 and second side 416 of chair 400, respectively, as shown in FIG. 14. Each arm rest assembly 434 includes an arm rest 436 defining a generally horizontal and upwardly-facing arm-support surface 454 upon which the arms of a person carried by chair 400 can rest.

Chair 400 includes a base frame 438 as shown in FIGS. 14–16. Front casters 58 and rear casters 60 are mounted to base frame 438 so that chair 400 can be rolled over floor 62. Base frame 438 is shielded from view by side panels 56 and articulated patient support 420 is supported above base frame 438. Front and rear casters 58, 60 each can swivel freely about a vertical axis.

A recline handle 450 is mounted to one of the arm rest assemblies 434. Recline handle 450 is pivotably mounted to arm rest assembly 434 at a position beneath arm rest 436, as shown in FIG. 14, for movement between an upward releasing position allowing back, seat, and leg sections 422, 426, 430 to move relative to one another and a downward locking position locking back, seat, and leg sections 422, 426, 430 so that back, seat, and leg sections 422, 426, 430 are fixed relative to one another. Recline handle 450 is biased toward the locking position.

Movement of recline handle 450 to the releasing position allows back, seat, and leg sections 422, 426, 430 to be moved between a sitting-up position shown in FIG. 14 and a table position shown in FIG. 16. In the sitting-up position, seat section 426 is generally horizontal so that seat-support surface 428 faces generally upwardly, back section 422 extends generally upwardly from rear end 412 of seat section 426 so that back-support surface 424 faces generally toward front end 410 of chair 400, and leg section 430 extends generally downwardly from front end 410 of seat section 426 so that leg-support surface 432 faces generally toward front end 410 of chair 400 as shown in FIG. 14. In the table position, back, seat, and leg sections 422, 426, 430 are generally aligned so that back-support surface 424, seat-support surface 428, and leg-support surface 432 face generally upwardly and are generally coplanar as shown in FIG. 16. Back, seat, and leg sections 422, 426, 430 can be locked in an infinite number of positions between the sitting-up position and the table position by moving release handle 450 to the locking position when back, seat, and leg sections 422, 426, 430 are at a desired position between the sitting-up position and the table position.

Leg section 430 includes a leg section frame 781 L having a rim 783 and struts 780 and a cushion assembly 435 pivotably mounted to frame 781 for movement between a closed position shown in FIG. 14 and a footrest position shown in FIG. 15. When back, seat, and leg sections 422, 426, 430 are in the sitting-up position, cushion assembly 435 can pivot downwardly away from frame 781 about an axis 429 to the footrest position so that a foot support surface 433 of a back plate 427 of cushion assembly 435 is exposed. In the footrest position, leg-support surface 432 faces generally downwardly toward floor 62 and foot-support surface 433 faces generally upwardly for holding the feet of a person on chair 400 away from floor 62.

Cushion assembly 435 is supported in the footrest position by a pair of cables 431 connecting back plate 427 to struts 780 of frame 781 as shown in FIG. 15. When cushion assembly 435 pivots upwardly about axis 429 from the footrest position to the closed position, a latch 458 mounted to a center top portion of rim 781 catches a latch plate 459 of cushion assembly 435 appended to back plate 427 locking cushion assembly 435 in the closed position. When cushion assembly 435 is in the closed position, back plate 427 abuts a cover plate 457 that shields portions of base frame 438 from view and prevents foreign objects from inadvertently being inserted underneath seat section 426 from front end 410 of chair 400.

A back cover 445 is mounted to back section 422 and back cover 445 is formed to include a recess 447, a portion of which is covered by a net 449 to provide a storage compartment in which objects (not shown) can be stored and transported with chair 400. A push bar 442 having a generally horizontal grip 443 is mounted to back section 422 and first and second forward tilt handles 444 are pivotably mounted to push bar 442 adjacent to first side 414 and second side 416 of chair 400 as shown in FIG. 14. In addition a U-shaped rearward tilt handle 446 is mounted to back section 422 adjacent to and above push bar 442.

Tilt handles 444, 446 each can move between a locking position and a releasing position. Movement of either forward tilt handle 444 to the releasing position allows patient support 420 to tilt forwardly about a horizontal transverse pivot axis 448 and movement of rearward tilt handle 446 to the releasing position allows patient support 420 to tilt rearwardly about axis 448.

Hereinafter, components of chair 400 will be described as tilting "forwardly" when each referred-to component is rotated about an axis so that front end 410 of the component is lowered and rear end 412 of the component is raised. Likewise, components of chair 400 will be described as tilting "rearwardly" when each referred-to component is rotated about an axis so that rear end 412 of the component is lowered and front end 410 of the component is raised. Patient support 420 can be forwardly or rearwardly tilted when back, seat, and leg sections 422, 426, 430 are locked in the sitting-up position, the table position, or any position therebetween.

When back, seat, and leg sections 422, 426, 430 of chair 400 are locked in the sitting-up position, patient support 420 can be placed in a generally horizontal "home" position, tilted forwardly from the home position to a forward egress position, and tilted rearwardly to a leaned-back position. In addition, when back, seat, and leg sections 422, 426, 430 are locked in the table position, patient support 420 can be placed in a generally horizontal "home" position, tilted forwardly from the home position to a reverse Trendelenburg position, and tilted rearwardly from the home position to a Trendelenburg position.

Figure 24:
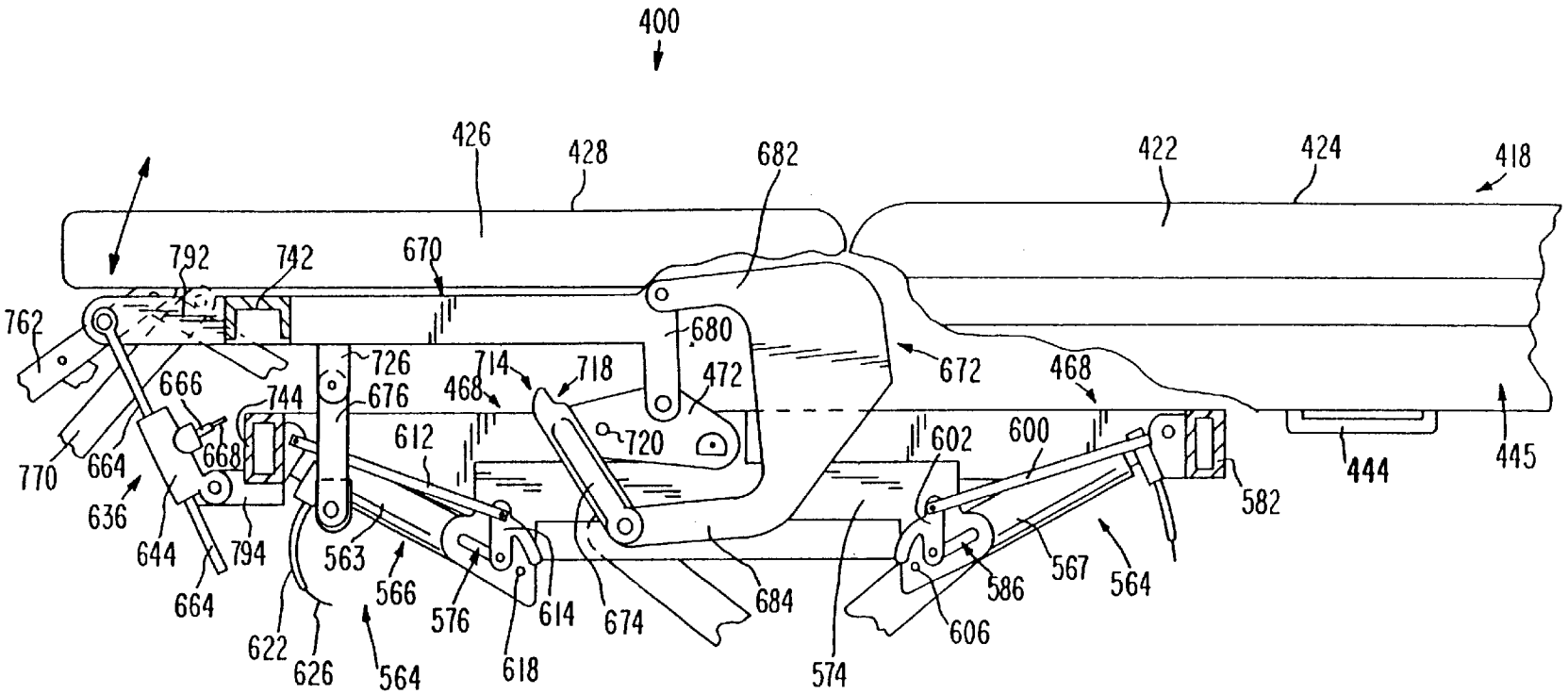
FIG. 24 is a side elevation view of an alternative embodiment chair similar to the chair of FIGS. 14–23 with portions broken away showing a locking mechanism underneath the front of the seat section and coupling a cross member of the control assembly to a front frame member of the intermediate frame, the locking mechanism being lockable to lock the back, seat, and leg sections from movement relative to the intermediate frame, and the locking mechanism being releasable to allow the back, seat, and leg sections to move relative to the intermediate frame.

An arm rest release handle 452 is mounted to each arm rest assembly 434 as shown in FIGS. 14 and 24. Each release handle 452 is movable between an upward releasing position allowing arm rest 436 to move vertically relative to seat section 426 and a downward locking position locking arm rest 436 relative to seat section 426 so that each arm rest 436 is fixed relative to seat section 426. Each release handle 452 is biased toward the locking position.

Movement of release handle 452 from the locking position to the releasing position allows the corresponding arm rest 436 to move between a raised position and a lowered position. In their raised positions, arm rests 436 are elevated above seat section 426 and in their lowered positions arm rests 436 are adjacent to seat section 426 so that arm-support surface 454 of each arm rest 436 is generally coplanar with seat-support surface 428.

Each arm rest 436 can be locked in an infinite number of positions between the raised position and the lowered position by moving the corresponding release handle 452 to its locking position when selected arm rest 436 is at a desired position between the raised position and the lowered position. Although arm rests 436 are adjacent to seat section 426 when in the lowered position so that each arm-support surface 454 is generally coplanar with seat-support surface 428, it is within the scope of the invention as presently perceived to provide arm rest assemblies 434 for which arm-support surfaces 454 are vertically beneath the level of seat-support surface 428 when arm rests 436 are in the lowered position.

Chair 400 also includes a pair of brake-steer pedal wings 456 pivotably coupled to base frame 438 as shown best in FIGS. 14 and 15. Pedal wings 456 are fixed to a bell-crank-shaped brake-steer shaft 460 that is mounted to base frame 438 to rotate about a transversely-extending pivot axis 462. Shaft 460 is coupled to rear casters 60 and is coupled to a center wheel 82 so that movement of pedal wings 456 controls braking and releasing of rear casters 60 and controls movement of center wheel 82 between a downward brake-steer position engaging floor 62 and a neutral position spaced apart from floor 62.

When pedal wings 456 are tilted rearwardly to a braking position, as shown in FIG. 16, rear casters 60 are braked to prevent rear casters 60 from rotating or swiveling. In addition, center wheel 82 is moved to the brake-steer position engaging floor 62 to assist in preventing pivoting movement of chair 400 about either of braked rear casters 60. When pedal wings 456 are moved to a generally horizontal neutral position, rear casters 60 are no longer braked so that rear casters 60 can rotate and swivel and center wheel 82 moves to the neutral position spaced apart from floor 62. Finally, when pedal wings 456 are tilted forwardly to a steering position, as shown in FIGS. 14 and 15, rear casters 60 can rotate and swivel and center wheel 82 moves back to the brake-steer position engaging floor 62 to assist in steering chair 400 by providing a frictional contact area with floor 62 about which chair 400 can be easily turned.

Pump pedals 464 are pivotably mounted to sides 414, 416 of chair 400 to control the raising and lowering of patient support 420 relative to floor 62. Pump pedals 464 are normally in a middle locking position shown in FIGS. 14–16, vertically locking patient support 420 relative to floor 62. Pump pedals 464 can be lifted upwardly to an upward releasing position (not shown) releasing patient support 420 relative to floor 62 to lower patient support 420 relative to floor 62. In addition, pump pedals 464 can be depressed downwardly through pump strokes from the locking position to a downward pumping position and can be "pumped" so that pump pedals 464 reciprocate between the locking position and the pumping position to raise patient support 420 relative to floor 62.

Figure 21:
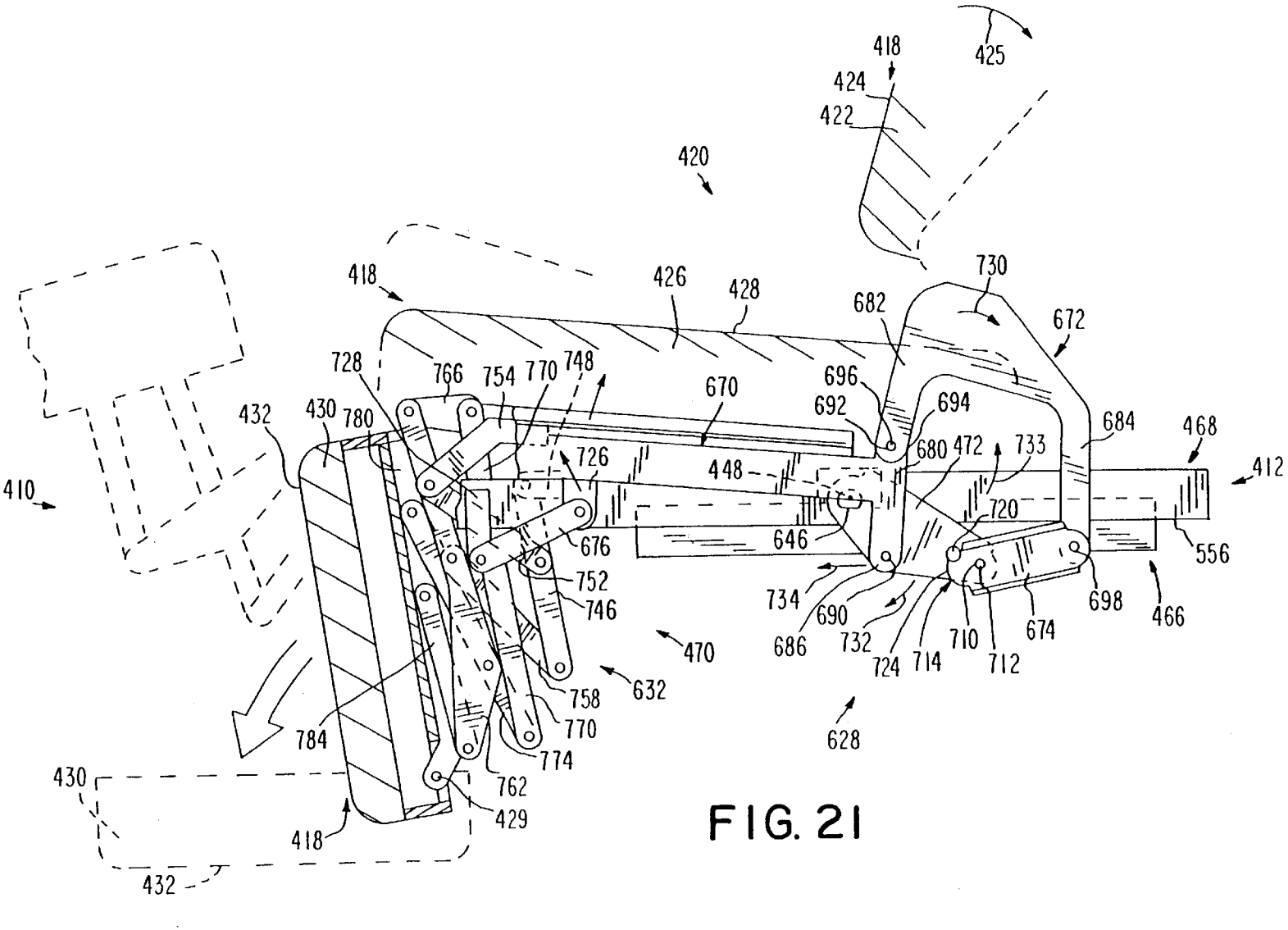
FIG. 21 is a side elevation view of the chair of FIG. 16 with portions broken away showing the patient support in the sitting-up position, the control plate in a first orientation, and the control assembly including linkages coupling each of the back, seat, and leg sections of the patient support to the control plate so that rotation of the control plate about the horizontal axis of the intermediate frame causes the patient support to move between the sitting-up position, a transitional position (in phantom), and the table position.
Figure 23:
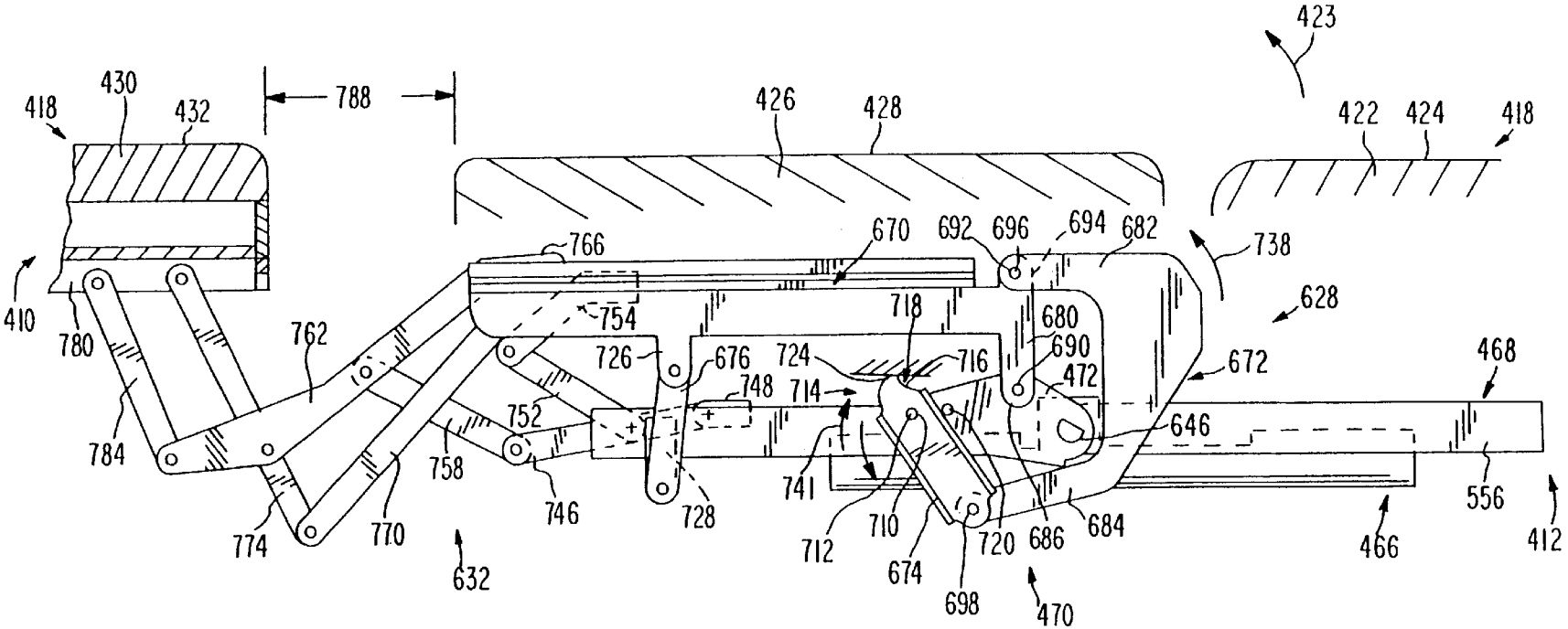
FIG. 23 is a view similar to FIG. 22 showing the patient support in the table position and the control plate in a second orientation, counter clockwise rotation of the control plate resulting in movement of the back, seat, and leg sections from the table position back toward the sitting-up position.

Thus, chair 400 includes articulated patient support 420 having back, seat, and leg sections 422, 426, 430 that are movable and lockable between the sitting-up position, as shown in FIGS. 14, 15, and 21, and the table position, as shown in FIGS. 16 and 23. In addition, patient support 420 is forwardly and rearwardly tiltable about horizontal axis 448 when back, seat, and leg sections 422, 426, 430 are locked in the sitting-up position, the table position, or any position therebetween. Furthermore, patient support 420 can be raised and lowered relative to floor 62. Additionally, chair 400 includes center wheel 82 that can be moved into and out of engagement with floor 62 and arm rest assemblies 434 having arm rests 436 that are each lockable at an infinite number of positions between the raised position and the lowered position.

Base frame 438 of chair 400 includes a lower frame 492 having casters 58, 60 engaging floor 62, a staging frame 466, and an elevation mechanism 496 mounting staging frame 466 above lower frame 492 for upward and downward movement with respect thereto, as shown in FIGS. 15 and 16, so that staging frame 466 can be raised and lowered relative to floor 62. An intermediate frame 468 is pivotably mounted to staging frame 466 to tilt forwardly and rearwardly about horizontal axis 448 between a forward tilt position and a rearward tilt position, respectively. A control linkage assembly 470 (hereinafter assembly 470) is carried by intermediate frame 468 and connects patient support 420 to intermediate frame 468. Assembly 470 controls the pivoting movement of each of back, seat, and leg sections 422, 426, 430 relative to intermediate frame 468. Thus, sections 422, 426, 430 of patient support 420 move relative to one another in response to movement of assembly 470, patient support 420 tilts relative to floor 62 with intermediate frame 468, and patient support 420 raises and lowers relative to floor 62 with staging frame 466.

Lower frame 492 of chair 400 is substantially similar to lower frame 92 of chair 20 described above with reference to FIG. 7 and includes first and second spaced-apart side members 512, 514 connecting the front and rear members 146, 148 as shown best in FIG. 15. Each side member 512, 514 includes an upwardly-extending front tube 124 at front end 410 of side member 512, 514 and an upwardly-extending rear tube 126 at rear end 412 of side member 512, 514. Casters 58 are mounted to front tubes 124 and casters 60 are mounted to rear tubes 126.

Brake-steer shaft 460 is received by apertures 128 for rotation relative to lower frame 492 as shown in FIG. 15. Apertures 128 of rear tubes 126 are aligned to define pivot axis 462 and shaft 460 pivots about axis 462. Pedal wings 456 are fixed to and extend rearwardly from shaft 460 between rear tubes 126 so that pivoting pedal wings 456 about axis 462 rotates shaft 460 about axis 462. Each pedal wing 456 includes a generally upwardly-facing braking surface 493 and shaft 460 includes a bell crank-shaped steering portion 494 offset from axis 462 as shown in FIGS. 14 and 15.

Applying a contact force to braking surface 493 of either pedal wing 456 rotates shaft 460 about axis 462 in a braking direction indicated by arrow 497 shown in FIG. 16 until shaft 460 and pedal wings 456 reach the braking position. Applying a contact force to steering portion 494 of shaft 460 rotates shaft 460 about axis 462 in a steering direction indicated by arrow 498, also shown in FIG. 16, until shaft 460 and pedal wings 456 reach the steering position.

Shaft 460 is coupled to each rear caster 60 by a conventional braking mechanism (not shown) so that when shaft 460 is in the braking position, the braking mechanism brakes rear casters 60 blocking the rotation and swivelling movement of rear casters 60. When shaft 460 is in the steering position, the braking mechanism allows rear casters 60 to rotate and swivel.

Center wheel deployment assembly 138 couples shaft 460 to center wheel 82 so that rotation of shaft 460 about axis 462 moves center wheel 82 relative to floor 62 between the neutral position and the brake-steer position. Center wheel deployment assembly 138 includes pivot link 140 attached to shaft 460 and elongated fork 142 coupling pivot link 140 to center wheel 82 as shown in FIGS. 15 and 16 and as described in detail hereinafter with reference to FIGS. 26 and 27.

Elevation mechanism 496 includes first and second spaced-apart scissors linkages 476 as shown in FIGS. 15 and 16. First scissors linkage 476 is connected to second scissors linkage 476 by a cross member 480 extending transversely therebetween. Each scissors linkage 476 is mounted to lower frame 492 for movement relative to lower frame 492 between an upward open position and a downward closed position. A drive mechanism 114 is coupled to lower frame 492 and to cross member 480 for moving scissors linkages 476 and thus moving staging frame 466, intermediate frame 468, and patient support 420 upward and downward relative to lower frame 492 and floor 62.

Each scissors linkage 476 includes a plurality of links 516 as shown in FIG. 16. A middle portion of each one of links 516 is pivotably coupled to the middle portion of another one of links 516 by a center pin 517 to form a crossing pair of links 516. Ends of each link 516 of each crossing pair of links 516 are pivotably coupled to ends of each link 516 of the next adjacent crossing pair of links 516 by an end pin 518 so that the crossing pairs of links 516 are vertically stacked having the respective center pins 517 vertically aligned. Illustrative scissors linkages 476 each include two stages of vertically stacked crossing pairs of links 516, although it is within the scope of the invention as presently perceived for scissors linkages 476 to be provided with a different number of vertically stacked crossing pairs of links 516. Thus, the term "scissors elevation linkage" and "scissors linkage," as used in the specification and in the claims, includes at least two links 516 interconnected by a center pin 517.

A flange 520 depends downwardly from each side member 512, 514 of lower frame 492 near rear member 148 as shown in FIGS. 15 and 16. A lower pivot pin 522 couples each scissors linkage 476 to a respective linkage flange 520 for pivoting movement relative to lower frame 492.

A lower track 524 depends downwardly from each of side members 512, 514 of lower frame 492 near front member 146. Each lower track 524 includes a generally horizontal track plate 526. A roller 528 is mounted for rotation to a front bottom end 530 of each scissors linkage 476 and engages plate 526 of each lower track 524 as shown in FIG. 16. When drive mechanism 114 opens scissors linkages 476 lifting staging frame 466, rollers 528 roll rearwardly on plates 526 and when drive mechanism 114 closes scissors linkages 476 lowering staging frame 466, rollers 528 roll forwardly on plates 526.

Staging frame 466 of chair 400 includes a first side member 532 adjacent to first side 414 of chair 400, a second side member 534 adjacent to second side 416 of chair 400, and a front member 536 connecting first side member 532 and second side member 534 and extending transversely therebetween as shown in FIG. 15. A pivot pin 540 pivotably couples a rear top end 542 of each scissors linkage 476 to a side member 532, 534, respectively, of staging frame 466.

Side members 532, 534 are each formed to include an upper track 544 having a horizontal track plate 546 as shown in FIG. 15. A roller 548 is mounted for rotation to a front top end 550 of each scissors linkage 476 and engages plate 546 of each track 544 as shown best in FIG. 20. When drive 114 opens scissors linkages 476 lifting staging frame 466, rollers 548 roll rearwardly on plates 546 and when drive mechanism 114 closes scissors linkages 476 lowering staging frame 466, rollers 548 roll forwardly on plates 546.

Each pin 540 is vertically aligned with a corresponding pin 522 and horizontally aligned with a corresponding roller 548 as shown in FIG. 16. In addition, each roller 548 is vertically aligned with a corresponding roller 528. As a result, staging frame 466 remains generally horizontal as it moves relative to lower frame 492 between the raised and the lowered positions.

It will be appreciated, as described above, that drive mechanism 114 can include various mechanical and electromechanical actuators and drivers to raise and lower staging frame 466 relative to lower frame 492, without exceeding the scope of the invention as presently perceived. Drive mechanism 114 of chair 400 is hydraulic cylinder 114 as described above with reference to FIGS. 7 and 8.

Chair 400 includes a pump pedal arm 482 pivotably coupling a pump (not shown) to pump pedals 464 shown in FIGS. 15 and 16 so that pump pedals 464 pivot between the locking position and the pumping position and between the locking position and the releasing position. Each pump pedal 464 includes an upwardly-facing foot-engaging surface 486. The caregiver can apply a downward pumping force to foot-engaging surface 486 of either pump pedal 464 so that pump pedals 464 reciprocate upwardly and downwardly about a transversely-extending pivot axis 488 between the locking position and the pumping position.

Pumping pump pedals 464 causes the pump to pressurize hydraulic fluid and forces hydraulic fluid into the interior region of hydraulic cylinder 114 to move staging frame 466 upwardly relative to lower frame 492 away from the lowered position and toward the raised position as previously described. Lifting pump pedals 464 upwardly past the locking position to a releasing position allows hydraulic fluid to escape from the interior region of hydraulic cylinder 114 so that a piston 479 retracts into hydraulic cylinder 114 and scissors linkages 476 close downwardly toward the closed position, lowering staging frame 466 relative to lower frame 492 toward the lowered position.

Intermediate frame 468 includes a first side upper strut 556 and a second side upper strut 558 each of which is formed to include an aperture 560. Staging frame 466 is provided with an upwardly-extending box 552 attached to each side member 532, 534 of staging frame 466 as shown in FIG. 15. Each box 552 is formed to include main apertures 554.

Figure 19:
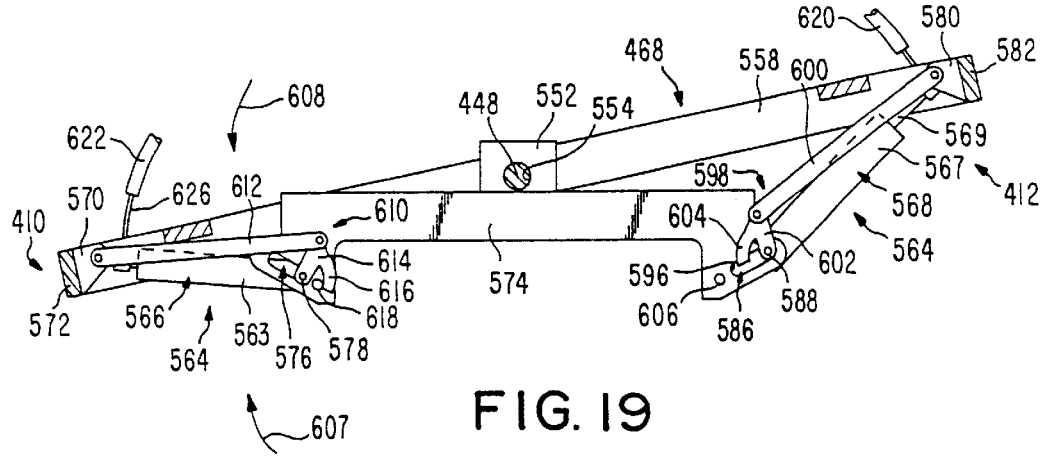
FIG. 19 is a view similar to FIG. 18 showing the front gas spring compressed and moved to a retracted position causing the intermediate frame to tilt forwardly relative to the staging frame to a forward tilt position, causing the pin of the rear gas spring to slide upwardly in the rear slot, and causing the front locking linkage to encircle a front locking peg on the slot plate to lock the pin of the front gas spring against an innermost edge of the front slot.
Figure 20:
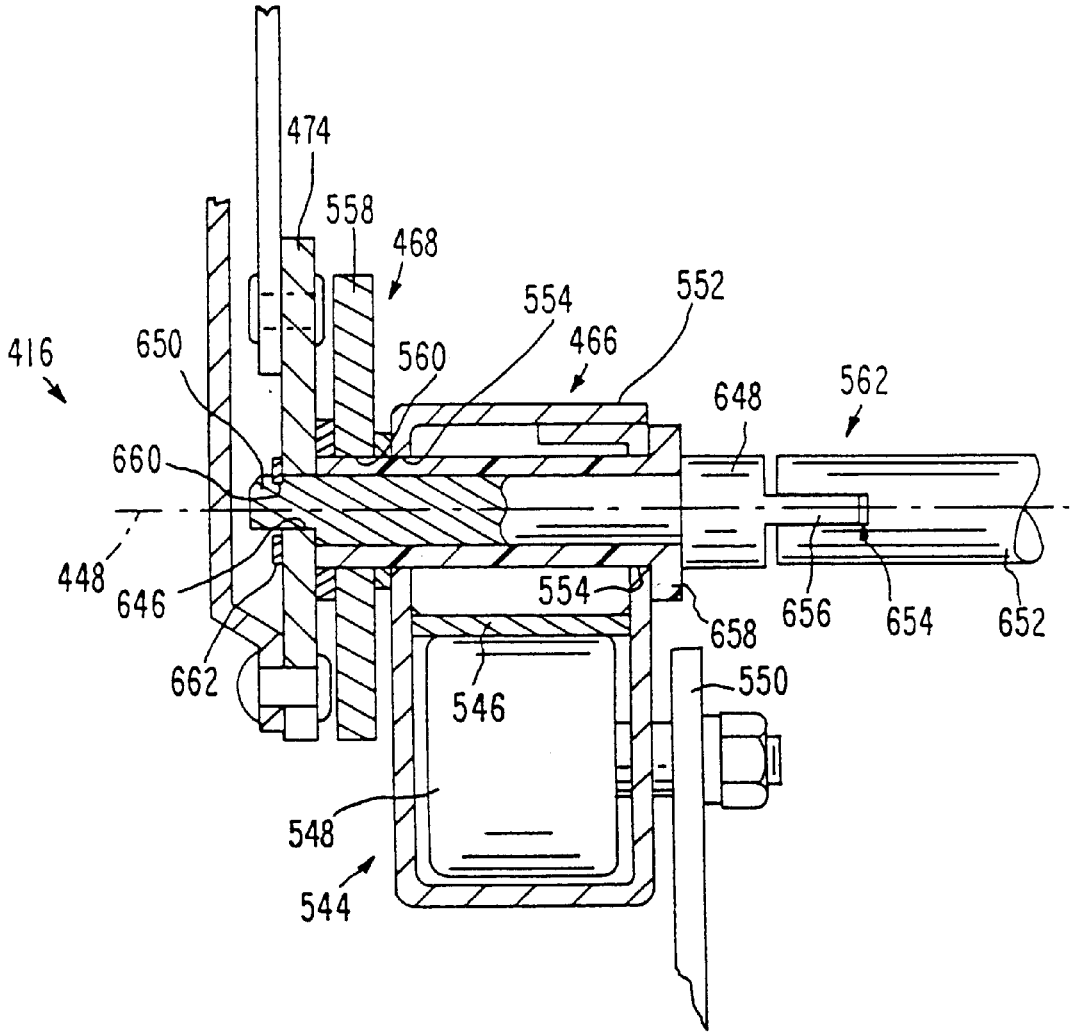
FIG. 20 is a sectional view taken along line 20 of FIG. 15 showing the main control shaft having tongue in-groove mating portions, a track roller mounted to one of the scissors linkages and engaging a track formed on the staging frame, the roller riding along the track as the scissors linkages extend and retract to raise and lower the intermediate frame and the patient support relative to the lower frame, and the main control shaft extending through apertures formed in the staging frame, the intermediate frame, and the control plate of the control assembly.

Apertures 554 and apertures 560 support bearings 658, as shown in FIG. 20, and are generally aligned to define horizontal axis 448. A control shaft 562 is rotatably received by apertures 554 and apertures 560 as shown in FIG. 15, so that intermediate frame 468 pivots about axis 448 relative to staging frame 466 between the forward tilt position shown, for example, in FIG. 19, and the rearward tilt position, shown, for example, in FIG. 18. Patient support 420 is mounted to intermediate frame 468 so that tilting intermediate frame 468 between the forward and rearward tilt positions tilts patient support 420 between forward and rearward tilt positions.

A locking mechanism 564 connects intermediate frame 468 to staging frame 466 as shown in FIGS. 15–19. Locking mechanism 564 is movable between a locking position blocking movement of intermediate frame 468 relative to staging frame 466 and a releasing position allowing intermediate frame 468 to pivot relative to staging frame 466 about pivot axis 448. Locking mechanism 564 can lock intermediate frame 468 in an infinite number of positions relative to staging frame 466 between the forward tilt position and the rearward tilt position.

Locking mechanism 564 includes a front gas spring 566 and a rear gas spring 568 as shown in FIGS. 15–19. Gas springs 566, 568 can be activated and deactivated to move locking mechanism 564 between the locking and releasing positions. Although locking mechanism 564 includes front and rear gas springs 566, 568, it is within the scope of the invention as presently perceived for locking mechanisms 566, 568 to include any locking mechanism as described above with reference to locking mechanism 180 which is suitable for locking and unlocking intermediate frame 468 relative to staging frame 466.

Figure 17:
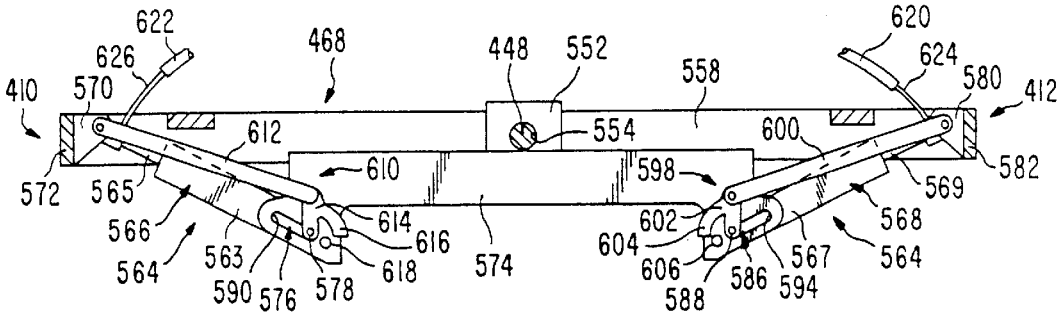
FIG. 17 is an isolated side elevation view of the intermediate frame and the staging frame of the chair of FIG. 16 with portions broken away showing a generally horizontal slot plate fixed to the staging frame and formed to include a front slot and a rear slot, the intermediate frame pivotably mounted to the staging frame and in the horizontal home position, a front gas spring coupled to a front strut of the intermediate frame and having a pin received in the front slot, a rear gas spring coupled to a rear strut of the intermediate frame and having a pin received in the rear slot, a front locking linkage for locking the pin of the front gas spring to the slot plate to prevent sliding movement of the pin of the front gas spring within the front slot when the front gas spring is actuated, and a rear locking linkage for locking the pin of the rear gas spring to the slot plate to prevent sliding movement of the pin of the rear gas spring within the rear slot when the rear gas spring is actuated.
Figure 18:
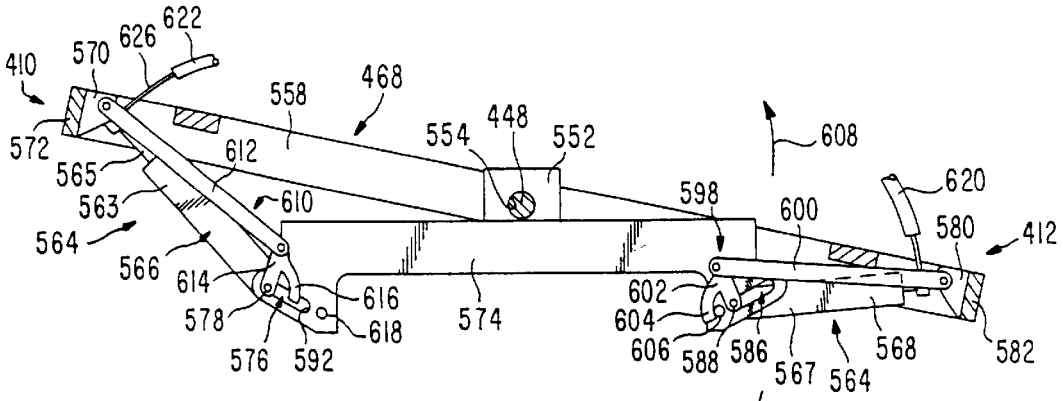
FIG. 18 is a view similar to FIG. 17 showing the rear gas spring compressed and moved to a retracted position causing the intermediate frame to tilt rearwardly relative to the staging frame to a rearward tilt position, causing the pin of the front gas spring to slide upwardly in the front slot, and causing the rear locking linkage to encircle a rear locking peg on the slot plate to lock the pin of the rear gas spring against an innermost edge of the rear slot.

Front gas spring 566 includes a housing 563 and a piston 565 slidably received in housing 563 as shown best in FIGS. 17–19. Front gas spring 566 can be locked blocking the movement of piston 565 relative to housing 563 thereby preventing piston 565 from extending out of or retracting into housing 563. Likewise, rear gas spring 568 includes a housing 567 and a piston 569 slidably received in housing 567. Rear gas spring 568 can be locked blocking the movement of piston 569 relative to housing 567 thereby preventing piston 569 from extending out of or retracting into housing 567.

A first slot plate 574, shown best in FIGS. 17–19, is mounted adjacent to first side member 532 of staging frame 466 and a second slot plate 574 is mounted to staging frame 466 and is spaced apart from first slot plate 574 to define a gas spring-receiving space 575 therebetween as shown in FIG. 15. Front end 410 of each slot plate 574 is attached to front member 536 of staging frame 466 and rear end 412 of each slot plate 574 is attached to a transversely-extending bracket 538 cantilevered to first side member 532 of staging frame 466 as shown in FIG. 15. Each slot plate 574 includes a front outermost edge 590 and a front innermost edge 592, edges 590, 592 defining a front slot 576 adjacent to front end 410 of each slot plate 574. Each slot plate 574 also includes a rear outermost edge 594 and a rear innermost edge 596, edges 594, 596 defining a rear slot 586 adjacent to rear end 412 of each slot plate 574.

Rear end 412 of housing 563 of front gas spring 566 is positioned to lie in gas spring-receiving space 575 adjacent to front ends 410 of slot plates 574. A pin 578 is fixed to housing 563 and is slidably received by slots 576 as shown in FIG. 15 so that housing 563 slides and pivots relative to slot plates 574. Rear housing 567 is similarly positioned to lie in gas spring-receiving space 575 adjacent to rear ends 412 of slot plates 574. A pin 588 is fixed to housing 567 and is slidably received by slots 586 so that housing 567 slides and pivots relative to slot plates 574.

Intermediate frame 468 includes a front strut 572 and flanges 570 appended to front strut 572 as shown in FIGS.

15–19. Front end 410 of front piston 565 is pivotably coupled to flanges 570 thereby connecting slot plate 574 and staging frame 466 to intermediate frame 468. Similarly, intermediate frame 468 includes a rear strut 582 and flanges 580 appended to rear strut 582. Rear end 412 of rear piston 569 is pivotably coupled to flanges 580 also connecting slot plate 574 and staging frame 466 to intermediate frame 468.

When intermediate frame 468 is in the generally horizontal home position shown in FIG. 17, front flanges 570 are positioned to lie in front of and above front slots 576 and front end 410 of gas spring 566 is positioned to lie above rear end 412 of gas spring 566. In addition, rear flanges 580 are positioned to lie behind and above rear slots 586 and rear end 412 of gas spring 568 is positioned to lie above front end 410 of gas spring 568. In addition, front slot 576 is oriented having outermost edge 590 positioned to lie above innermost edge 592 and rear slot 586 is oriented having outermost edge 594 positioned to lie above innermost edge 596.

Also, when intermediate frame 468 is in the home position, gas springs 566, 568 are each fully-extended relative to housings 563, 567, respectively, as shown in FIG. 17. When gas springs 566, 568 are thus positioned and locked, slot pin 578 engages innermost edge 592 blocking forward tilting of intermediate frame 468 relative to staging frame 466 and slot pin 588 engages innermost edge 596 blocking rearward tilting of intermediate frame 468 relative to staging frame 466.

Gas springs 566, 568 are yieldably biased to their locked modes and can be selectively and independently released. When either of front and rear gas springs 566, 568 are released, intermediate frame 468 can pivot about axis 448 relative to staging frame 466.

A first bowden wire 620 has a sheath and a flexible control cable 624 movable within the sheath and coupled to rear gas spring 586 so that control cable 624 can move relative to gas spring 568 within the sheath to unlock gas spring 568 allowing piston 569 to slide relative to housing 567. Control cable 624 of bowden wire 620 is also attached to rearward tilt handle 446 mounted to back section 422 so that moving handle 446 to the releasing position relative to back section 422 moves control cable 624 and unlocks gas spring 568. Similarly, a second bowden wire 622 having a sheath and a flexible control cable 626 movable within the sheath couples each of forward tilt handles 444 to front gas spring 566 so that gas spring 566 unlocks and piston 565 can slide relative to housing 563 when either forward tilt handle 444 is moved to the releasing position relative to push bar 442.

When intermediate frame 468 is locked in the home position, movement of rearward tilt handle 446 from the locking position to the releasing position pulls control cable 624 of bowden wire 620 coupled to gas spring 568 so that gas spring 568 unlocks and allows piston 569 to retract into housing 567 thereby allowing intermediate frame 468 to tilt rearwardly. As intermediate frame 468 tilts rearwardly about axis 448, pin 588 engages edge 596 while piston 569 retracts into housing 567 compressing gas located inside housing 567, the gas yieldably biasing piston 569 toward the extended position.

When piston 569 retracts into housing 567, a locking assembly 598 automatically locks pin 588 against edge 596 so that pin 588 and housing 567 cannot slide in slot 586. Locking assembly 598 includes a connecting link 600 pivotably coupled to flanges 580 and a locking link 602 having a hook 604, locking link 602 being pivotably coupled to front end 410 of connecting link 600 and to pin 588 as shown in FIGS. 17–19.

When piston 569 retracts into housing 567 and intermediate frame 468 tilts rearwardly, intermediate frame 468 pushes connecting link 600 generally forwardly thereby pivoting locking link 602 forwardly about pin 588 as shown in FIGS. 17 and 18 so that hook 604 captures a rear locking peg 606 fixed to one of slot plates 574 as shown in FIG. 18. Thus, when intermediate frame 468 is positioned to lie between the home position and the rearward tilt position and gas springs 566, 568 are locked, pin 588 engages innermost edge 596 of slot 586 blocking further movement of intermediate frame 468 in direction 607 and hook 604 engages locking peg 606 blocking movement of intermediate frame 468 in direction 608.

When gas spring 568 is released and intermediate frame 468 moves in direction 607, pin 578 slides in front slot 576 away from edge 592 toward edge 590. Pin 578 engages edge 590 when intermediate frame 468 reaches the rearward tilt position shown in FIG. 18 blocking further movement of intermediate frame 468 in direction 607. When the caregiver releases tilt handle 446, gas spring 568 locks, blocking the movement of piston 569 relative to housing 567 and pulling control cable 624 of bowden wire 620, the control cable 624 pulling tilt handle 446 to the locking position.

Intermediate frame 468 can also move from the home position to the forward tilt position as shown FIGS. 17 and 19 by moving either forward tilt handle 444 from the locking position to the releasing position. Bowden wire 622 includes a sheath covering flexible control cable 626 coupled to each handle 444 and to gas spring 566 so that movement of either handle 444 pulls control cable 626 and releases gas spring 566 allowing piston 565 to retract into housing 563. When intermediate frame 468 tilts from the home position about axis 448 in direction 608, pin 578 engages edge 592. In addition, piston 565 retracts into housing 563 shortening gas spring 566 and compressing gas inside housing 563, the gas in housing 563 yieldably biasing piston 565 toward the extended position.

When piston 565 retracts into housing 563, a locking assembly 610 automatically locks pin 578 against edge 592 so that pin 578 and housing 563 cannot slide in slot 586. Locking assembly 610 includes a connecting link 612 pivotably coupled to flanges 570 and a locking link 614 having a hook 616, locking link 614 being pivotably coupled to rear end 412 of connecting link 612 and to pin 578 as shown in FIGS. 17–19.

When piston 565 retracts into housing 563 and intermediate frame 468 tilts forwardly, intermediate frame 468 pushes connecting link 612 generally rearwardly pivoting locking link 614 rearwardly about pin 578 as shown in FIGS. 17 and 19 so that hook 616 captures a front locking peg 618 fixed to one of slot plates 574 as shown in FIG. 19. Thus, when intermediate frame 468 is positioned to lie between the home position and the forward tilt position and gas springs 566, 568 are locked, hook 616 engages locking peg 618 blocking movement of intermediate frame 468 in direction 607 and pin 578 engages edge 592 of slot 576 blocking movement of intermediate frame 468 in direction 608.

When gas spring 566 is released and intermediate frame 468 moves in direction 608, pin 588 slides in rear slot 586 away from edge 596 toward edge 594. Pin 588 engages edge 594 when intermediate frame 468 reaches the forward tilt position shown in FIG. 19 blocking further movement of intermediate frame 468 in direction 608. When the caregiver releases tilt handle 444, gas spring 566 locks, blocking the movement of piston 565 relative to housing 563 and pulling control cable 626 of bowden wire 622, control cable 626 pulling tilt handle 444 to the locking position.

Thus, if the caregiver moves either tilt handle 444 to the releasing position when intermediate frame 468 is locked in the home position shown in FIG. 17, gas spring 566 unlocks and intermediate frame 468 can tilt forwardly in direction 608. Likewise, if the caregiver moves tilt handle 446 to the releasing position, gas spring 568 unlocks and intermediate frame 468 can move in direction 607.

If the caregiver moves either tilt handle 444 to the releasing position when intermediate frame 468 is locked in the forward tilt position shown in FIG. 19, gas spring 566 unlocks and intermediate frame 468 can move in direction 607 toward the home position. When intermediate frame 468 reaches the home position, gas spring 566 is fully-extended. Similarly, if the caregiver moves tilt handle 446 to the releasing position when intermediate frame 468 is locked in the rearward tilt position shown in FIG. 18, gas spring 568 unlocks and intermediate frame 468 can move in direction 608 toward the home position. When intermediate frame reaches the home position, gas spring 568 is fully-extended.

Assembly 470 includes a first control plate 472 rotatably coupled to strut 556 of intermediate frame 468 for rotation about axis 448 and a second control plate 474 rotatably coupled to strut 558 of intermediate frame 468 for rotation about axis 448. Axis 448 is defined by main control shaft 562. Shaft 562 includes a center rod 652 and end pieces 648 coupled to ends of center rod 652 as shown in FIG. 20. An axially-extending groove 654 is formed at each end of center rod 652 and each end piece 648 includes a tongue 656 extending into groove 654 as shown in FIG. 20 so that end pieces 648 and center rod 652 rotate together about axis 448.

Control plates 472, 474 are each formed to include a D-shaped aperture 646 receiving shaft 562 as shown in FIGS. 20–23 with reference to control plate 474. The connection of control plate 472 to shaft 562 is substantially similar to the connection of control plate 474 to shaft 562 and the description below related to plate 474 and the description of the related components of chair 400 is applicable to plate 474 unless specifically noted otherwise. Each end piece 648 includes an outer end 650 having a D-shaped cross-section. Outer end 650 drivingly engages D-shaped aperture 646 of control plate 474 as shown in FIG. 20 so that shaft 562 and control plate 474 rotate together about axis 448. Bearing 658 is a tubular bushing mounted on end piece 648 and is rotatably received by apertures 554 formed in box 552 of staging frame 466 and by an aperture 560 formed in intermediate frame 468 as shown in FIG. 20.

Outer end 650 of end piece 648 is formed to include an annular groove 660 carrying a C-ring 662 as shown in FIG. 20. C-ring 662 retains control plate 474 on shaft 562 adjacent to strut 558 of intermediate frame 468.

Assembly 470 includes a first reclining assembly 628 (hereinafter reclining assembly 628) adjacent to first side 414 of chair 400 and a second reclining assembly 630 (hereinafter reclining assembly 630) adjacent to second side 416 of chair 400 as shown in FIGS. 15, 16, and 21–23. Reclining assemblies 628, 630 are connected to back section 422 and seat section 426 to control pivoting movement of back section 422 and seat section 426 relative to one another and relative to intermediate frame 468. In addition, leg section deployment linkage assemblies 632 (hereinafter leg deployment assemblies 632) are connected to seat section 426, intermediate frame 468, and leg section 430 to control the movement of leg section 430 relative to seat section 426 and relative to intermediate frame 468.

Reclining assembly 628 and leg deployment assembly 632 are pivotably coupled to control plate 472 and shaft 562 as shown in FIGS. 15, 16, and 21–23. As a result, the orientation of control plate 472 relative to intermediate frame 468 establishes the positions of back, seat, and leg sections 422, 426, 430 relative to one another and relative to intermediate frame 468 between the sitting-up position and the table position.

A locking mechanism 636 connects shaft 562 to intermediate frame 468 as shown in FIG. 15. Locking mechanism 636 has a rear end 412 pivotably coupled to a member 640 adjacent strut 582 and attached to side struts 556, 558 of intermediate frame 468 as shown in FIG. 15 and a front end 410 coupled to a tab 642 fixed to center rod 652 of shaft 562 and extending radially outwardly therefrom. Locking mechanism 636 is movable between a releasing position allowing movement of front end 410 of mechanism 636 relative to rear end 412 of mechanism 636 so that locking mechanism 636 can extend and retract and a locking position locking front end 410 of mechanism 636 relative to rear end 412 of mechanism 636. When front end 410 of mechanism 636 is locked relative to rear end 412 of mechanism 636, locking mechanism 636 blocks rotation of shaft 562 thereby blocking movement of control plate 472 relative to intermediate frame 468.

Locking mechanism 636 includes a spring clutch having a clutch housing 644 and a rod 664 slidably received by clutch housing 644 for sliding movement. Locking mechanism 636 hereinafter is referred to alternatively as locking mechanism 636 and spring clutch 636. Rod 664 can be locked in an infinite number of positions relative to housing 644. As a result, control plate 472 can be locked in an infinite number of positions relative to intermediate frame 468 and patient support 420 can be locked in an infinite number of positions relative to intermediate frame 468 between the sitting-up position and the table position. Although locking mechanism 636 includes a spring clutch, it is within the scope of the invention as presently perceived for locking mechanism 636 to include any locking mechanism as described above with reference to locking mechanism 180 which is suitable for locking assembly 470 relative to intermediate frame 468.

A bowden wire 666 having a sheath surrounding a flexible control cable 668 is coupled to locking mechanism 636 so that control cable 668 can be moved to unlock locking mechanism 636, loosening a gripping spring (not shown) of spring clutch 636, thereby allowing rod 664 to slide relative to the spring and relative to clutch housing 644. Bowden wire 666 extends from clutch housing 644 through one of arm rest assemblies 434 to recline handle 450. Control cable 668 is connected to recline handle 450 so that when recline handle 450 is in the locking position, the spring constricts against rod 664 thereby locking rod 664 relative to clutch housing 644.

Locking mechanism 636 is yieldably biased toward its locking mode biasing recline handle 450 toward the locking position. When the caregiver pivots recline handle 450 from the locking position to the releasing position, recline handle 450 moves control cable 668 to unlock locking mechanism 636, loosening the spring, and allowing rod 664 to slide relative to clutch housing 644 so that the caregiver can move back, seat, and leg sections 422, 426, 430 relative to intermediate frame 468 between the sitting-up position and the table position. Once the caregiver moves patient support 420 to the desired position and the caregiver releases recline handle 450, locking mechanism 636 automatically locks, locking center rod 562 and control plates 472, 474, thus locking patient support 420 relative to intermediate frame 468 in the desired position and automatically moving control cable 668 and recline handle 450 back to the locking position.

Although locking mechanism 636 is illustratively shown in FIG. 15 as being coupled to main shaft 562 and coupled to member 640 of intermediate frame 468, it is within the scope of the invention as presently perceived for locking mechanism 636 to be coupled to any component of linkage assembly 470 and coupled to any part of intermediate frame 468 so that when locking mechanism 636 is locked, linkage assembly 470 is blocked from moving relative to intermediate-frame 468. For example, an alternative embodiment of chair 400 having front end 410 of locking mechanism 636 pivotably coupled to a flange 792 extending forwardly from a cross member 742 of linkage assembly 470 and having rear end 412 of locking mechanism 636 pivotably coupled to a flange 794 extending forwardly from a front intermediate frame member 744 is shown in FIG. 24. Locking mechanism 636 shown in FIG. 24 operates in a manner similar to mechanism 636 shown in FIGS. 15 and 16 to lock and unlock linkage assembly 470 from intermediate frame 468.

As previously described, assembly 470 includes control plate 472, reclining assembly 628, and leg deployment assembly 632 on first side 414 of chair 400 and control plate 474, reclining assembly 630, and leg deployment assembly 634 on second side 416 of chair 400 that are similar to corresponding elements on first side 414 of chair 400 except that the portion of assembly 470 mounted on second side 416 is a mirror image of the portion of assembly 470 mounted on first side 414. Control plate 472, reclining assembly 628, and leg deployment assembly 632 and the operation thereof are substantially similar to control plate 474, reclining-assembly 630, and leg deployment assembly 634, respectively. Thus, the description herein of control plate 472, reclining assembly 628, and leg deployment assembly 632 applies as well to control plate 474, reclining assembly 630, and leg deployment assembly 634, respectively, unless specifically noted otherwise.

Patient support 420 includes laterally spaced apart back section links 672, back section 422 being fixed to back section links 672 and extending rearwardly therefrom when patient support 420 is in the table position as shown in FIGS. 16 and 23 and extending upwardly therefrom when patient support 420 is in the sitting-up position as shown in FIG. 21. Patient support 420 also includes longitudinally-extending and laterally spaced-apart seat section frame members 670 of seat section 428 and leg section frame 781 of leg section 430.

Reclining assembly 628 includes a short portion 680 connecting seat section frame member 670 both to control plate 472 and to back section link 672 as shown in FIGS. 15, 16, and 21–23. A bottom end 686 of short portion 680 is pivotably coupled to control plate 472 by a pivot pin 690 so that seat section 428 can pivot relative to control plate 472. A top end 694 of short portion 680 is pivotably coupled to back section link 672 by a pivot pin 692 so that back section 422 and seat section 428 pivot relative to one another about a pivot axis 696 defined by pin 692. A tilt link 676 of reclining assembly 628 couples seat section frame member 670 to intermediate frame 468 as shown best in FIG. 15 to control the movement of seat section 428 relative to intermediate frame 468.

Back section link 672 is generally upside down U-shaped as shown in FIGS. 15 and 21 and includes a middle portion, a forward portion 682 extending down from the middle portion and a rear portion 684 extending down from the middle portion and spaced apart from forward portion 682. Forward portion 682 is pivotably coupled to top end 694 of short portion 680. Rear portion 684 is coupled to control plate 472 through a chair stop link 674 that operates to stop the movement of patient support 420 away from the table position when patient support 420 reaches the sitting-up position.

Figure 22:
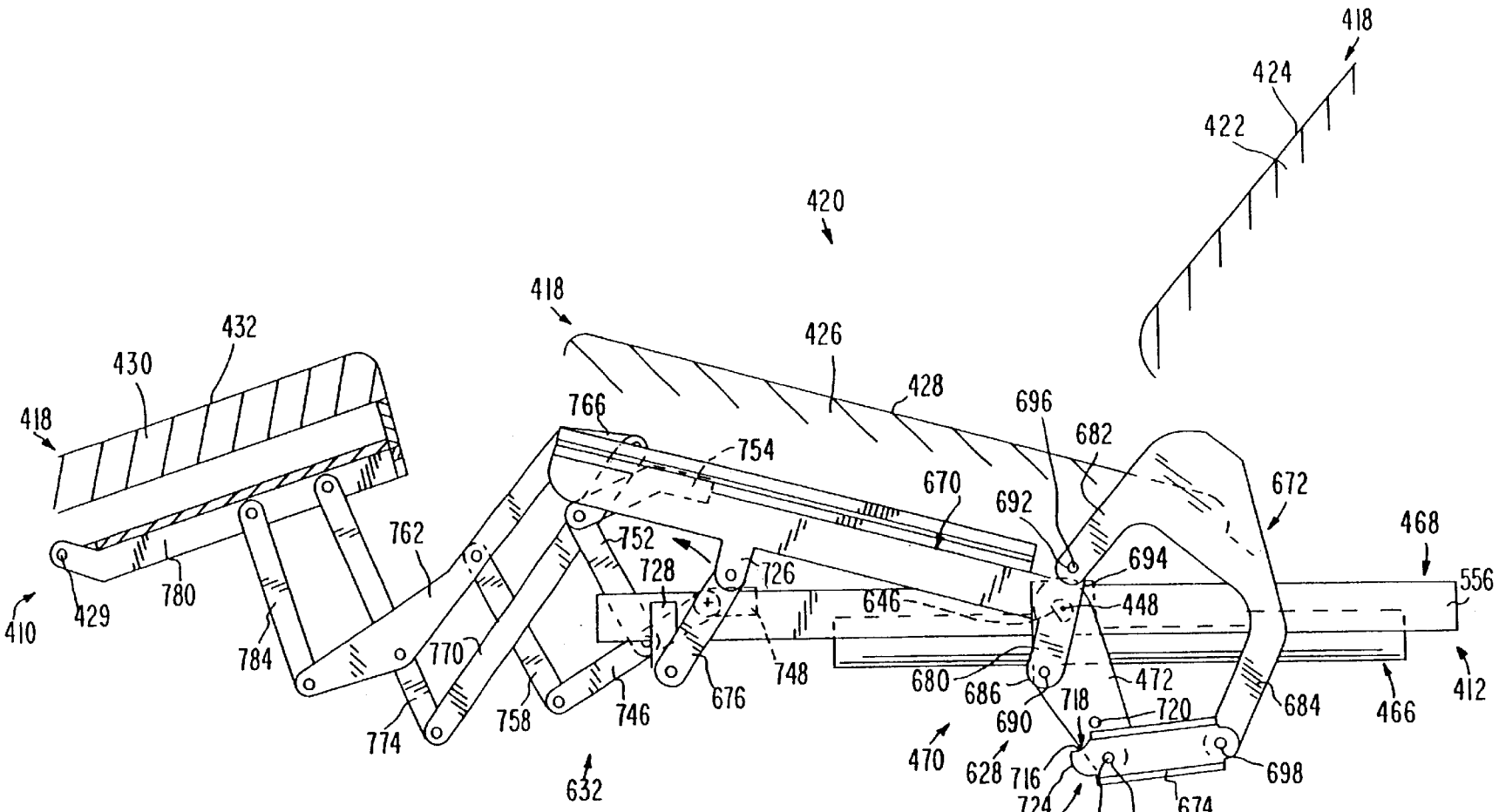
FIG. 22 is a view similar to FIG. 21 showing the patient support in the transitional position between the sitting-up position and the table position having the control plate rotated away from the first orientation in a clockwise direction so that the back section is pivoted downwardly toward the table position, the seat section has a front end pivoted upwardly, and the leg section is moved upwardly toward the table position.

Pivot pin 698 pivotably couples chair stop link 674 to rear portion 684 of back section link 672 and pivot pin 712 pivotably couples chair stop link 674 to control plate 472 so that chair stop link 674 and seat section frame member 670 are directly coupled control plate 472 and back section link 672 is indirectly coupled to control plate 472 through chair stop link 674 and short portion 680 of seat section frame member 670 as shown best in FIGS. 21–23. As a result, back section 422, seat section 426, and control plate 472 are pivotably coupled to one another and pivoting movement of any one of back section 422, seat section 426, or control plate 472 relative to intermediate frame 468 results in pivoting movement of the others.

Tilt link 676 has a first end pivotably coupled to a flange 726 depending from seat section frame member 670 and a second end pivotably coupled to a flange 728 depending from intermediate frame 468, as shown best in FIGS. 21–23. Flange 726 is spaced apart from both front end 410 of seat section frame member 670 and rear end 412 of seat section frame member 670 and flange 728 is positioned to lie adjacent to front end 410 of intermediate frame 468. Thus, tilt link 676 connects seat section 426 to intermediate frame 468 and short portion 680 of seat section frame member 670 connects seat section 426 to intermediate frame 468 through control plate 472 for movement relative thereto. It can be seen that back section 422 is coupled to seat section 426 and back and seat sections 422, 426 are coupled to control plate 472 and intermediate frame 468 so that movement of any one of back section 422, seat section 426, or control plate 472 results in movement of the others relative to intermediate frame 468.

When back section 422 and seat section 426 are in the sitting-up position, control plate 472 has a first orientation extending generally rearwardly from axis 448 as shown in FIGS. 15 and 21. As described above, when locking mechanism 636 is locked, locking mechanism 636 blocks the movement of tab 642 blocking the rotation of center rod 652, end piece 648, and control plate 472 relative to intermediate frame 468, thereby blocking the movement of patient support 420 relative to intermediate frame 468.

For example, when patient support 420 is locked in the sitting-up position shown in FIG. 21, the caregiver can release locking mechanism 636 and pull back section 422 downwardly about axis 696 toward the table position in the direction indicated by arrow 425. As back section 422 moves downwardly, back section link 672 rotates about pin 692 in direction 730 as shown in FIG. 21 so that rear portion 684 of back section link 672 pushes chair stop link 674 forwardly. Forward movement of chair stop link 674 rotates control plate 472 clockwise about axis 448 in the direction indicated by arrow 732 shown in FIG. 21. Clockwise rotation of control plate 472 pushes pin 690 of seat section frame member 670 along an arc 734 about axis 448 as shown in FIG. 21 moving short portion 680 and seat section frame member 670 about axis 448 as shown in FIGS. 21 and 22 so that seat section 426 moves about axis 448 in response to rotation of control plate 472 when back section 422 moves about axis 448 from the sitting-up position to the table position.

Short portion 680 cooperates with tilt link 676 to restrict the range of movement of front end 410 of seat section 428 so that as patient support 420 moves from the sitting-up position of FIG. 21 to the table position of FIG. 23, seat section 428 moves from a generally horizontal flat position adjacent to intermediate frame 468 as shown in FIG. 21 to an inclined transitional position having front end 410 of seat section 426 lifted above rear end 412 of seat section 426 as shown in FIG. 22 and then to a generally horizontal flat position spaced apart from intermediate frame 468 when patient support 420 is in the table position as shown in FIG. 23. It can be seen that back, seat, and leg sections 422, 426, 430 of patient support 420 define a transitional position between the sitting-up position and the table position having front end 410 of seat section 426 above rear end 412 of seat section 426 as shown in FIG. 22. When patient support 420 is in the transitional position, control plate 472 extends generally downwardly from horizontal axis 448 as also shown in FIG. 22.

When back, seat, and leg sections 422, 426, 430 are locked in the table position of FIG. 23, control plate 472 is in a second orientation extending generally forwardly from axis 448. The caregiver can release locking mechanism 636 and pull back section 422 upwardly about axis 696 away from floor 62 in the direction indicated by arrow 423 shown in FIG. 23, through the transitional position of FIG. 22, and back toward the sitting-up position of FIG. 21 moving back section link 672 in direction 738.

Chair stop link 674 includes a front portion 714 extending generally forwardly from pin 712 as shown best in FIGS. 21–23. Front portion 714 has a front edge 724 and a locking-edge 716 adjacent to front edge 724, locking edge 716 defining a notch 718. A stop peg 720 is fixed to control plate 472. Notch 718 receives peg 720 and stop peg 720 engages edge 716 when back section 422 and seat section 426 are in the sitting-up position shown in FIGS. 14, 15, and 21, blocking the upward movement of chair stop link 674 and pin 710, blocking the further rotation of control plate 472 in direction 733, and thereby blocking the movement of patient support 420 away from the table position past the sitting-up position. When back section 422 and seat section 426 are in the table position shown in FIG. 23, front edge 724 of chair stop link 674 engages a bottom surface of seat section 426 blocking the upward movement of chair stop link 674 in direction 741, thereby blocking the further rotation of control plate 472 and blocking the movement of patient support 420 away from the sitting-up position past the table position.

As previously described, leg deployment assembly 632 of control assembly 470 controls the movement of leg section 430 relative to seat section 426 and intermediate frame 468 as shown in FIGS. 21–23. Leg deployment assembly 632 is pivotably coupled to control plate 472 through cross member 742 and seat section frame member 670 so that leg deployment assembly 632 and leg section 430 move when control plate 472 rotates about axis 448. When back, seat, and leg sections 422, 426, 430 are in the sitting-up position, leg deployment assembly 632 is closed as shown in FIG. 21 and when back, seat, and leg sections 422, 426, 430 are in the table position, leg deployment assembly 632 is opened as shown in FIG. 23.

Figure 25:
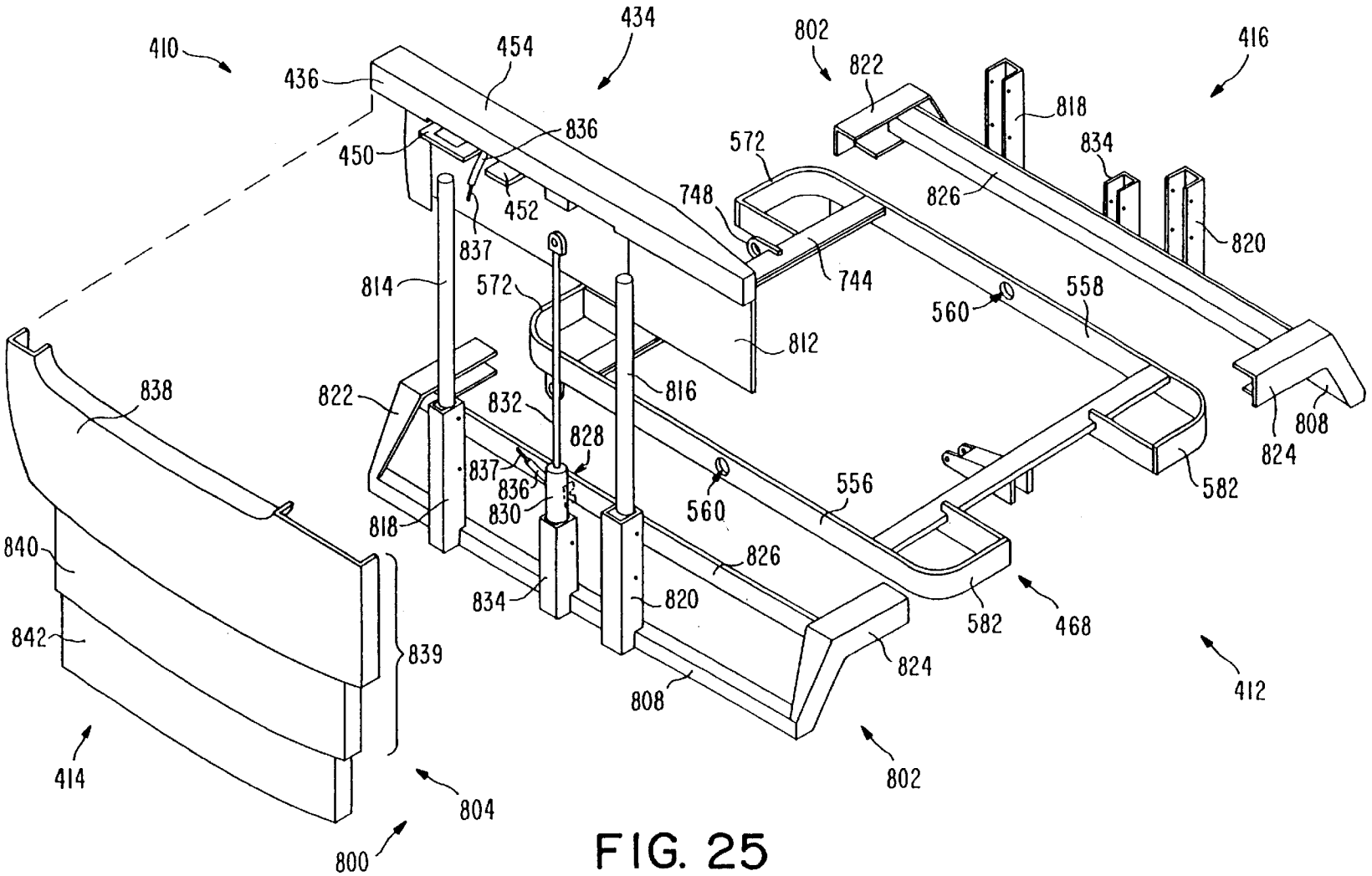
FIG. 25 is an exploded perspective view of the intermediate frame and a second embodiment of an arm rest assembly in accordance with the present invention mounted to the intermediate frame showing an arm rest including a generally horizontal arm-support surface mounted to a generally vertically-extending plate slidably mounted to a housing that is mounted to the intermediate frame, and a locking mechanism having a downwardly-extending rod mounted to the plate and a clutch housing receiving the rod and mounted to the housing of the arm rest assembly to lock the arm rest relative to the housing of the arm rest assembly when the locking mechanism is locked thereby locking the plate and the arm rest relative to the intermediate frame, and an arm rest release handle coupled to the locking mechanism and mounted to the arm rest for movement between an upward releasing position releasing the locking mechanism and a downward locking position locking the locking mechanism so that the arm-support surface can be locked in an infinite number of positions relative to the intermediate frame.

As described above, intermediate frame 468 includes transversely-extending front member 744 adjacent to front strut 572 and connecting first and second side struts 556, 558 of intermediate frame 468 as shown in FIGS. 15 and 25. A pair of spaced-apart flanges 748 is rigidly attached to and extends forwardly from member 744. In addition, transversely-extending cross member 742 is generally parallel to member 744 and connects seat section frame member 670 of first reclining assembly 628 to seat section frame member 670 of second reclining assembly 630 as shown in FIG. 15. A pair of spaced-apart flanges 766 is attached to and extends generally forwardly from cross member 742 and a second pair of spaced-apart flanges 754 is attached to and extends generally forward and downwardly from cross member 742. Leg deployment assembly 632 is pivotably mounted to cross member 742 by flanges 754, 766 and front member 744 by flanges 748.

When the caregiver moves back section 422 away from the sitting-up position and toward the table position so that control plate 472 rotates in direction 732 about axis 448 and moves seat section frame member 670 generally forwardly relative to intermediate frame 468, cross member 742 travels generally forwardly along with seat section frame member 670 and moves away from frame member 744. Separation of cross member 742 from front intermediate frame member 744 causes leg deployment assembly 632 to automatically open from the closed position shown in FIG. 21, through a transitional position shown in FIG. 22, to the opened position shown in FIG. 23.

Leg deployment assembly 632 includes a swing link 746 pivotably mounted to stationary flange 748 for swinging movement between a downward closed position shown in FIG. 21 and an upward open position shown in FIG. 23. Leg deployment assembly 632 also includes a driven link 752 mounted to flange 754 of seat section 426 and connecting flange 754 to swing link 746 so that as seat section 426 moves between the sitting-up position and the table position, driven link 752 swings swing link 746 between the closed position and the open position, respectively. Stationary flange 748 is fixed to member 744 of intermediate frame 468 and flange 754 is attached to member 742 which is fixed to seat section 426 so that as front end 410 of seat section 426 moves away from front end 410 of intermediate frame 468 when patient support 420 moves to the table position, driven link 752 swings swing link 746 upwardly to the open position.

A first mobilizing link 758 of leg deployment assembly 632 couples front end 410 of swing link 746 to a first cross link 762 of leg deployment assembly 632 as shown in FIGS. 15 and 21–23. First cross link 762 has a first end pivotably coupled to front end 410 of flange 766 and a second end pivotably coupled to a second mobilizing link 784 connecting cross link 762 to strut 780 of leg section 430 so that as swing link 746 moves from the closed position to the open position, swing link 746 pushes first mobilizing link 758 upwardly, pivoting first cross link 762 upwardly, pushing second mobilizing link 784 upwardly, thereby moving leg section 430 from the sitting-up position upwardly to the table position.

A following link 770 of leg deployment assembly 632 is pivotably coupled to a rear end 412 of flange plate 766 spaced apart from first cross link 762 as shown in FIGS. 21–23. Following link 770 is pivotably coupled to a third mobilizing link 774 of leg deployment assembly 632 and a middle portion of third mobilizing link 774 is pivotably coupled to a middle portion of first cross link 762 as shown best in FIGS. 22 and 23 so that second and third mobilizing links 784, 774 cooperate with first cross link 762 to establish the orientation of strut 780 and thus leg section 430.

When the caregiver moves recline handle 450 releasing locking mechanism 636 and then moves patient support 420 from the sitting-up position toward the table position, front end 410 of seat section 426 moves away from front end 410 of intermediate frame 468 and flanges 754, 766 move with seat section 426 away from flange 748 as shown in FIGS. 21–23. Flange 754 pulls driven link 752 upwardly swinging swing link 746 forwardly and upwardly. Swing link 746 pushes mobilizing link 758 forwardly swinging first cross link 762 forwardly and upwardly pushing mobilizing link 784 upwardly and pulling mobilizing link 774 forwardly and upwardly, deploying leg section 430 from the sitting-up position toward the table position. Mobilizing link 774 pulls following link 770 swinging following link 770 forwardly and upwardly relative to flange 766 as leg section 430 deploys.

As shown, for example, in FIGS. 21–23, during movement of leg section 430 from the sitting-up position to the table position, second mobilizing link 784 unfolds relative to cross link 762 and third mobilizing link 774 unfolds relative to following link 770 and cross link 762 moving leg-support surface 432 from facing forwardly as shown in FIGS. 14, 16 and, 21, to facing upwardly and generally coplanar with seat support surface 428 as shown in FIGS. 16 and 23. It can also be seen that when patient support 420 is in the table position, leg section 430 is longitudinally separated from seat section 426 by a distance 788, shown in FIG. 23.

When back, seat, and leg sections 422, 426, 430 are locked in the table position and leg deployment assembly 632 is opened, the caregiver can release locking mechanism 636 and pull back section 422 upwardly and forwardly relative to seat section 426 in direction 423 toward the sitting-up position. Movement of back section 422 in direction 423 automatically moves front end 410 of seat section 426 downwardly toward front end 410 of intermediate frame 468 moving flanges 754, 766 toward flange 748.

As flanges 754, 766 of seat section 426 move toward flange 748 of intermediate frame 468, flange 754 pushes driven link 752 downwardly swinging swing link 746 rearwardly and downwardly, pulling mobilizing link 758, first cross link 762, and third mobilizing link 774 downwardly, thereby pulling leg section 430 downwardly from the table position-toward the sitting-up position. When the caregiver moves patient support 420 to the desired position, the caregiver releases handle 450 on arm rest assembly 434 and locking mechanism 636 locks, blocking further movement of patient support 420.

As previously described, chair 400 includes a first arm rest assembly 434 mounted to first side 414 of chair 400 and a second arm rest assembly 434 mounted to second side 416 of chair 400. Each arm rest assembly 434 includes an arm rest 436 having an upwardly-facing arm-support surface 454 and an arm rest release handle 452 for unlocking arm rest 436 for upward and downward movement relative to seat section 426. The description below of arm rest assembly 434 mounted to first side 414 of chair 400 and shown in FIG. 25 applies as well to arm rest assembly 434 mounted to second side 416 of chair 400 unless specifically noted otherwise.

Arm rest assembly 434 includes arm rest 436 connected to a plate 812 extending generally downwardly from arm rest 436 as shown in FIG. 25. A front guide post 814 is mounted to arm rest 436 and extends downwardly therefrom adjacent to front end 410 of plate 812 and a rear guide post 816, spaced apart behind post 814, is mounted to arm rest 436 and extends downwardly therefrom adjacent to rear end 412 of plate 812. Arm rest assembly 434 also includes a housing 800 including a support member 802 mounted to intermediate frame 468 and a cover 804 including an upper cover 839 and a lower cover 842. Support member 802 is formed to include front and rear guides 818, 820 receiving front and rear posts 814, 816, respectively. Front and rear guides 818, 820 cooperate with front and rear guide posts 814, 816 to guide the upward and downward movement of plate 812 and arm rest 436 relative to support member 802 and intermediate frame 468 as shown in FIG. 25.

Support member 802 is also formed to include a lower strut 808 as shown in FIG. 25. Front and rear guides 818, 820 are mounted to strut 808 and extend upwardly therefrom. A support strut 826 is spaced apart above strut 808 and is attached to-front and rear guides 818, 820 to support front and rear guides 818, 820. A front connector 822 couples front end 410 of strut 826 and front end 410 of strut 808 to a corresponding front strut 572 of intermediate frame 468. A rear connector 824 is spaced apart behind front connector 822 and couples rear end 412 of strut 826 and rear end 412 of strut 808 to a corresponding rear strut 582 of intermediate frame 468. Front and rear connectors 822, 824 are attached to front and rear struts 572, 582, respectively, so that support member 802 is spaced apart from struts 556 of intermediate frame 468 sufficiently to allow room for the operation of reclining assembly 628 and control plate 472 without interference from arm rest assemblies 434.

Arm rest assembly 434 includes a locking mechanism 828 movable between a locking position blocking movement of plate 812 and arm rest 436 relative to support member 802 and intermediate frame 468 and a releasing position allowing movement of arm rest 436 and plate 812 relative to support member 802 and intermediate frame 468. Locking mechanism 828 includes a spring clutch having a clutch housing 830 and a rod 832 received by clutch housing 830 for sliding movement. Rod 832 is mounted to plate 812 and extends downwardly therefrom as shown in FIG. 25. Clutch housing 830 is mounted to a middle guide 834 of support member 802 and to a middle portion of strut 808 and rod 832 is received by clutch housing 830. The spring clutch is coupled to arm rest release handle 452 by a bowden wire 836 having a flexible control cable 837 surrounded by a sheath. Although locking mechanism 828 includes a spring clutch, it is within the scope of the invention as presently perceived for locking mechanism 828 to include any locking mechanism as described above with reference to locking mechanism 180 which is suitable for locking arm rest 436 to intermediate frame 468.

When arm rest release handle 452 is in the downward locking position, locking mechanism 828 is locked and blocking the sliding movement of rod 832 relative to clutch housing 830, thereby locking plate 812 and arm rest 436 relative to support member 802 and intermediate frame 468, blocking upward and downward movement of arm rest 436 and plate 812 relative to support member 802 and intermediate frame 468. When the caregiver moves arm rest release handle 452 to the upward releasing position, control cable 837 of bowden wire 836 moves locking mechanism 828 to the releasing position so that rod 832 can slide relative to clutch housing 830, and plate 812 and arm rest 436 can move upwardly and downwardly relative to support member 802 and intermediate frame 468.

Upper cover 839 is "segmented" having a top portion 838 and a bottom portion 840 appended to top portion 838. Upper and lower covers 839, 842 shield guides 818, 834, 820, posts 814, 816, and locking mechanism 828 from view as shown in FIGS. 14 and 25. Upper cover 839 is attached to plate 812 to move upwardly and downwardly therewith. Lower cover 842 is attached to guides 818, 820 and remains fixed relative to intermediate frame 468 during upward and downward movement of arm rest 436. Thus, upper cover 839 telescopes relative to lower cover 842 during upward and downward movement of arm rest 436.

Figure 26:
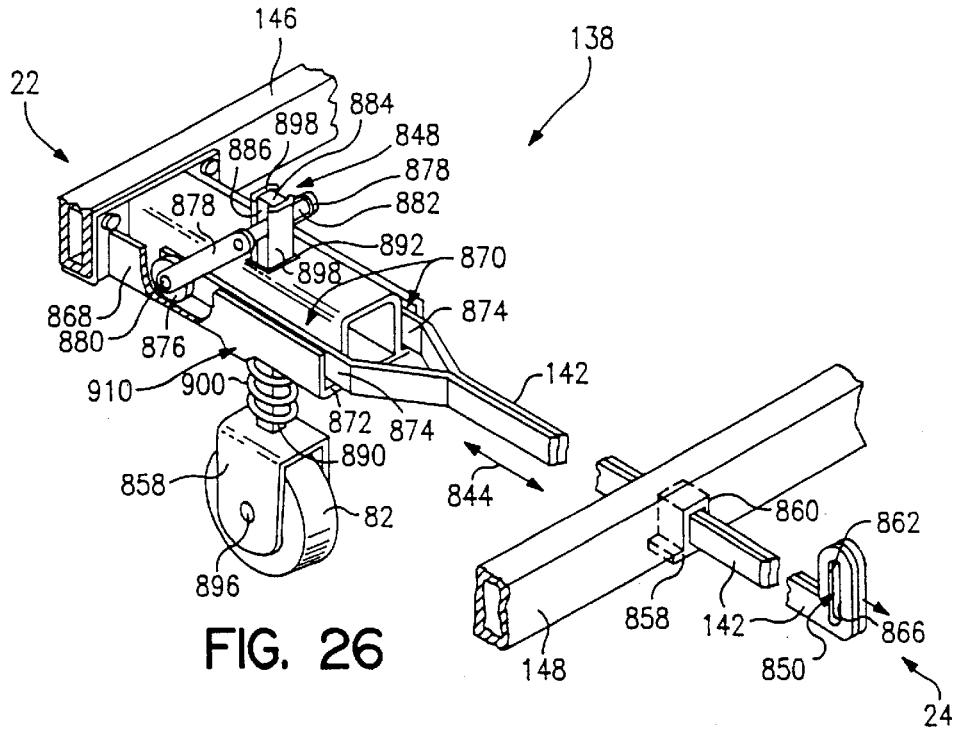
FIG. 26 is an enlarged perspective view of the center wheel and a portion of the center wheel deployment assembly of the chairs of FIGS. 7 and 15 with portions broken away showing a roller track housing mounted to the lower frame and including a pair of longitudinally-extending spaced-apart roller tracks, and an elongated fork having a rear end formed to include a vertical slot and extending frontwardly from the rear end through an opening of the base frame to two spaced-apart fork prongs, each fork prong extending frontwardly into one of the channels and being pivotably coupled to a roller arm, a roller being rotatably mounted to each roller arm and rolling along the roller track, the roller arms being coupled to a lifting pin connected to the center wheel by a center wheel post so that movement of the fork moves the rollers along the roller tracks and pivots the roller arms raising and lowering the lifting pin, the center wheel post, and the center wheel out of and into engagement with the floor.
Figure 27:
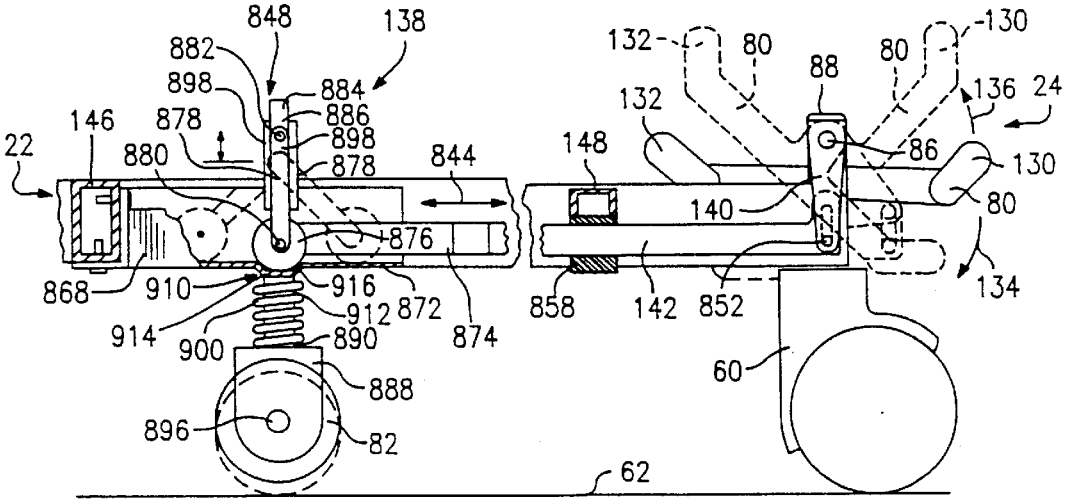
FIG. 27 is a side elevation view of the center wheel and center wheel deployment assembly of FIG. 26 with portions broken away showing the brake-steer pedal fixed to the brake-steer shaft and in a generally horizontal neutral position and a pivot link fixed to the brake-steer shaft and being pivotably coupled to the fork at the slot, each roller being received by an indentation formed in the roller track defining the neutral position at which the rollers and the roller arms hold the center wheel post and center wheel in the upward neutral position spaced apart from the floor, the center wheel post and center wheel moving downwardly when the caregiver moves the brake-steer pedal to a steering position (in phantom) pulling the fork and the pair of rollers toward the brake-steer shaft and moving downwardly when the caregiver moves the brake-steer pedal to a braking position (in phantom) pushing the fork and the pair of rollers away from the brake-steer shaft so that the center wheel engages the floor.

As previously described, first embodiment chair 20 and second embodiment chair 400 each include center wheel deployment assembly 138 that moves center wheel 82 into and out of contact with floor 62 as shown in FIGS. 26 and 27. Although brake-steer pedal 80 and brake-steer shaft 86 of chair 20 are shown in FIG. 26 it will be readily apparent to those skilled in the art that brake-steer pedal wings 456 and brake-steer shaft 460 of chair 400 are employed to actuate center wheel deployment assembly 138 when center wheel deployment assembly 138 is installed onto chair 400.

Center wheel deployment assembly 138 includes elongated fork 142 and pivot link 140 connecting fork 142 to shaft 86 as shown in FIGS. 26 and 27. Rear end 24 of fork 142 is formed to include a vertically-extending slot 850 and front end 22 of fork 142 is coupled to a lifting subassembly 848 of center wheel deployment assembly 138 as shown best in FIG. 26. Pivot link 140 is coupled to fork 142 by a pivot pin 852 fixed to link 140 and received by slot 850 for pivoting and sliding movement therein.

Rear member 148 of lower frame 92 is formed to include an opening 860 carrying a bushing 858 as shown in FIG. 26. Fork 142 is slidably received by bushing 858 for movement in longitudinal direction 844. Thus, link 140 pivots in-response to rotation of shaft 86 and fork 142 slides within bushing 858 in direction 844 relative to rear member 148 of lower frame 92. Movement of fork 142 in direction 844 actuates subassembly 848 moving center wheel 82 into and out of contact with floor 62.

When pedal 80 is in the generally horizontal neutral position, center wheel 82 is spaced apart from floor 62 as shown in FIG. 27 and fork 142 is in a neutral position having slot 850 positioned to lie generally underneath shaft 86. When the caregiver presses braking portion 130 of pedal 80, shaft 86 rotates about axis 88 in braking direction 134, link 140 pivots about axis 88 in direction 134, and pin 852 engages a front edge 862 of slot 850 pushing fork 142 forwardly. As fork 142 slides forwardly from the neutral position and link 140 continues to pivot in direction 134, pin 852 slides upwardly in slot 850. Once pedal 80 is in the braking position, fork 142 is in a forward position and subassembly 848 yieldably biases center wheel 82 against floor 62.

Similarly, when fork 142 is in the neutral position and the caregiver presses steering portion 132 of pedal 80, shaft 86 rotates about axis 88 in steering direction 136, link 140 pivots about axis 88 in direction 136, and pin 852 engages a rear edge 866 of slot 850 pulling fork 142 rearwardly. As fork 142 slides rearwardly from the neutral position and link 140 continues to pivot in direction 136, pin 852 slides upwardly in slot 850. Once pedal 80 is in the steering position, fork 142 is in a rearward position and subassembly 848 yieldably biases center wheel 82 against floor 62 as shown in FIG. 27 (in phantom). Thus, movement of pedal 80 between the braking position and the steering position moves fork 142 between the forward position and the rearward position, respectively, moving center wheel 82 from engagement with floor 62 upward to the neutral position and back downward into engagement with floor 62.

Center wheel deployment assembly 138 includes a roller track housing 868 cantilevered to front member 146 of lower frame 92 and extending rearwardly therefrom as shown in FIGS. 26 and 27. Roller track housing 868 includes an upwardly-facing roller track 872 and first and second spaced-apart channels 870 defined above roller track 872 as shown best in FIG. 26. Front end 22 of fork 142 includes a pair of spaced-apart prongs 874, each prong 874 extending frontwardly into a corresponding channel 870 of roller track housing 868.

Lifting subassembly 848 includes first and second rollers 876 each of which is rotatably mounted to front end 22 of a corresponding prong 874 as shown in FIGS. 26 and 27. First roller 876 is received in first channel 870 and second roller 876 is received in second channel 870 and rollers 876 roll back and forth along roller tracks 872 as fork 142 reciprocates. between the forward and rearward positions. A first roller arm 878 of lifting subassembly 848 is pivotably coupled to first roller 876 by a first axle pin 880 and a second roller arm 878 is pivotably coupled to second roller 876 by a second axle pin 880.

Lifting subassembly 848 also includes a transversely-extending lifting pin 882 and roller arms 878 couple each pin 880 to lifting pin 882 as shown best in FIG. 26. Lifting pin 882 is pivotably coupled to a top end 884 of a center wheel post 886 as shown in FIGS. 26 and 27. Roller track housing 868 is formed to include a vertically-extending aperture 892 having a square-shaped cross section. Aperture 892 receives center wheel post 886 for vertical sliding movement. A pair of vertically-extending guide channel plates 898 are received in aperture 892 and are fixed to roller track housing 868. Plates 898 guide the vertical movement of center wheel post 886 as shown best in FIG. 27 between a raised position and a lowered position so that lifting pin 882 moves vertically with post 886 in aperture 892. When rollers 876 roll along roller tracks 872, roller arms 878 pivot about pins 880 raising and lowering lifting pin 882 and center wheel post 886 relative to plates 898, housing 868, and floor 62.

Center wheel post 886 extends downwardly through aperture 892 and a center wheel bracket 888 is mounted to a bottom end 890 of center wheel post 886 underneath housing 868. Center wheel 82 is mounted to center wheel bracket 888 for rotation about a transversely-extending center wheel axle 896 as shown in FIG. 26. A spring 900 is mounted in compression on post 886 underneath housing 868 and yieldably biases bracket 888, and center wheel 82 downwardly away from housing 868.

When pedal 80 is in the braking position and fork 142 is in the forward position, rollers 876 are positioned to lie in front of post 886 and roller arms 878 angle downwardly and forwardly from lifting pin 882 to axle pin 880 as shown in FIGS. 26 and 27 (in phantom in FIG. 27) so that post 886 is in the lowered position and center wheel 82 is in the downward brake-steer position. When pedal 80 is in the steering position and fork 142 is in the rearward position, rollers 876 are positioned to lie behind post 886 and roller arms 878 angle downwardly and rearwardly from lifting pin 882 to axle pin 880 as shown in FIG. 27 (in phantom) so that again post 886 is in the lowered position and center wheel 82 is in the downward brake-steer position. When the caregiver moves pedal 80 to the neutral position, fork 142 moves to the neutral position and rollers 876 and roller arms 878 move to a vertical locking position placing rollers 876 vertically beneath pin 882 so that roller arms 878 extend generally vertically lifting pin 882. Thus, when pedal 80 is in the neutral position, roller arms 878 extend generally vertically lifting pin 882 and post 886 to the raised position so that center wheel 82 is in the upward neutral position spaced apart from floor 62.

When subassembly 848 is in the neutral position, rollers 876 are received by an indentation 910 defined by a bottom wall 912, a front ramp 914, and a rear ramp 916 of each roller track 872. Post 886 is yieldably biased downwardly so that rollers 876 firmly engage bottom walls 912 and front and rear ramps 914, 916 to lock rollers 876 and roller arms 878 in the vertical locking position thereby locking pedal 80 in the horizontal neutral position and locking center wheel 82 in the neutral position spaced apart from floor 62 as shown in FIG. 27.

When the caregiver presses braking portion 130 of pedal 80 pivoting pedal 80, shaft 86, and link 140 in direction 134 toward the braking position, fork 142 moves forwardly toward the forward position and rollers 876 roll forwardly away from bottom wall 912. When rollers 876 move out of indentation 910 and past ramp 914, spring 900 urges rollers 876 forwardly and bracket 888, post 886, and center wheel 82 downwardly until center wheel 82 reaches the brake-steer position engaging floor 62.

Similarly, when the caregiver presses steering portion 132 of pedal 80 pivoting pedal 80, shaft 86, and link 140 in direction 136 toward the steering position, fork 142 moves rearwardly toward the rearward position and rollers 876 roll rearwardly away from bottom wall 912. When rollers 876 move out of indentation 910 and past ramp 916, spring 900 urges rollers 876 rearwardly and bracket 888, post 886, and center wheel 82 downwardly until center wheel 82 reaches the brake-steer position engaging floor 62.

When center wheel 82 engages floor 62, spring 900 biases center wheel 82 to a position past the plane of floor 62 and past the plane defined by the bottoms of front and rear caster 58, 60. Of course, floor 62 limits the downward movement of deployed center wheel 82. However, if floor 62 has a surface that is not planar or that is not coincident with the plane defined by the bottoms of front and rear casters 58, 60, spring 900 cooperates with roller track housing 868 and bracket 888 to maintain contact between center wheel 82 and floor 62. For example, when chair 20 passes over a threshold of a doorway, the plane defined by the bottoms of front and rear casters 58, 60 is not necessarily coplanar with floor 62. However, spring 900 maintains engagement of deployed center wheel 82 against floor 62.

Center wheel deployment assembly 138 can maintain engagement between deployed center wheel 82 and floor 62 when floor 62 beneath center wheel 82 is spaced apart up to approximately 0.75 inch (1.9 cm) beneath the plane defined by the bottoms of front and rear casters 58, 60. Additionally, center wheel deployment assembly 138 allows deployed center wheel 82 to pass over a threshold that is approximately 0.75 inch (1.9 cm) above the plane defined by the bottoms of front and rear casters 58, 60.

An alternative embodiment of a center wheel deployment assembly 920 that can be mounted to either lower frame 92 of chair 20 or lower frame 492 of chair 400 and operated to move center wheel 82 between the neutral position spaced apart from floor 62 and the brake-steer position engaging floor 62 is shown in FIGS. 28–33. The description below of center wheel deployment assembly 920 of chair 400 applies as well to chair 20 unless specifically noted otherwise.

Figure 28:
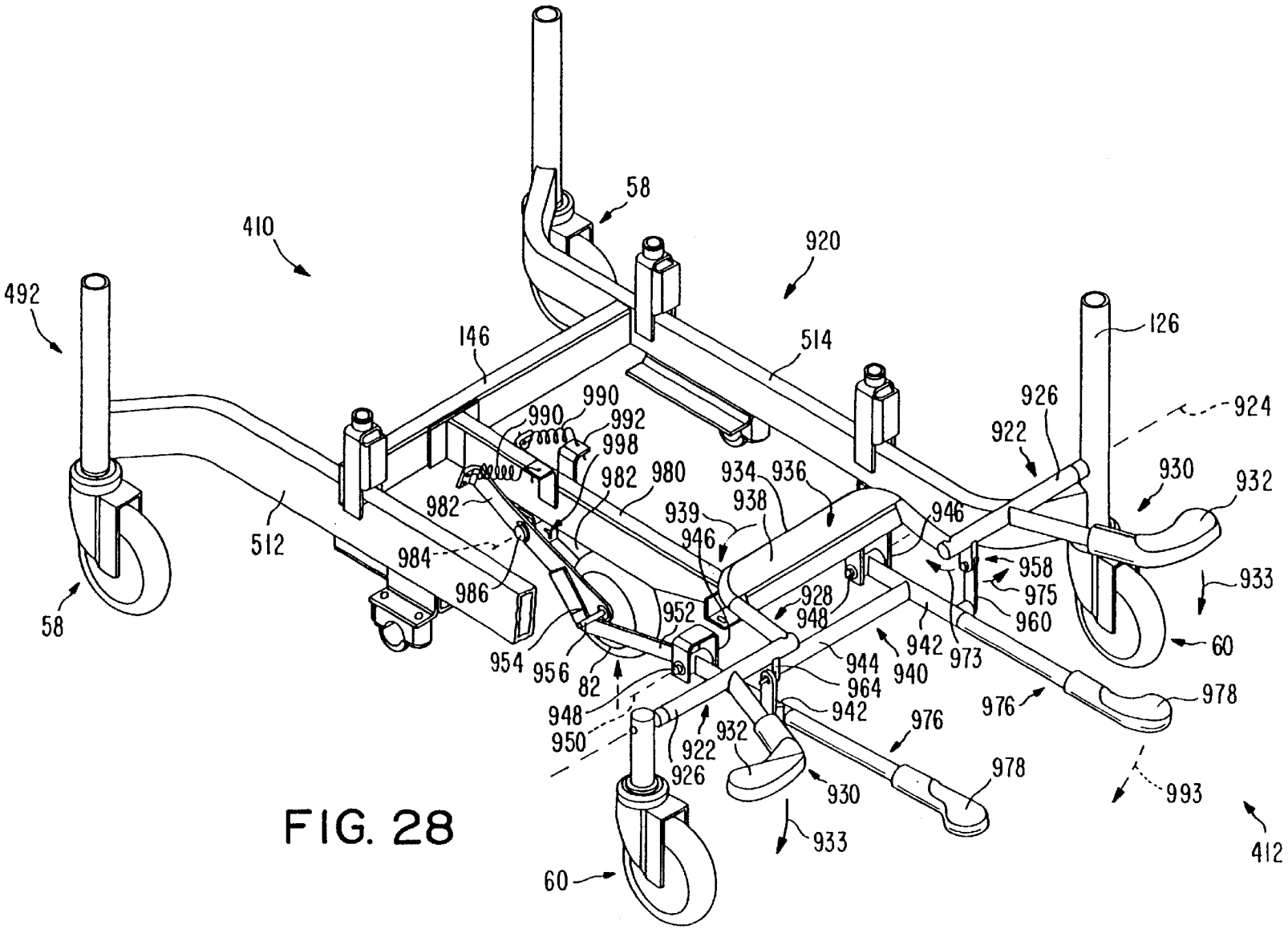
FIG. 28 is a perspective view of the lower frame of the chair of FIGS. 14–25 showing an alternative embodiment center wheel deployment assembly attached to the lower frame, the center wheel deployment assembly including a brake-steer shaft positioned to lie above a control truss and coupled thereto by a pair of spaced apart coupling linkages, a pair of spaced-apart neutral pedals extending rearwardly from the control truss, and a scoop bar extending forwardly from the control truss to engage an exposed portion of a center wheel axle pin.

Assembly 920 includes a brake-steer shaft 922 mounted to rear tubes 126 of lower frame 492 for pivoting movement about a horizontal transverse pivot axis 924 as shown best in FIG. 28. Brake-steer shaft 922 includes a pair of spaced-apart horizontal tubes 926 extending transversely inwardly from respective rear tubes 126 and a generally U-shaped tube 928 connecting horizontal tubes 926. A brake pedal 930 having an upwardly-facing braking surface 932 is appended to each horizontal tube 926 and extends generally rearwardly therefrom. U-shaped tube 928 extends generally forwardly from tubes 926 and includes both a central offset portion 934 and a steer pedal 936 having an upwardly-facing steering surface 938 mounted to offset portion 934 as shown in FIG. 28.

Figure 29:
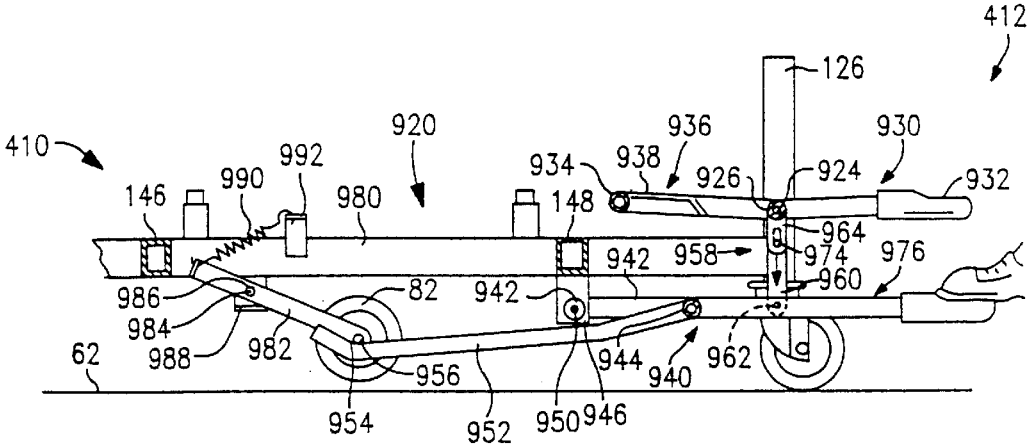
FIG. 29 is a side elevation view of the lower frame and the center wheel deployment assembly of FIG. 28 showing the brake-steer shaft in a generally horizontal neutral position, the control truss in a generally horizontal neutral, position, the coupling linkages in an in-line orientation, and the center wheel in a neutral position lifted off of the floor by the scoop bar.
Figure 30:
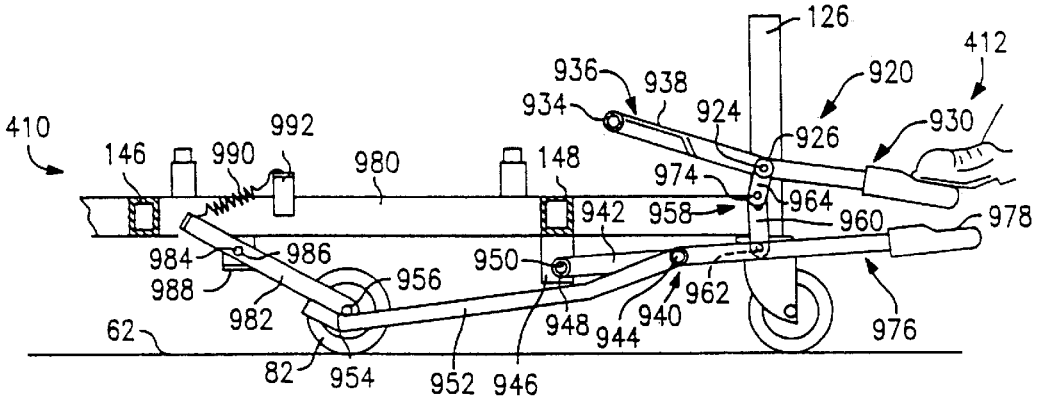
FIG. 30 is side elevation view of the lower frame and the center wheel deployment assembly similar to FIG. 29 showing the brake-steer shaft tilted rearwardly to a braking position, the control truss tilted forwardly, the coupling linkages in a forward-fold orientation, and the center wheel in a brake-steer position engaging the floor.

Applying a downward contact force to braking surface 932 of either brake pedal 930 rotates shaft 922 about pivot axis 924 in a braking direction indicated by arrows 933 shown in FIG. 28 until shaft 922 and pedals 930 reach a braking position shown in FIG. 30. Applying a downward contact force to steering surface 938 of steer pedal 936 rotates shaft 922 about axis 924 in a steering direction indicated by arrow 939 shown in FIG. 28 until shaft 922 and pedal 936 reach a steering position shown in FIG. 31. Shaft 922 has a generally horizontal neutral position shown in FIG. 29 between the braking and steering positions.

Shaft 922 is coupled to each rear caster 60 by a conventional braking mechanism (not shown) well-known to those skilled in the art. When shaft 922 is in the braking position, the braking mechanism moves to a braking position braking rear casters 60 and preventing rear casters 60 from rotating and swivelling. When shaft 922 is in either the neutral position or the steering position, the braking mechanism moves to a releasing position releasing rear casters 60 so that rear casters 60 can freely rotate and swivel. Each braking mechanism is attached to shaft 922 and is positioned to lie inside a corresponding rear tube 126.

Assembly 920 includes a generally H-shaped control truss 940 having a pair of spaced apart longitudinally-extending tubes 942 and a cross tube 944 extending transversely therebetween. Front end 410 of each tube 942 is mounted to frame member 148 of lower frame 492 for pivoting movement about a horizontal transverse pivot axis 950 by a pivot pin 948 which is coupled to a U-shaped bracket 946 depending from frame member 148 as shown in FIGS. 28–31. Control truss 940 also includes a scoop bar 952 appended to cross tube 944 and extending forwardly therefrom. Front end 410 of scoop bar 952 is formed to include an elbow portion having a concave top surface 954 that engages an exposed portion of an axle pin 956 to which center wheel 82 is mounted for rotation.

Assembly 920 further includes a longitudinally-extending strut 980 connecting front frame member 146 and rear frame member 148 between side members 512, 514 of lower frame 492 as shown in FIGS. 28–31. A pair of center wheel arms 982 are mounted to strut 980 for pivoting movement about a horizontal transverse pivot axis 984 by a pivot pin 986 which is coupled to a U-shaped bracket 988 depending from strut 980. Center wheel arms 982 are spaced apart to receive center wheel 82 therebetween. In addition, center wheel 82 is rotatably coupled to rear ends 412 of each center wheel arm 982 by axle pin 956.

A spring 990 connects the front end 410 of each center wheel arm 982 to a respective bent flange 992 extending upwardly from a middle portion of strut 980 as shown best in FIG. 28. Springs 990 are held in tension so that center wheel 82 is biased toward floor 62 when center wheel 82 is in the neutral position and so that center wheel 82 is yieldably biased against floor 62 when center wheel 82 is in the brake-steer position to provide a frictional contact area with floor 62 about which chair 400 can be easily turned. In addition, springs 990 bias the exposed portion of axle pin 956 into contact with concave top surface 954 of scoop bar 952.

Figure 32:
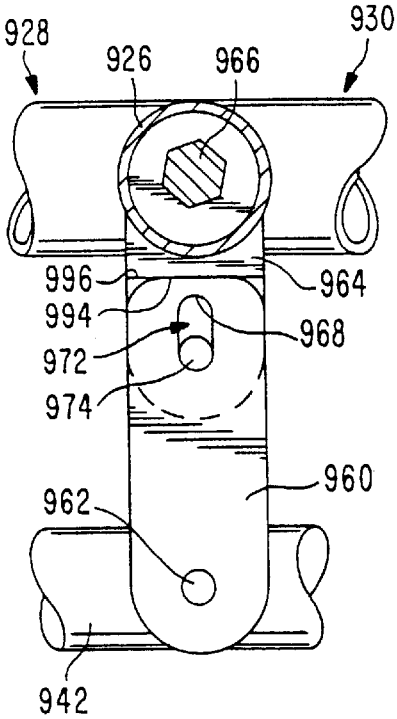
FIG. 32 is side elevation view of one of the coupling linkages of FIG. 31 showing an upper link of the coupling linkage rigidly attached to the brake-steer shaft by a hexagonal-shaped pin, a lower link of the coupling linkage pivotably coupled to the control truss, the lower link formed to include a slot that receives a coupling pin so that the upper and lower links are coupled together, and the lower link having a flat top edge that engages a stop edge formed in the upper link when the coupling linkages are in the in-line orientation.
Figure 33:
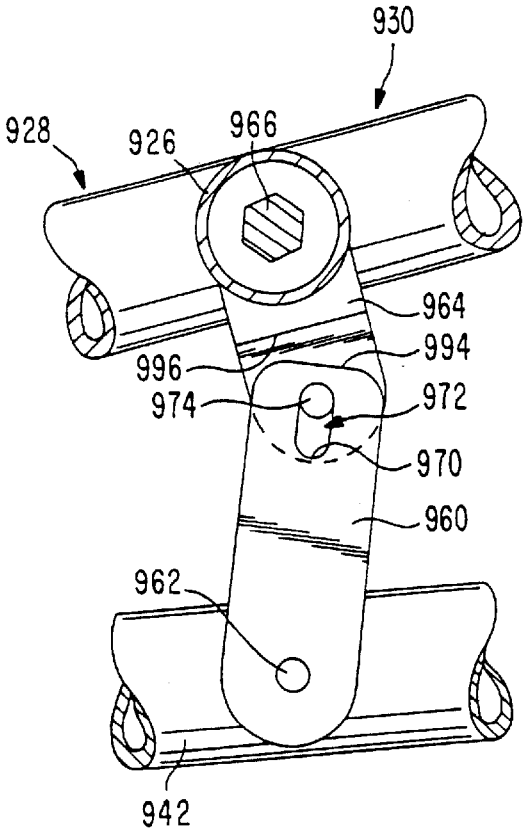
FIG. 33 is side elevation view similar to FIG. 32 showing the coupling linkage in the rearward-fold orientation having the stop edge of the upper link separated away from the top edge of the lower link and having the coupling pin moved upwardly in the slot to engage an upper edge of the lower link.

Control truss 940 is positioned to lie below brake-steer shaft 922 and is connected thereto by a pair of spaced apart coupling linkages 958. Each coupling linkage 958 includes a lower link 960 which is pivotably coupled to rear end 412 of a respective tube 942 by a pivot pin 962. Each coupling linkage 958 also includes an upper link 964 which is rigidly coupled to a corresponding horizontal tube 926 by a hexagonal-shaped pin 966 as shown in FIGS. 32 and 33. Each lower link 960 includes an upper edge 968 cooperating with a lower edge 970 to define a slot 972. A coupling pin 974 connects each of upper links 964 to respective lower links 960 and each pin 974 is received by a corresponding slot 972 for rotating and sliding movement.

Assembly 920 includes a pair of longitudinally-extending spaced-apart neutral pedals 976 each of which includes an upwardly-facing foot-engaging surface 978. Each neutral pedal 976 connects to the rear end 412 of a corresponding tube 942 of control truss 940 as shown in FIG. 28. Applying a contact force to either foot-engaging surface 978 of neutral pedals 976 moves control truss 940 to a generally horizontal neutral position and moves shaft 922 and center wheel 82 to their respective neutral positions through the operation of linkages 958.

When shaft 922 moves in braking direction 933, upper link 964 pivots forwardly moving coupling pin 974 forwardly in a direction indicated by arrow 973 shown in FIG. 28 thereby moving linkages 958 into a forward-fold orientation as shown in FIG. 30. Forward folding movement of linkages 958 pulls pivot pin 962 upwardly resulting in forward tilting movement of control truss 940 about pivot pin 948. As control truss 940 tilts forwardly, center wheel 82 moves downwardly into the brake-steer position due to downward movement of front end 410 of scoop bar 952.

Figure 31:
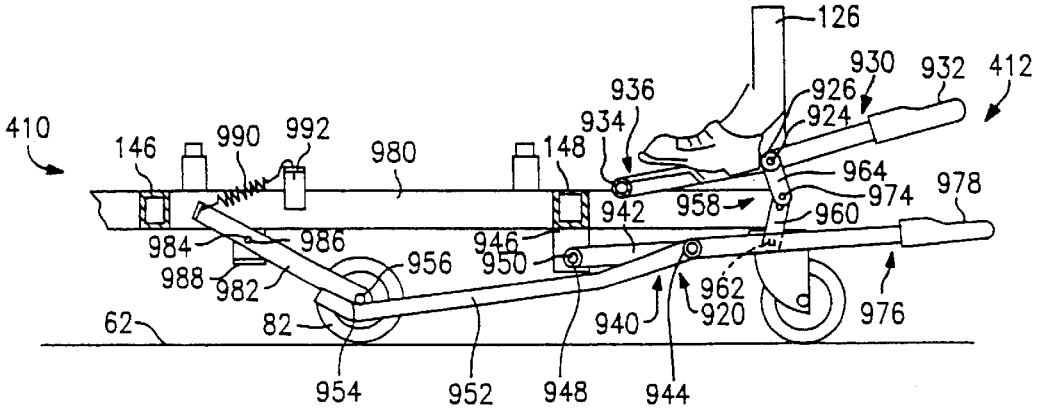
FIG. 31 is side elevation view of the lower frame and the center wheel deployment assembly similar to FIG. 30 showing the brake-steer shaft tilted forwardly to a steering position, the control truss tilted forwardly, the coupling linkages in a rearward-fold orientation, and the center wheel in the brake-steer position engaging the floor.

When shaft 922 moves in steering direction 939, upper link 964 pivots rearwardly moving coupling pin 974 rearwardly in a direction indicated by arrow 975 shown in FIG. 28 thereby moving linkages 958 into a rearward-fold orientation as shown in FIG. 31. Rearward folding movement of linkages 958 pulls pivot pin 962 upwardly resulting in forward tilting movement of control truss 940 about pivot pin 948 and downward movement of center wheel 82 into the brake-steer position due to downward movement of front end 410 of scoop bar 952. Thus, when linkages 958 are in either the forward-fold or rearward-fold orientations center wheel 82 is in the brake-steer position engaging floor 62.

When shaft 922 is in the braking position, applying a downward contact force to foot-engaging surface 978 of either neutral pedal 976 results in rearward tilting movement of control truss 940 about axis 950 in a direction indicated by arrow 993 shown in FIG. 28 (in phantom). As control truss 940 rearwardly tilts, pivot pin 962 pulls lower link 960 downwardly thereby moving linkages 958 from the forward-fold orientation into an in-line orientation shown in FIG. 29. Similarly, when shaft 922 is in the steering position, applying a downward contact force to foot-engaging surface 978 of either neutral pedal 976 results in rearward tilting movement of control truss 940 about axis 948 in direction 993, downward movement of pivot pin 962 and lower link 960, and movement of linkages 958 from the rearward-fold orientation into the in-line orientation. Rearward tilting movement of control truss 940 causes top surface 954 of scoop bar 952 to lift axle pin 956 upwardly thus moving center wheel 82 out of engagement with floor 62.

When linkages 958 are in the in-line orientation shaft 922 is in the generally horizontal neutral position having center wheel 82 spaced apart from floor 62 and control truss 940 is in the generally horizontal neutral position as shown in FIGS. 28 and 29. In addition, when linkages 958 are in the in-line orientation, a flat top edge 994 of lower link 960 abuts a flat stop edge 996 formed in a middle portion of upper link 964 as shown in FIG. 32.

Springs 990 urge center wheel 82 downwardly and urge the exposed portion of axle pin 956 downwardly into contact with top surface 954 of scoop bar 952 when center wheel is in the neutral position, as previously described. Downward urging of axle pin 956 against scoop bar 954 urges control truss 940 to forwardly tilt about axis 950 thus urging top edge 994 of lower link 960 upwardly into engagement with stop edge 996 of upper link 964 as shown in FIG. 32. Engagement of top edge 994 with stop edge 996 under the urging of springs 990 "locks" control truss 940, shaft 922, and center wheel 82 in their respective neutral positions.

When linkages 958 are each in the in-line orientation, coupling pin 974 is adjacent to lower edge 970 of lower link 960 as shown in FIG. 32. When shaft 922 is moved in direction 933 or direction 939 thus moving coupling pin in direction 973 or direction 975, respectively, coupling pin 974 moves upwardly in slot 972 away from lower edge 970 into engagement with upper edge 968. In addition, stop edge 996 of upper link 964 separates away from top edge 994 of lower link 960 as shown, for example, in FIG. 33.

It can be seen that chairs 20, 400 facilitate improved caregiver efficiency and productivity by offering a variety of positions for patient examination and treatment. Each chair 20, 400 includes a "hydraulic hi-lo" activated by the caregiver using foot pedal 90, 464 located along the sides of chair 20, 400 allowing infinite height adjustment between the raised position and the lowered position. The range of height adjustment overlaps current stretcher and bed height adjustments so that the ease of surface-to-surface transfer is maximized. In addition, the hydraulic hi-lo allows the caregiver to position the patient at a comfortable working height for patient care and transfer while also enhancing seating comfort for short and tall patients.

The caregiver can move each chair 20, 400 to a "straight-line flat" position having back-support surfaces 36, 424 generally coplanar with seat support surface 40, 428, respectively. Caregivers can move chairs 20, 400 to the straight-line flat position using handles 70, 450, respectively, providing a "true" flat position for caregiver intervention such as small procedures, patient exams, and the like, which may eliminate the need to transfer the patient to another surface.

Chairs 20, 400 also provide Trendelenburg positioning and reverse Trendelenburg positioning in infinite adjustments. The caregiver can activate the Trendelenburg positioning of chair 20 using handle 66 and the caregiver can actuate the Trendelenburg position of chair 400 using handle 446. The Trendelenburg positions are locked until the caregiver is ready to reposition the patient.

Chairs 20, 400 also include infinite recline controls accessible to both the patient and the caregiver (handles 70, 450). The recline controls allow back 35 and leg sections 34, 42 and 422, 430 to recline relative to seat section 38, 426 at any selected position between the sitting-up position and the table position. Once the caregiver releases handles 70, 450, back, seat, and leg sections 34, 38, 42 and 422, 426, 430 remain fixed relative to one another, even when the patient moves.

Each chair 20, 400 also includes push bar 64, 442 which is grasped by the caregiver when the caregiver transports chair 20, 400 across floor 62. Each chair 20, 400 also includes center wheel 82 engaging floor 62 to assist with steering chair 20, 400 during transport of chair 20, 400 and to resist sideways movement of chair 20, 400 when chair 20, 400 is stationary. Brake-steer pedals 80, 456, 494 control the braking and releasing of rear casters 60 and movement of center wheel 82 into and out of engagement with floor 62.

The mechanisms of chairs 20, 400 that control vertical movement, tilting movement, and articulating movement of patient supports 32, 420, respectively, are compactly arranged so that the size of chairs 20, 400 can be minimized. For example, with reference to chair 400 as shown in FIG. 14, drive means 114, scissors linkages 476, control assembly 470, intermediate frame 468, staging frame 466, and lower frame 492 are all positioned to lie between front end 410 of seat section 426 and grip 443 of push bar 442 and below back and seat sections 422, 426 when patient support 420 is in the sitting-up position.

Although the invention has been described in detail with reference to certain preferred embodiments, variations and modifications exist within the scope and spirit of the invention as described and as defined in the following claims.

What is claimed is:

1. A chair comprising a base frame including a front end and a rear end longitudinally spaced apart from the front end, a patient support spaced apart from the base frame and positioned above the base frame, an intermediate frame coupled to the base frame for pivoting movement about a transverse horizontal axis, the intermediate frame including a front end and a rear end longitudinally spaced apart from the front end, the intermediate frame carrying the patient support, a front locking mechanism connecting the front end of the base frame to the front end of the intermediate frame, and a rear locking mechanism connecting the rear end of the base frame to the rear end of the intermediate frame, the front and rear locking mechanisms being operable to allow movement of the intermediate frame relative to the base frame and to block movement of the intermediate frame relative to the base frame.

2. The chair of claim 1, wherein the base frame is formed to include a front edge defining a front slot and a rear edge defining a rear slot longitudinally spaced apart from the front slot and further comprising a front pin received in the front slot for sliding movement within the slot relative to the base frame and a rear pin received in the rear slot for sliding movement within the slot relative to the base frame, the front locking mechanism being connected to the base frame by the front pin and the rear locking mechanism being connected to the base frame by the rear pin.

3. The chair of claim 2, wherein the front locking mechanism includes a front linkage that fixes the front pin relative to the front slot when the front locking mechanism contracts and the rear locking mechanism includes a rear linkage that fixes the rear pin relative to the rear slot when the rear locking mechanism contracts.

4. A chair for supporting a patient above a floor, the chair comprising a lower frame, a staging frame supported above the lower frame, a patient support coupled to the staging frame, the patient support including back and seat sections, the seat section having a front end and a rear end spaced apart from the front end, the back section extending upwardly adjacent to the rear end of the seat section, and a scissors elevation linkage coupling the lower frame to the staging frame, the scissors elevation linkage being movable to raise and lower the staging frame and patient support relative to the lower frame, and the scissors elevation linkage being positioned to lie beneath the seat and back sections.

5. The chair of claim 4, wherein the scissors elevation linkage includes a top end and the staging frame is formed to include a track having a track plate and the chair further comprising a roller mounted to the top end of the scissors linkage and engaging the track plate of the track formed in the staging frame, the roller rolling on the track plate during movement of the scissors linkage to raise and lower the staging frame.

6. The chair of claim 5, wherein the scissors elevation linkage includes a bottom end and further comprising a lower track depending from the lower frame and a lower roller mounted to the bottom end of the scissors linkage, the lower track having a lower track plate and the roller rolling on the lower track plate during movement of the scissors linkage to raise and lower the staging frame.

7. The chair of claim 4, wherein the scissors elevation linkage includes a bottom end and further comprising a lower track depending from the lower frame and a lower roller mounted to the bottom end of the scissors linkage, the lower track having a lower track plate and the roller rolling on the lower track plate during movement of the scissors linkage to raise and lower the staging frame.

* * * * *